US010135186B2

(12) United States Patent
Dai et al.

(10) Patent No.: US 10,135,186 B2
(45) Date of Patent: Nov. 20, 2018

(54) ELECTRICAL CONNECTION DEVICE

(71) Applicant: LOTES CO., LTD, Keelung (TW)

(72) Inventors: Yong Jun Dai, Keelung (TW); Zuo Feng Jin, Keelung (TW); Tung Ming Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/960,752

(22) Filed: Apr. 24, 2018

(65) Prior Publication Data

US 2018/0309238 A1 Oct. 25, 2018

(30) Foreign Application Priority Data

Apr. 24, 2017 (CN) ..... 2017 2 0428993 U
Jun. 16, 2017 (CN) ..... 2017 2 0701386 U
Jun. 16, 2017 (CN) ..... 2017 2 0701709 U
Jan. 22, 2018 (CN) ..... 2018 1 0059820

(51) Int. Cl.
*H01R 13/10* (2006.01)
*H01R 13/631* (2006.01)
*H01R 12/72* (2011.01)
*H01R 12/75* (2011.01)

(52) U.S. Cl.
CPC ..... *H01R 13/631* (2013.01); *H01R 12/721* (2013.01); *H01R 12/75* (2013.01)

(58) Field of Classification Search
CPC ..... H01R 23/725; H01R 23/7026; H01R 13/631; H01R 13/64; H01R 33/7628; H01R 23/005
USPC ..... 439/682, 567, 374, 680, 569, 941
See application file for complete search history.

(56) References Cited

U.S. PATENT DOCUMENTS 6,045,396 A 4/2000 Tighe
7,581,975 B1 9/2009 Liu et al.
8,529,286 B2 * 9/2013 Su ..... H01R 13/506 439/495
8,556,652 B2 * 10/2013 Kang ..... G02F 1/13452 439/498
8,939,790 B2 * 1/2015 Jung ..... H01R 12/774 439/495

(Continued)

FOREIGN PATENT DOCUMENTS

CN 2779650 Y 5/2006
CN 1725387 B 8/2011

*Primary Examiner* — Phuong Chi T Nguyen
(74) *Attorney, Agent, or Firm* — Locke Lord LLP; Tim Tingkang Xia, Esq.

(57) ABSTRACT

An electrical connection device includes: a first insulating body; a first conductor is accommodated in the first insulating body, a foremost end of a lower surface of the first conductor is provided with a lower edge, and a contact area extends backward from the lower edge; a second mating element including a second conductor located below the first conductor and provided with a front edge and a rear edge and a top surface connected to the front edge and the rear edge; an elastic body located above the first conductor; and a pressing member presses the elastic body and provides a downward acting force such that the first conductor downward abuts the second conductor, the contact area is fully attached to the top surface, the lower edge is located between the front edge and the rear edge and abuts the top surface, and the rear edge abuts the contact area.

39 Claims, 48 Drawing Sheets

(56) References Cited

U.S. PATENT DOCUMENTS

| | | | | |
|---|---|---|---|---|
| 9,070,993 | B2 * | 6/2015 | Honda | H01R 12/88 |
| 9,455,513 | B2 * | 9/2016 | Yokoo | H01R 12/88 |
| 10,050,364 | B1 * | 8/2018 | Morino | H01R 12/87 |

* cited by examiner

100

A-A

100

B–B

100

100

100

100

100

E-E

D–D

F–F

100

ELECTRICAL CONNECTION DEVICE

CROSS-REFERENCE TO RELATED PATENT APPLICATION

This non-provisional application claims priority to and the benefit of, pursuant to 35 U.S.C. § 119(a), patent application Serial No. CN201720428993.1 filed in China on Apr. 24, 2017, patent application Serial No. CN201720701709.3 filed in China on Jun. 16, 2017, patent application Serial No. CN201720701386.8 filed in China on Jun. 16, 2017, and patent application Serial No. CN201810059820.6 filed in China on Jan. 22, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connection device, and in particular to an electrical connection device for high-frequency signal transmission.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In a current electrical connection device, to increase the contacting force between two conductors, it is common to apply an external force to the two conductors for crimping together. To guarantee the stability of crimping, an elastic body is usually adopted to press on the two conductors. For instance, as shown in the Chinese Patent No. 200520053929.7, the electric connector is provided with a cable and an elastic body, the cable has a conductive body, and the elastic body presses on the conductive body of the cable to be crimped with a conductive area of a conductive sheet on another circuit board, thus forming a conductive path between the conductive body and a conductive sheet. However, the ends of the conductive body may be warped up and displaced from the conductive area, thus failing to be in contact with the conductive area, which results in a stake effect that affects the quality of signal transmission. In particular, in high-frequency signal transmission, the negative influence of the stake effect is significant, causing severe signal distortion.

Therefore, a heretofore unaddressed need to design a novel electrical connection device exists in the art to address the aforementioned deficiencies and inadequacies.

SUMMARY

In view of the deficiencies in the background, an objective of the present invention is to provide a novel electrical connection device, which eliminates the stake effect between two separably crimped conductors, such that that the quality of signal transmission can be increased.

To achieve the foregoing objective, the present invention adopts the following technical solution.

An electrical connection device includes: a first mating element including a first insulating body, wherein a first conductor is strip-shaped and is accommodated in the first insulating body, the first conductor is provided with a contact portion exposed forward out of the first insulating body, a foremost end of a lower surface of the contact portion is provided with a lower edge, a contact area extends backward from the lower edge, a pressing member is located right above the first conductor, and an elastic body is located between the pressing member and the first conductor, such that the pressing member is configured to downward abut the elastic body, and the elastic body is configured to downward abut the first conductor; and a second mating element including a second insulating body, wherein a second conductor is provided in the second insulating body and is located below the first conductor, the second conductor is provided with a front edge and a rear edge opposite to each other and a top surface connected to the front edge and the rear edge, and the top surface is exposed out of an upper surface of the second insulating body. The pressing member provides a downward acting force such that the first conductor downward abuts the second conductor; and when the pressing member presses the elastic body, the contact area is fully attached to the top surface, the lower edge is located between the front edge and the rear edge and is conductively connected to the top surface, and the rear edge abuts the contact area.

In certain embodiments, the contact area is narrow at a front thereof and wide at a rear thereof.

In certain embodiments, a foremost end of a upper surface of the contact portion is provided with an upper edge, a pressure-bearing area extends backward from the upper edge, and the elastic body is attached from the pressure-bearing area to the upper edge.

In certain embodiments, the first conductor has a base, the contact portion extends upward from the base, and the upper edge abuts the elastic body.

In certain embodiments, the contact portion extends upward as a whole.

In certain embodiments, along an extending direction of the contact portion, the contact portion first extends downward and then extends obliquely upward.

In certain embodiments, the upper edge is located in front of the lower edge.

In certain embodiments, the second insulating body is provided with a guide surface located behind the second conductor and configured to guide the first conductor to be in contact with the second conductor; and when the first mating element is mated with the second mating element, the contact area slides along the guide surface and the top surface respectively, the guide surface scrapes the contact area, and the contact area and the top surface scrape each other.

In certain embodiments, when the second mating element is mated with the first mating element, before the pressing member presses the elastic body, a gap exists between the lower edge and the top surface; and when the pressing member presses the elastic body, the elastic body abuts the contact portion, such that the contact portion moves toward the gap until the gap disappears.

In certain embodiments, the second insulating body is provided with a sloped chamfer located behind the second conductor, the chamfer extends to the second conductor, and the chamfer does not forwardly cover the rear edge.

In certain embodiments, the second mating element is a circuit board, an upper surface of the circuit board is provided with conformal coating, and the upper surface of the circuit board is not provided with the conformal coating right behind the second conductor.

In certain embodiments, the second mating element is a circuit board, an upper surface of the circuit board is provided with conformal coating, the circuit board is provided with the conformal coating right behind the second conductor, and the upper surface of the conformal coating is not higher than the top surface.

In certain embodiments, the second mating element is a circuit board, the second conductor comprises a signal pad, and the circuit board is provided with a signal line having a contact conductively connected to the signal pad between the lower edge and the front edge.

In certain embodiments, the second mating element is a circuit board, the second conductor comprises a signal pad, and the circuit board is provided with a signal line having a contact is conductively connected to the front edge.

In certain embodiments, the first mating element further comprises a third conductor provided in vertical symmetry with the first conductor and accommodated in the first insulating body; the second mating element further comprises a four conductor provided in vertical symmetry with the second conductor and accommodated in the second insulating body; the second mating element is a circuit board; each of the second conductor and the fourth conductor comprises a ground pad; the circuit board is provided with an accommodating hole, and a conducting member is accommodated in the accommodating hole; the ground pad of the second conductor and the ground pad of the fourth conductor are electrically conducted with each other through the conducting member; and the circuit board is provided with a ground line, and the conducting member is electrically connected to the ground line.

In certain embodiments, an insulating member is provided with a space, the elastic body is provided in the space and upward abuts the insulating member, and the pressing member downward abuts the insulating member; and an elastic element is provided in the space and located below the third conductor, and upward abuts the third conductor, such that the third conductor upward abuts the fourth conductor, and the elastic element downward abuts the insulating member.

In certain embodiments, the conducting member is located right below the contact area.

In certain embodiments, the accommodating hole runs upward through the second conductor, such that the conducting member is exposed out of the top surface, and the conducting member abuts the contact area.

In certain embodiments, the conducting member is conductively connected between the lower edge and the front edge.

In certain embodiments, the conducting member is conductively connected between the lower edge and the rear edge.

In certain embodiments, an area of the contact area is greater than or equal to one half of an area of the top surface.

An electrical connection device includes:a first mating element including at least one cable, wherein each cable has at least one core and an insulating layer wrapping the at least one core, and a shielding layer wrapping the insulating layer, wherein each of the at least one core has a mating section extending forward out of the corresponding insulating layer, a pressing member is located right above the mating section, and an elastic body is located between the pressing member and the mating section; and a second mating element including a insulating body below the mating section, wherein at least one conductor is provided in the insulating body and is at least partially located below the mating section, the conductor has a top surface exposed on an upper surface of the insulating body, the top surface has a front edge and a rear edge opposite to each other, and a foremost end of the mating section is located between the front edge and the rear edge; wherein the pressing member provides a downward acting force such that the mating section downward abuts the conductor; and when the pressing member presses the elastic body, the elastic body is pressed and deforms to pass pressure to the mating section, the foremost end of the mating section is conductively connected to the top surface, and the rear edge abuts the mating section.

In certain embodiments, the cable is a dual axis cable having two cores provided in parallel in a same one of the shielding layer and configured to transmit differential signals, and a sheath is provided to wrap the shielding layer.

In certain embodiments, a grounding strip is electrically connected to the shielding layer.

In certain embodiments, the grounding strip has a grounding portion, and an arm portion extending from the grounding portion to be in contact with another one of the at least one conductor.

In certain embodiments, when the pressing member presses the elastic body, the elastic body simultaneously presses on the mating section and the arm portion.

In certain embodiments, the elastic body has a main body portion and at least one protruding portion extending downward from the main body portion, and when the pressing member presses the elastic body, the protruding portion abuts the mating section.

In certain embodiments, the elastic body has a plurality of protruding portions, and a slot is provided between adjacent ones of the protruding portions to separate the adjacent ones of the protruding portions.

In certain embodiments, a reinforcing member is provided on the elastic body to increase a mechanical strength thereof.

In certain embodiments, the reinforcing member and the elastic body are formed by injection molding, and the reinforcing member is exposed on the elastic body.

In certain embodiments, the reinforcing member has at least one through hole vertically penetrating the reinforcing member.

In certain embodiments, when the pressing member presses the elastic body, the elastic body abuts the foremost end of the mating section.

In certain embodiments, there are a plurality of cables provided in parallel, and a grounding strip is electrically connected to the shielding layers of the cables.

In certain embodiments, the pressing member has a pushing portion configured to operate the pressing member, and a pressing portion extends from one end of the pushing portion to abut the elastic body.

In certain embodiments, the pressing member is an eccentric wheel or a wedge member.

In certain embodiments, an insulating body is provided between the elastic body and the mating section, the insulating body has a groove configured to accommodate each mating section, and the mating section is downward partially exposed out of the groove.

An electrical connection device includes: a first mating element comprising a cable, wherein the cable has a core and an insulating layer wrapping the core, and a shielding layer wrapping the insulating layer, wherein the core has a mating section extending forward out of the insulating layer, a conductive sheet is coupled to a bottom of the mating section, a pressing member is located right above the mating section, and an elastic body is located between the pressing member and the mating section; and a second mating element comprising a insulating body, wherein at least one conductor is provided in the insulating body and is located below the mating section, the conductor has a top surface exposed on an upper surface of the insulating body; wherein the pressing member provides a downward acting force such that the conductive sheet is downward conductively connected to the conductor; and when the pressing member presses the elastic body, the elastic body is pressed and deforms to pass pressure to the mating section, such that the conductive sheet is electrically connected to the top surface.

In certain embodiments, the conductive sheet has a top surface and a bottom surface vertically opposite to each other, a foremost end of the mating section is electrically connected to the top surface of the conductive sheet, the bottom surface is configured to be electrically connected to the top surface of the conductor, a front end of the bottom surface has a first edge, the top surface of the conductor has a front edge and a rear edge opposite to each other, and when the pressing member presses the elastic body, the first edge abuts the top surface of the conductor, and the rear edge abuts the bottom surface.

In certain embodiments, a hardness of the conductive sheet is greater than a hardness of the core.

Compared with the related art, certain embodiments of the present invention has the following beneficial effects.

In the electrical connection device according to certain embodiments of the present invention, the first conductor and the second conductor are in tight contact under an external force, the contact area is fully attached to the top surface, the lower edge is between the front edge and the rear edge and abuts the top surface, and the rear edge abuts the contact area. Therefore, the lower edge of the first conductor and the rear edge of the second conductor are connected with the electric current path to avoid a serious signal radiation to the outer environment, thus eliminating the negative influence of the stake effect on signal transmission, decreasing the degree of distortion of high-frequency signal transmission, and increasing the quality of signal transmission.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
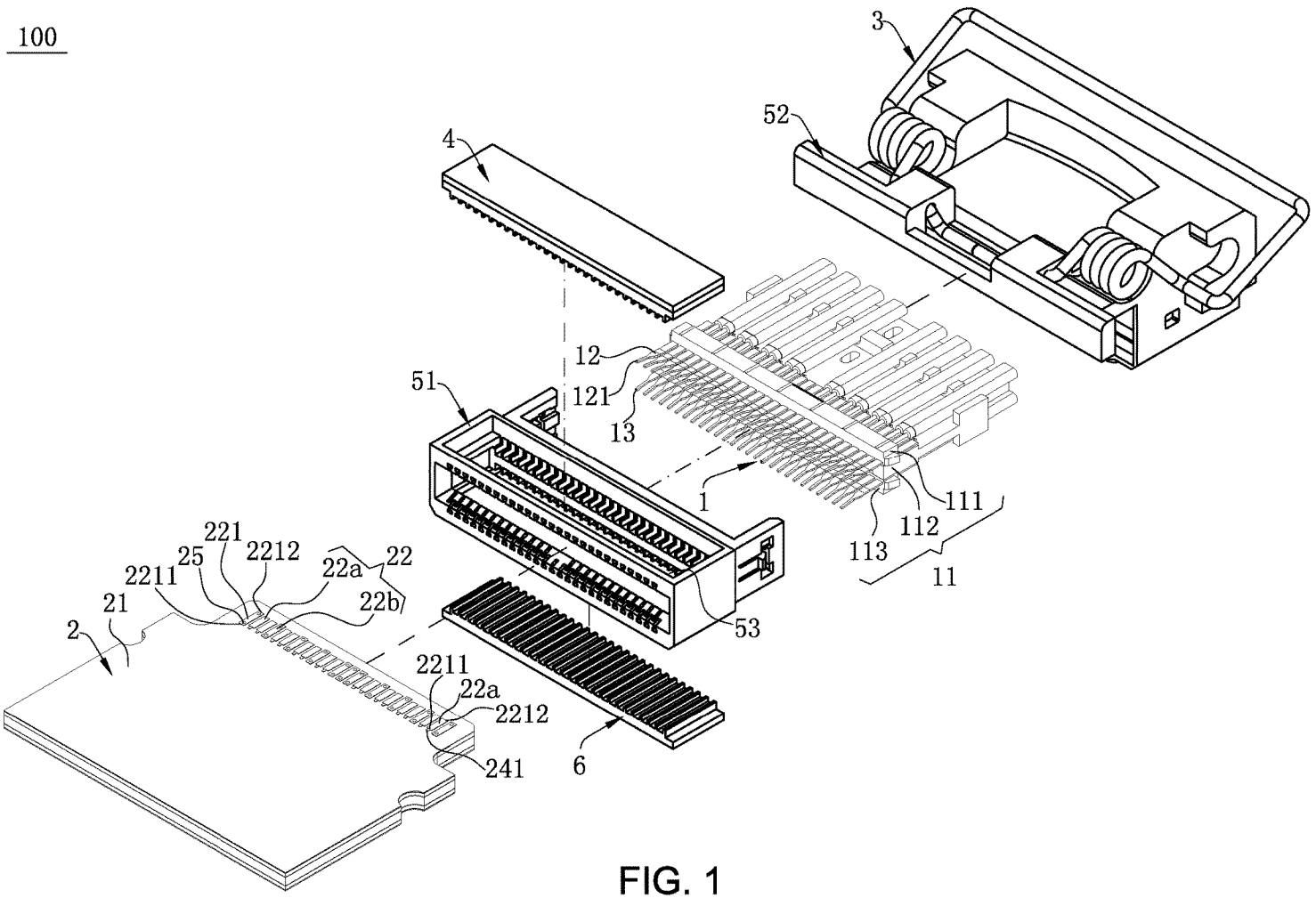
FIG. 1 is a perspective exploded schematic view of an electrical connection device according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-48. In accordance with the purposes of this invention, as embodied and broadly described herein, this invention, in one aspect, relates to an electrical connection device.

FIG. 1 shows an electrical connection device 100 according to a first embodiment of the present invention. The major components of the electrical connection device 100 include a first mating element 1, a second mating element 2, a pressing member 3, and an elastic body 4.

Figure 2:
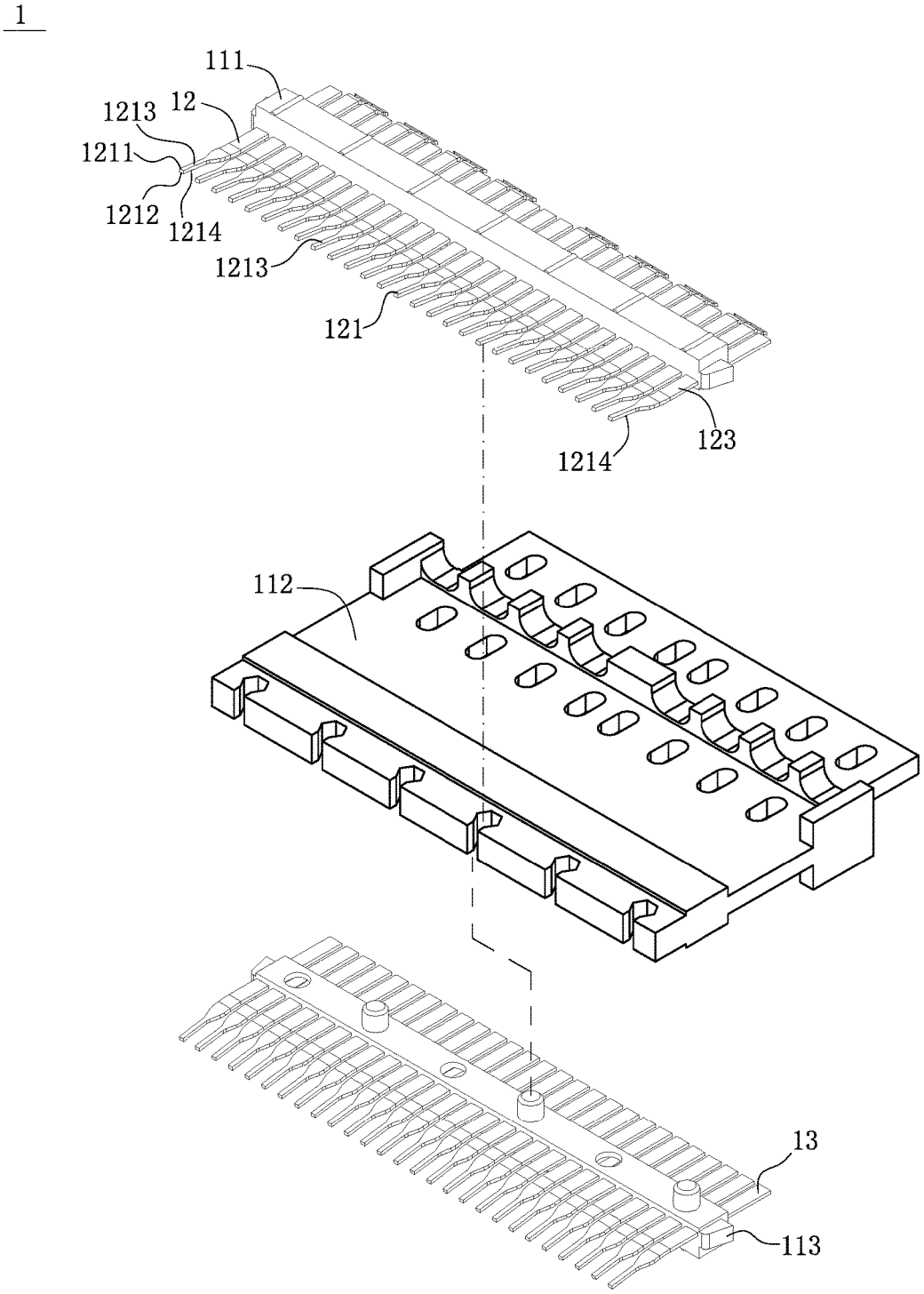
FIG. 2 is a perspective exploded schematic view of a first mating element of the electrical connection device according to the first embodiment of the present invention.
Figure 3:
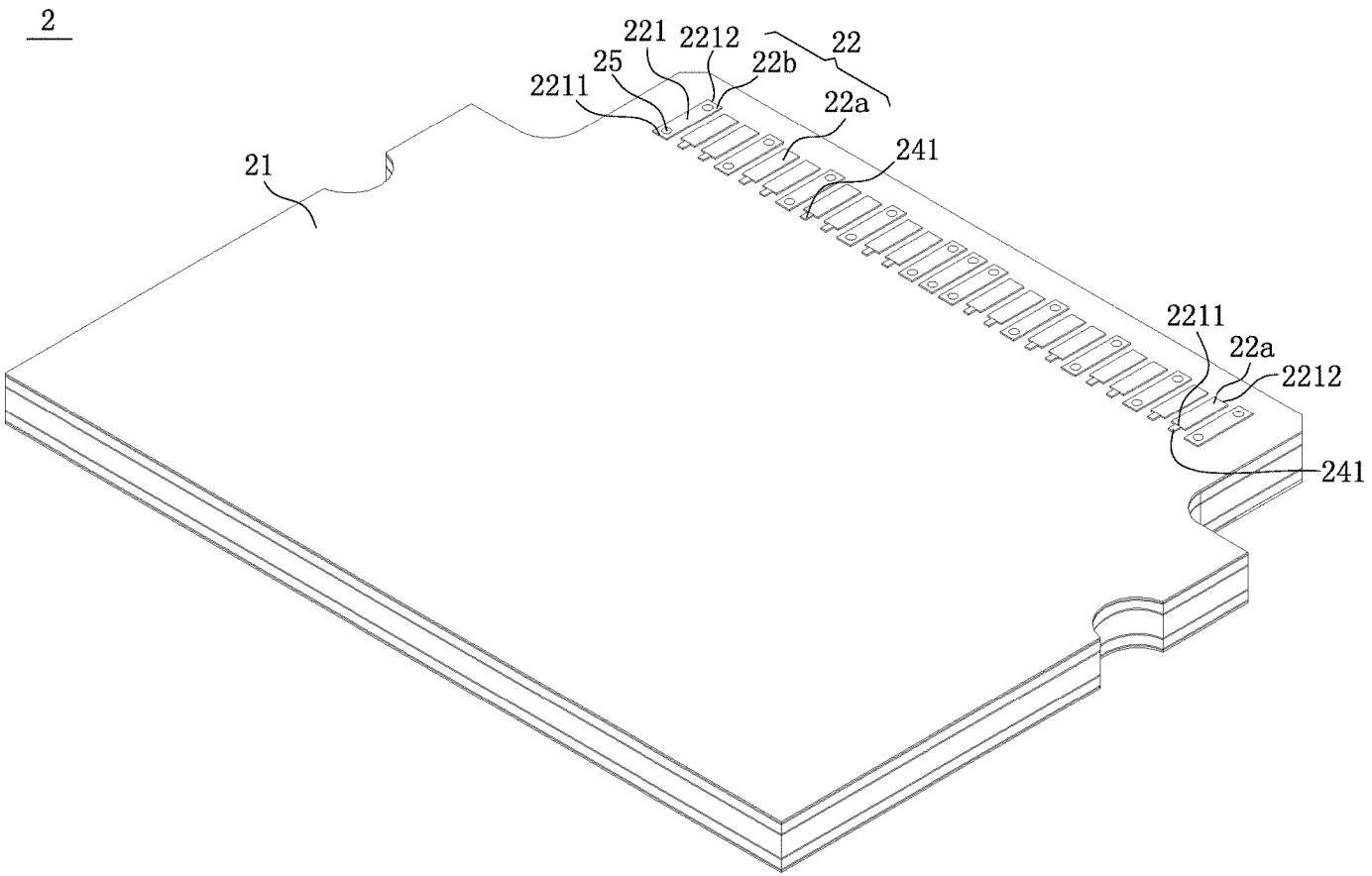
FIG. 3 is a perspective schematic view of a second mating element of the electrical connection device according to the first embodiment of the present invention.

As shown in FIG. 1 and FIG. 2, the first mating element 1 includes a first insulating body 11. The first insulating body 11 is formed by an upper body 111, a middle body 112 and a lower body 113 assembled together. The first mating element 1 further includes a plurality of strip-shaped first conductors 12 and a plurality of third conductors 13 correspondingly arranged in vertical symmetry with the first conductors 12. The first conductors 12 and the upper body 111 are insert-molded, and the third conductors 13 and the lower body 113 are insert-molded. Then, both are assembled and combined with the middle body 112. In other embodiments, the first insulating body 11 can be formed integrally into one piece.

Each first conductor 12 is provided with a base 123 located in the upper body 111 and a contact portion 121 formed by bending forward and extending from the base 123. The contact portion 121 protrudes forward out of the upper body 111 and extends upward as a whole. The contact portion 121 is provided with an upper surface and a lower surface parallel to each other. A foremost end of the upper surface of the contact portion 121 is provided with an upper edge 1211, and the upper surface is provided with a pressure-bearing area 1213 which extends backward from the upper edge 1211. A foremost end of the lower surface of the contact portion 121 is provided with a lower edge 1212, and the lower surface is provided with a contact area 1214 which extends backward from the lower edge 1212. A width of the contact area 1214 is increased from the front thereof to the rear thereof in order to meet the requirement of electric properties such as impedance matching.

As shown in FIG. 1, FIG. 3, FIG. 6 and FIG. 7, the second mating element 2 is configured to be mated with the first mating element 1, and includes a second insulating body 21. A plurality of second conductors 22 are provided in the second insulating body 21. Each second conductor 22 is provided with a top surface 221 fully exposed out of an upper surface of the second insulating body 21 and configured to be in contact with the contact portion 121, and the top surface 221 is provided with a front edge 2211 and a rear edge 2212 opposite to each other. The second mating element 2 further includes a plurality of fourth conductors 23 correspondingly arranged in vertical symmetry with the second conductors 22.

Figure 4:
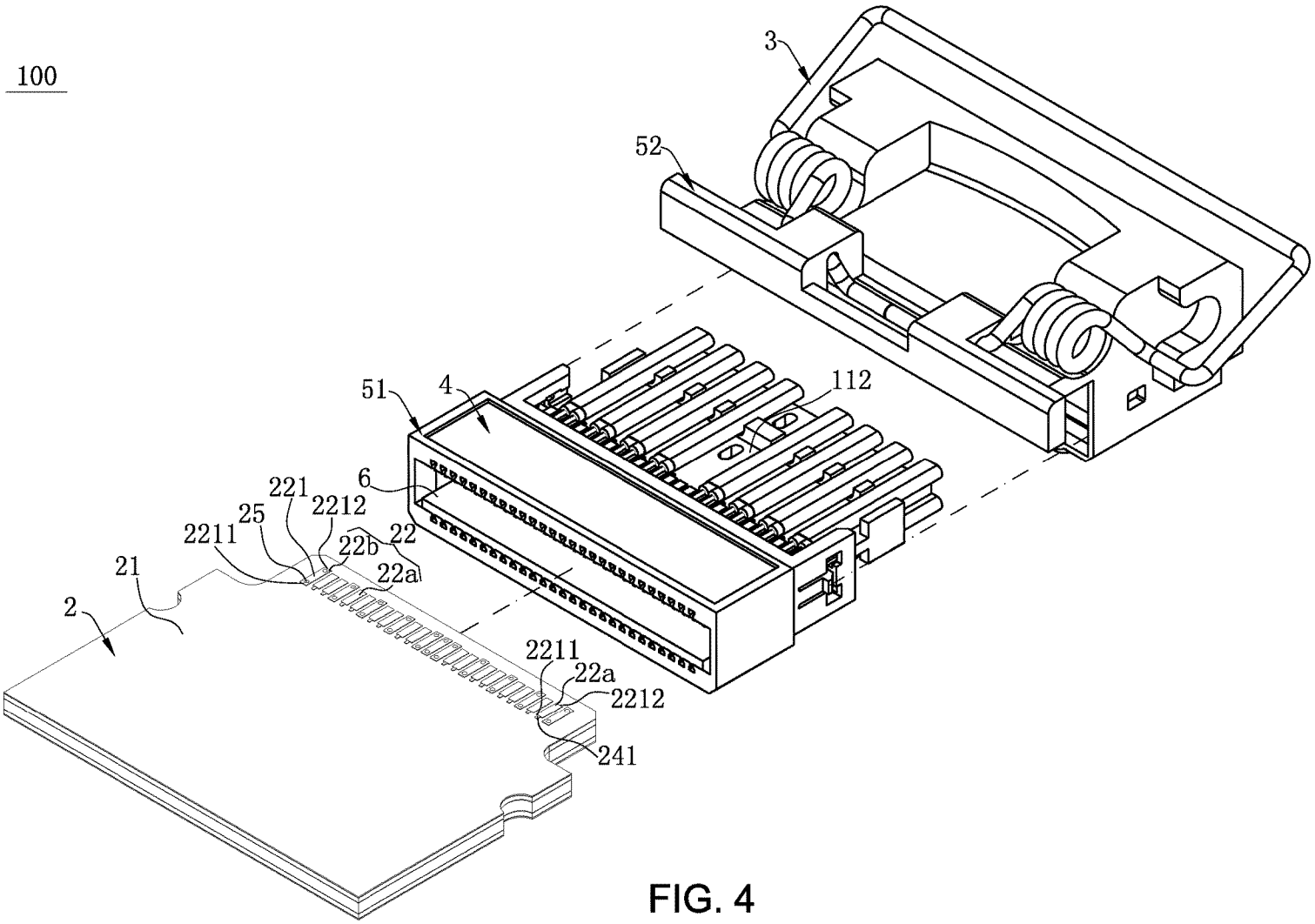
FIG. 4 is another perspective exploded schematic view of the electrical connection device according to the first embodiment of the present invention.
Figure 6:
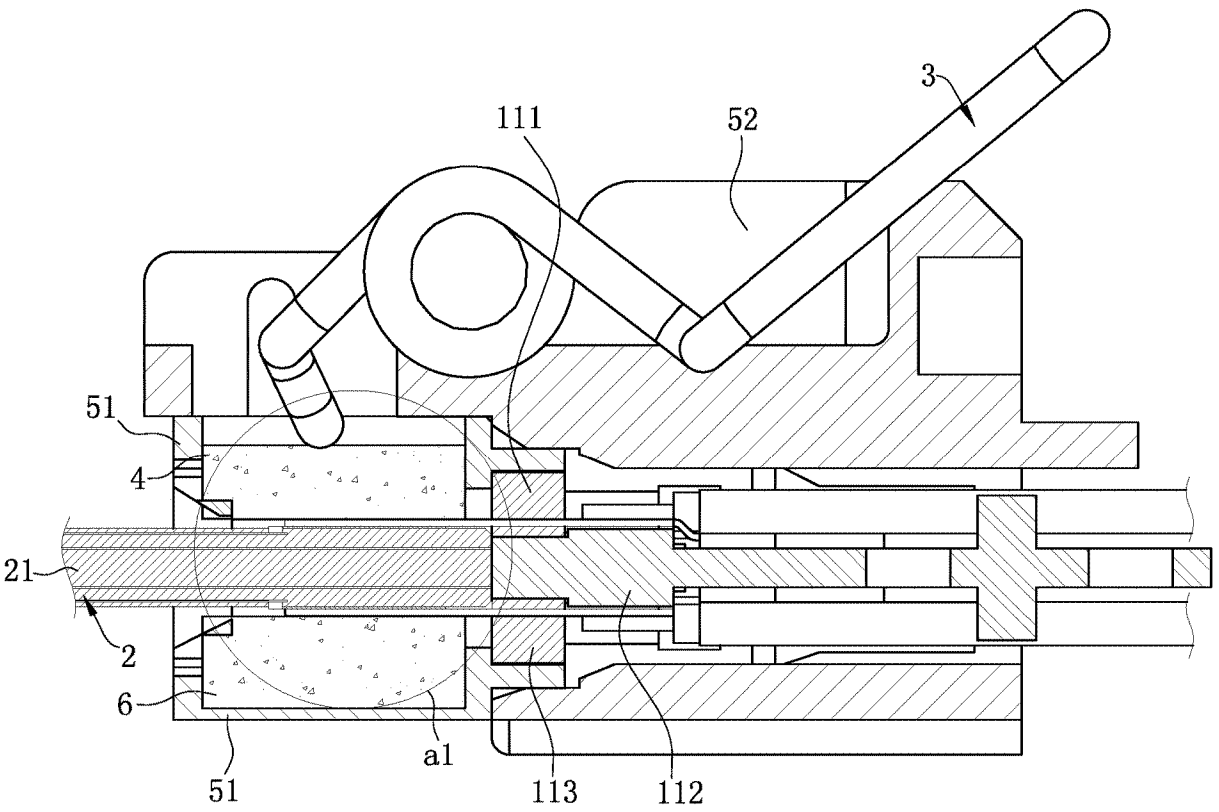
FIG. 6 is a side sectional view of FIG. 5 along an A-A direction.
Figure 7:
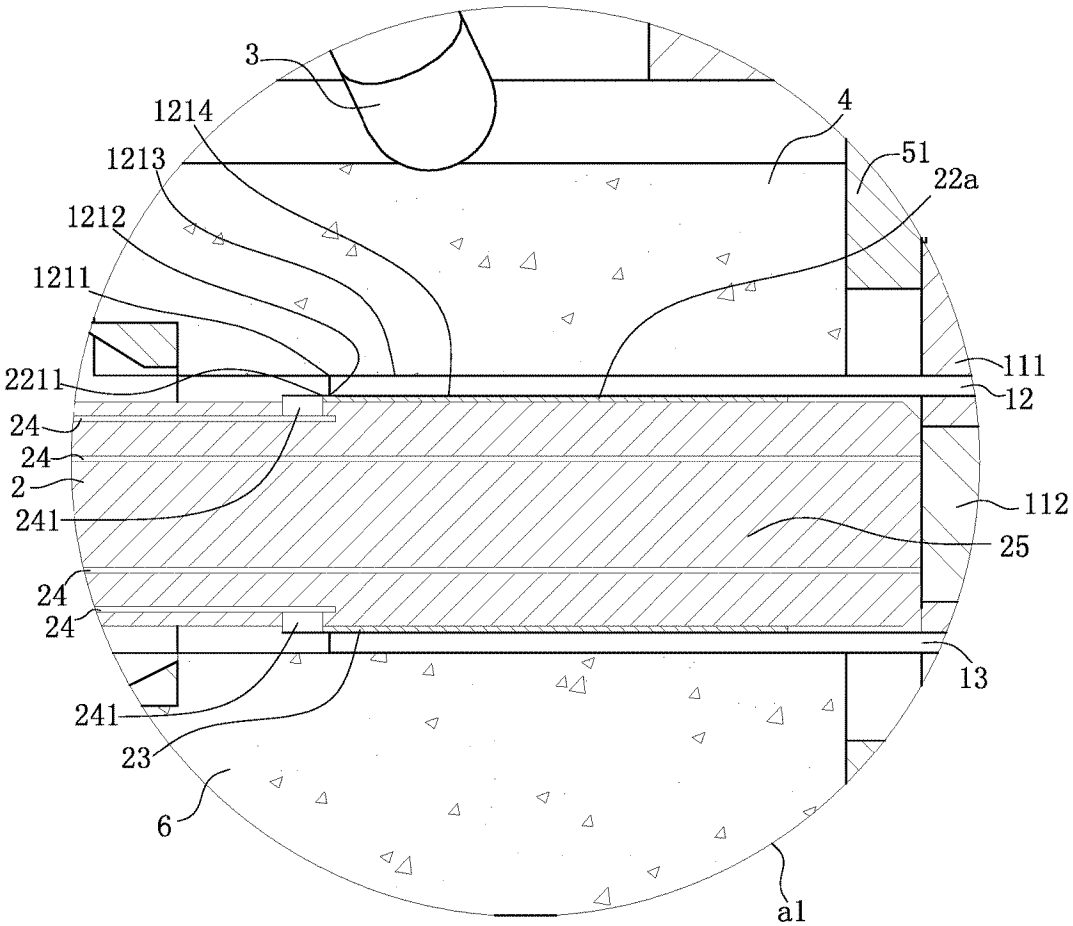
FIG. 7 is an enlarged view of a portion a1 in FIG. 6.

As shown in FIG. 4, FIG. 6 and FIG. 7, in the present embodiment, the second mating element 2 is a circuit board. The second conductors 22 include a plurality of signal pads 22*a*, and the interior of the circuit board is provided with a signal line 24, which is provided with a contact 241 correspondingly conductively connected to one signal pad 22*a*. In a horizontal projection, the contact 241 is conductively connected to the signal pad 22*a* between the front edge 2211 and the lower edge 1212, and preferably, the contact 241 is conductively connected to the front edge 2211.

Figure 8:
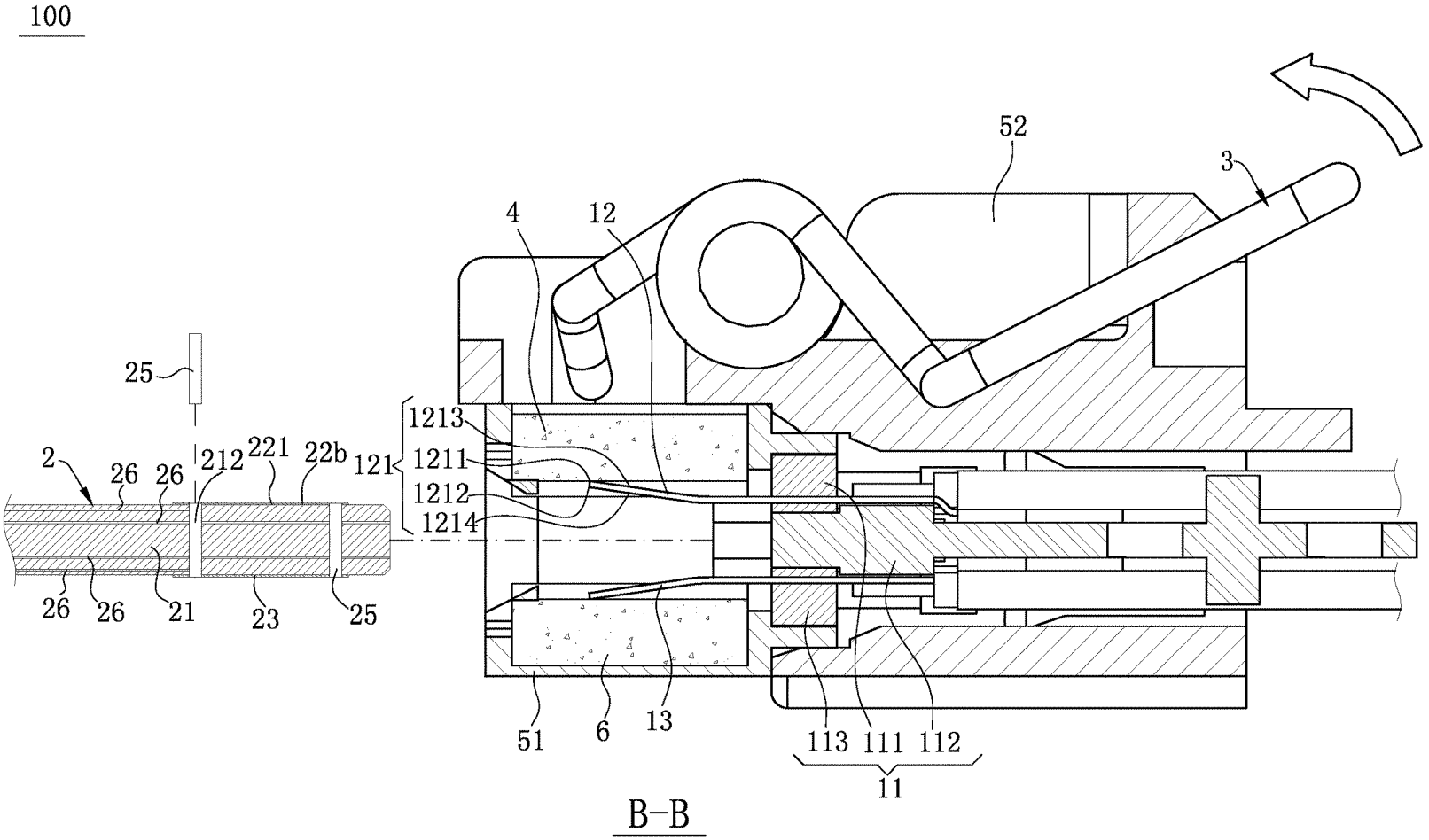
FIG. 8 is a side sectional view of the electrical connection device of FIG. 5 along a B-B direction before the second mating element is plugged therein.
Figure 9:
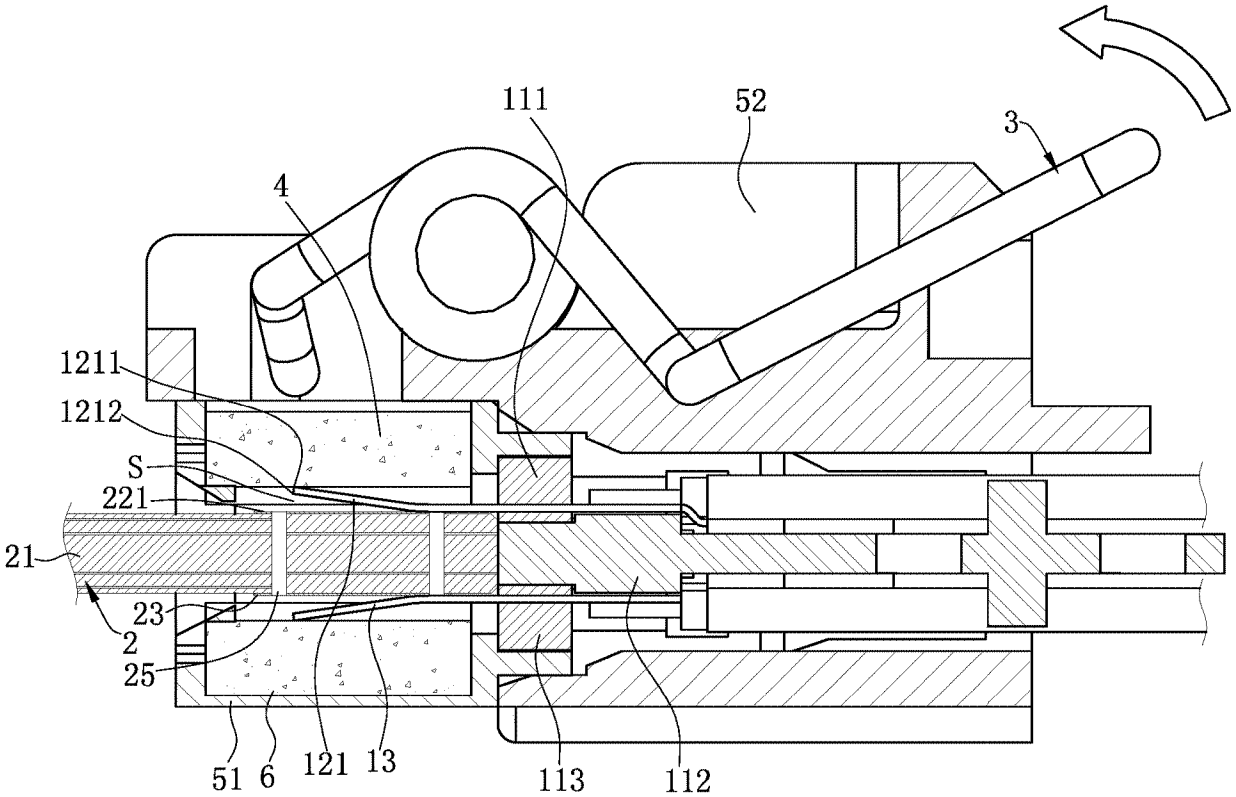
FIG. 9 is a side sectional view of the electrical connection device of FIG. 5 along the B-B direction.

As shown in FIG. 4, FIG. 8 and FIG. 9, each of the second conductors 22 and the fourth conductors 23 includes a plurality of ground pads 22*b*. The circuit board is provided with a plurality of accommodating holes 212, and a plurality of conducting members 25 are accommodated correspondingly in the accommodating holes 212. The ground pads 22*b* of the second conductors 22 and the ground pads 22*b* of the corresponding fourth conductors 23 are electrically conducted with each other through the conducting members 25, and the conducting members 25 are located under the contact areas 1214. Further, the accommodating holes 212 run upward through the ground pads 22*b*, such that the conducting members 25 are exposed out of the top surfaces 221 to abut the contact areas 1214. The interior of the circuit board is provided with at least one ground line 26, and the conducting members 25 are connected electrically to the at least one ground line 26. In this embodiment, there are four ground lines 26, and in the other embodiments, the quantities of the ground lines 26 may vary.

As shown in FIG. 7, in the present embodiment, the location to which the signal line 24 is conductively connected to the first conductor 12 is the contact 241, and the contact 241 is integrated with the signal line 24. In other embodiments, the signal pad 22*a* and the signal line 24 can be formed from the same copper foil by etching. Thus, the signal line 24, the contact 241 and the signal pad 22*a* are integrated. Alternatively, the signal line 24 and the signal pad 22*a* are not formed integrally but are made into two pieces, and the contact 241 can be arranged separately and conductively connected to the signal pad 22*a* and the signal line 24 respectively, which may achieve the same effect.

Figure 11:
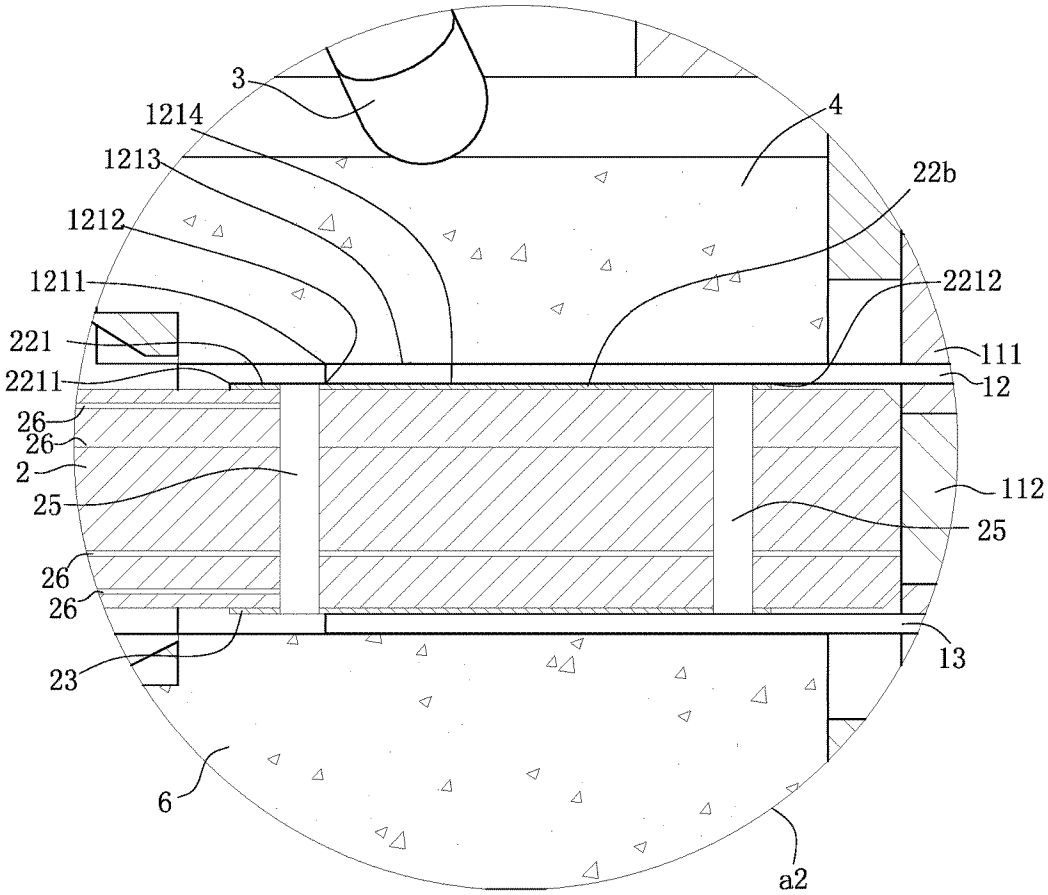
FIG. 11 is an enlarged view of a portion a2 in FIG. 10.
Figure 12:
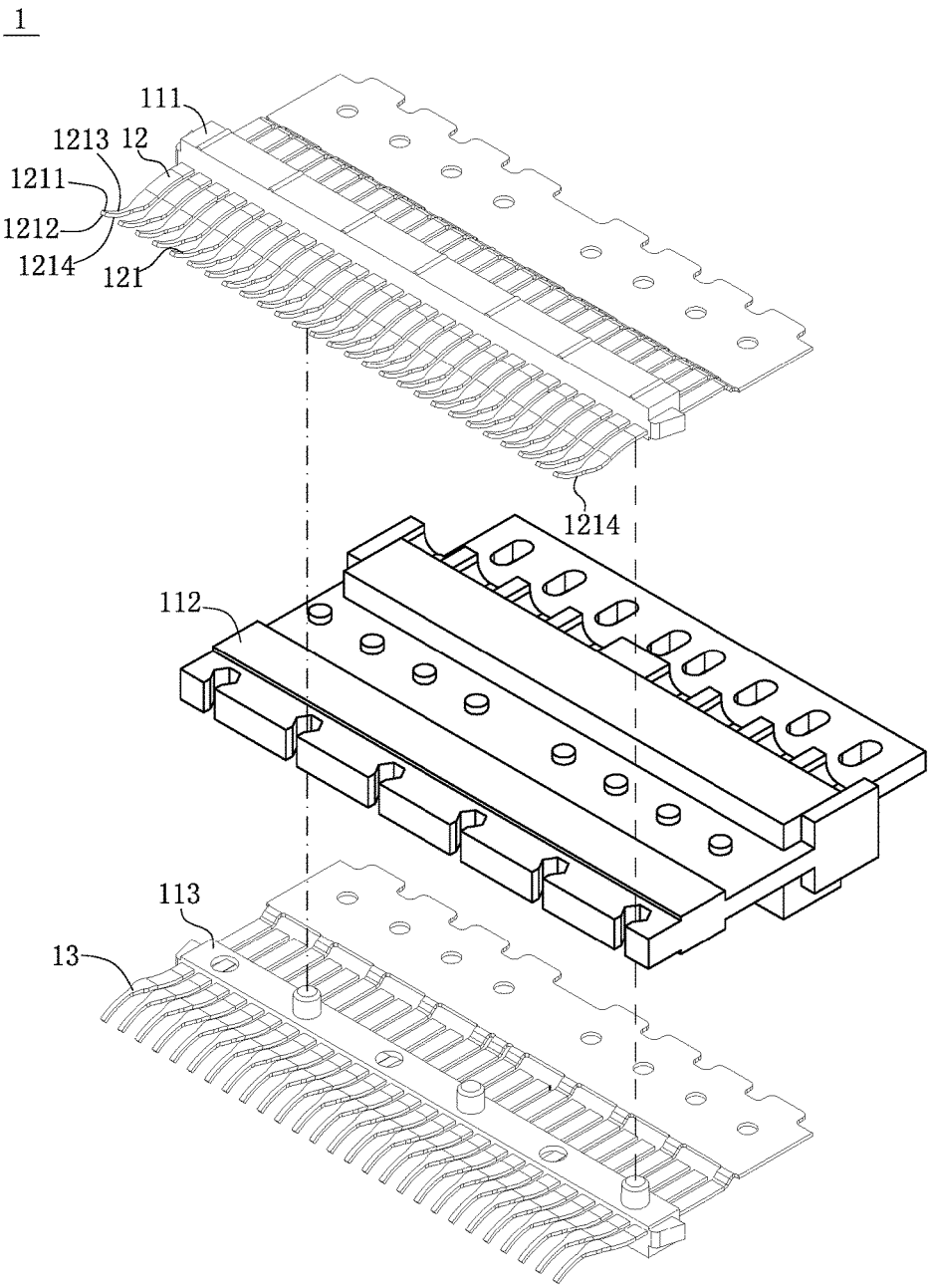
FIG. 12 is a perspective exploded schematic view of a first mating element of an electrical connection device according to a second embodiment of the present invention.
Figure 13:
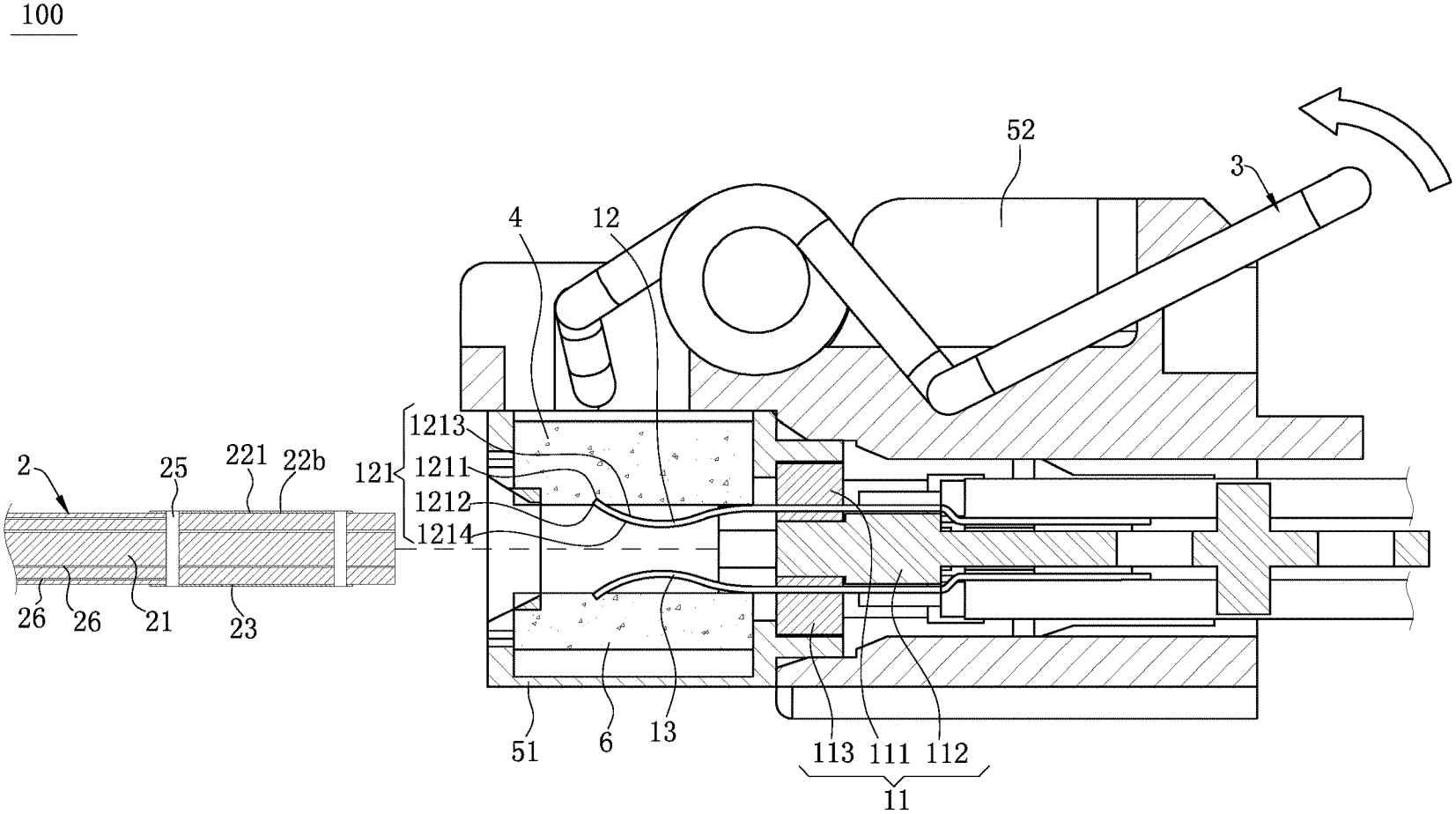
FIG. 13 is a side sectional view of the electrical connection device according to the second embodiment of the present invention before the second mating element is mated with the first mating element.
Figure 14:
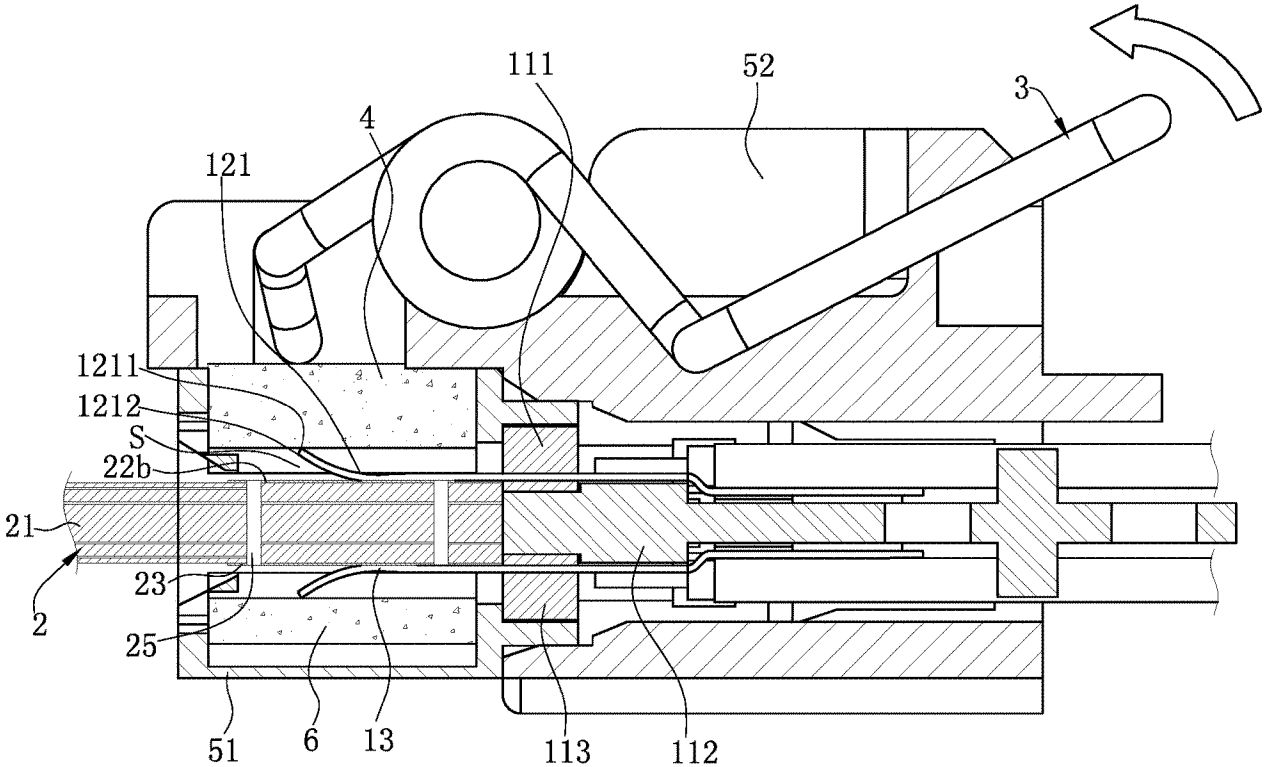
FIG. 14 is a side sectional view of the electrical connection device according to the second embodiment of the present invention before the pressing member presses thereon.
Figure 15:
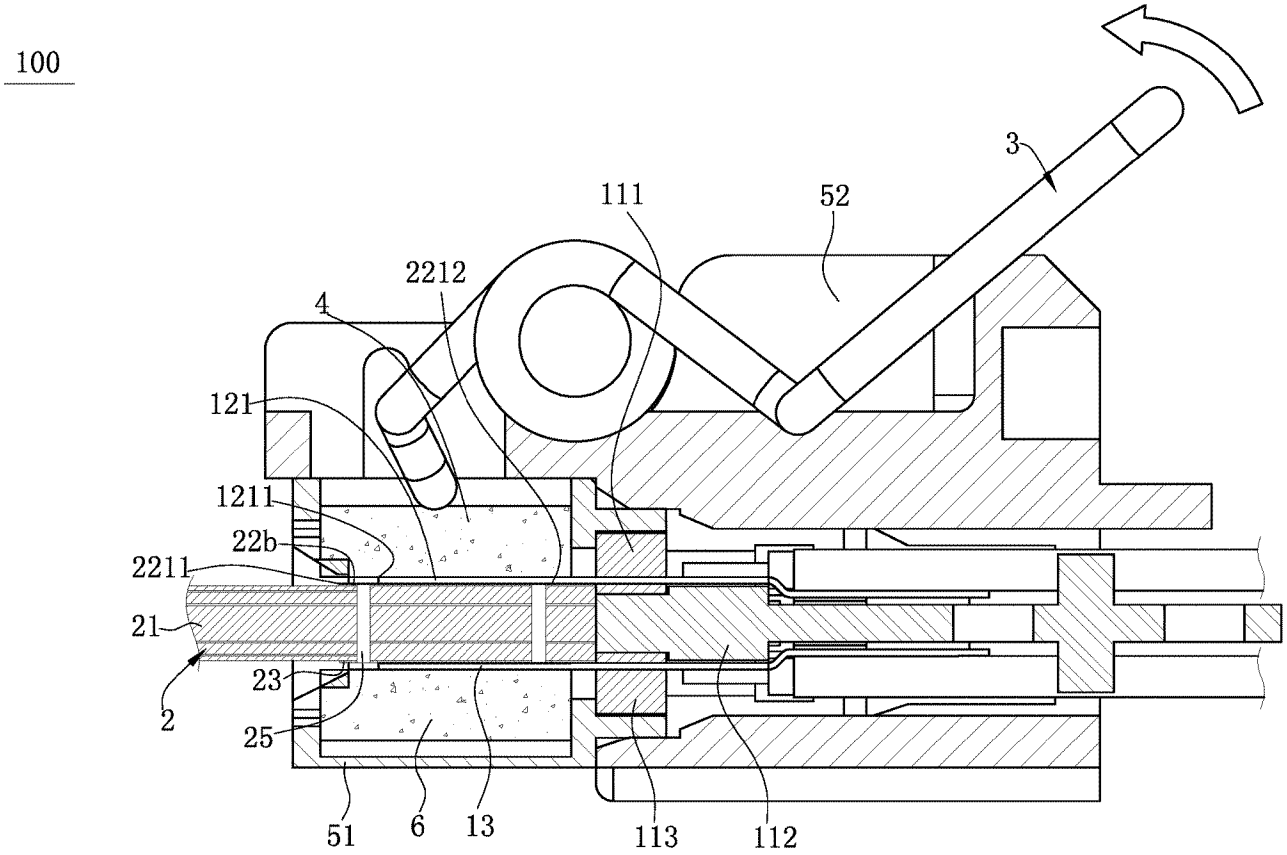
FIG. 15 is a side sectional view of the electrical connection device according to the second embodiment of the present invention after the pressing member presses thereon.

As shown in FIG. 8 and FIG. 11, the conducting member 25 is made of a material with good conductivity. For example, the conducting member 25 can be a solid copper post, a hollow copper tube or a copper plating, and the resin plugging technique is used commonly to provide the copper plating. In the present embodiment, there are two conducting members 25 corresponding to each of the second conductors 22. One conducting member 25 is conductively connected between the lower edge 1212 and the front edge 2211, and the other conducting member 25 is exposed out of the top surface 221 to abut the contact area 1214 and is also conductively connected between the lower edge 1212 and the rear edge 2212. The two conducting members 25 are both connected to the ground lines 26, such that the grounding effect is enhanced, which is favorable for signal transmission.

It should be particularly noted about the electrical connection device 100 that, as shown in FIG. 8, in the present embodiment, the accommodating holes 212 vertically run through the ground pads 22*b* of the second conductors 22 and the fourth conductors 23, and the conducting members 25 are exposed out of the top surfaces 221. The reason of such an arrangement is that the resin plugging technique which is used commonly at present is usually applied after a circuit board is formed. That is, the ground pads 22*b* of the second conductors 22 and the fourth conductors 23 are first provided in the second insulating body 21, and the resin plugging technique is then used to provide the conducting members 25. Thus, the accommodating holes 212 run through the ground pads 22*b* of the second conductors 22 and the fourth conductors 23. In other embodiments, the conducting members 25 can be arranged at the start of the circuit board design, such that the arrangement of the conducting members 25 is prior to the arrangement of the ground pads 22*b* of the second conductors 22 or the fourth conductors 23, or the conducting members 25 and the ground pads 22*b* of the second conductors 22 or the fourth conductors 23 are arranged simultaneously when the circuit board is formed. Thus, the accommodating holes 212 do not need to run through the ground pads 22*b* of the second conductors 22 or the fourth conductors 23, and the conducting members 25 abut the ground pads 22*b* of the second conductors 22 without being exposed out of the top surfaces 221.

Figure 10:
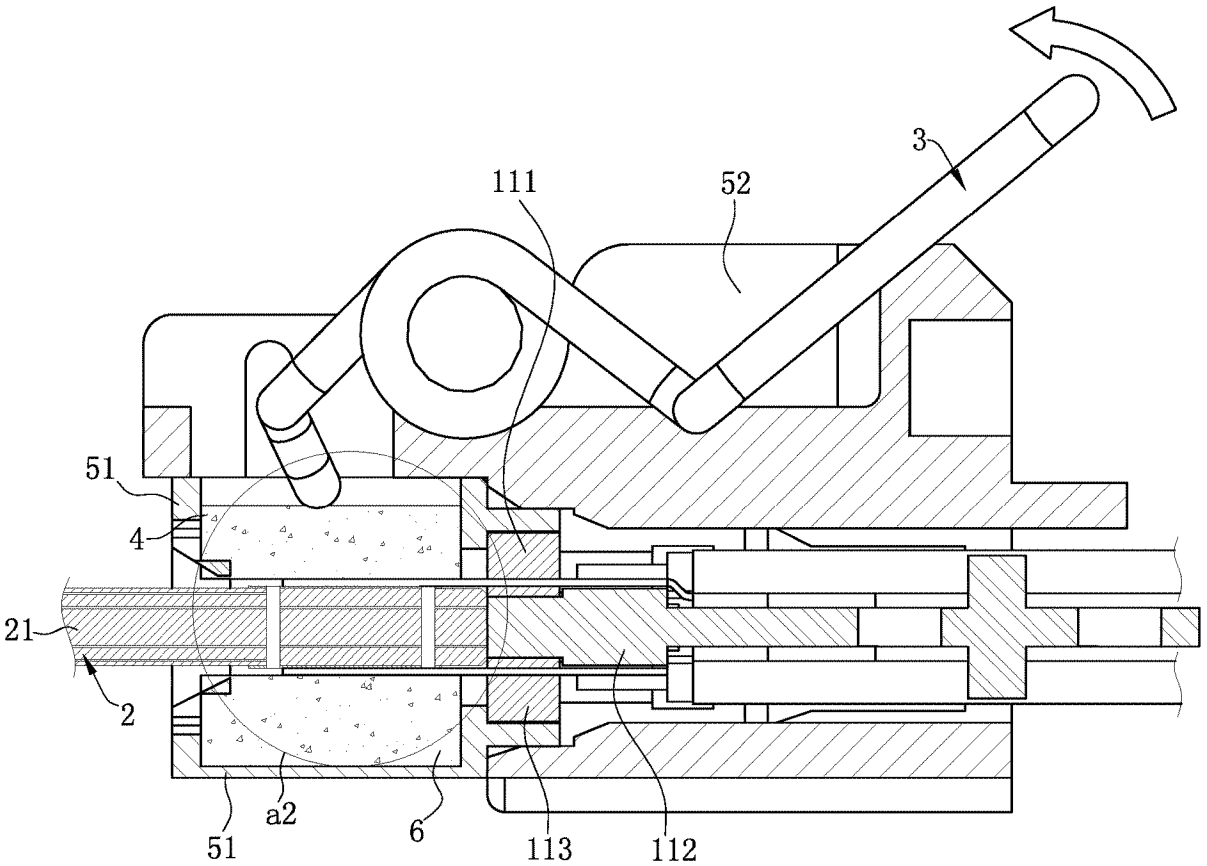
FIG. 10 is a side sectional view of FIG. 5 along the B-B direction after a pressing member presses thereon.

As shown in FIG. 8 and FIG. 10, the pressing member 3 is located above the contact portions 121. The elastic body 4 is located between the pressing member 3 and the contact portions 121, and the elastic body 4 upward abuts the pressing member 3 and downward abuts the upper edge 1211.

As shown in FIG. 9, FIG. 10 and FIG. 11, before the pressing member 3 presses the elastic body 4, a gap S exists between the lower edges 1212 and the top surfaces 221. The pressing member 3 presses on the elastic body 4, such that the elastic body 4 is attached to the whole pressure-bearing areas 1213, and the contact portions 121 move toward the gap S. As a result, the contact areas 1214 are attached to the top surfaces 221 with no gap exists between both, and the rear edges 2212 abut the contact areas 1214, and the area of each contact area 1214 is greater than or equal to one half of the area of each top surface 221, so as to reduce the contact impedance between the first conductors 12 and the second conductors 22.

Figure 5:
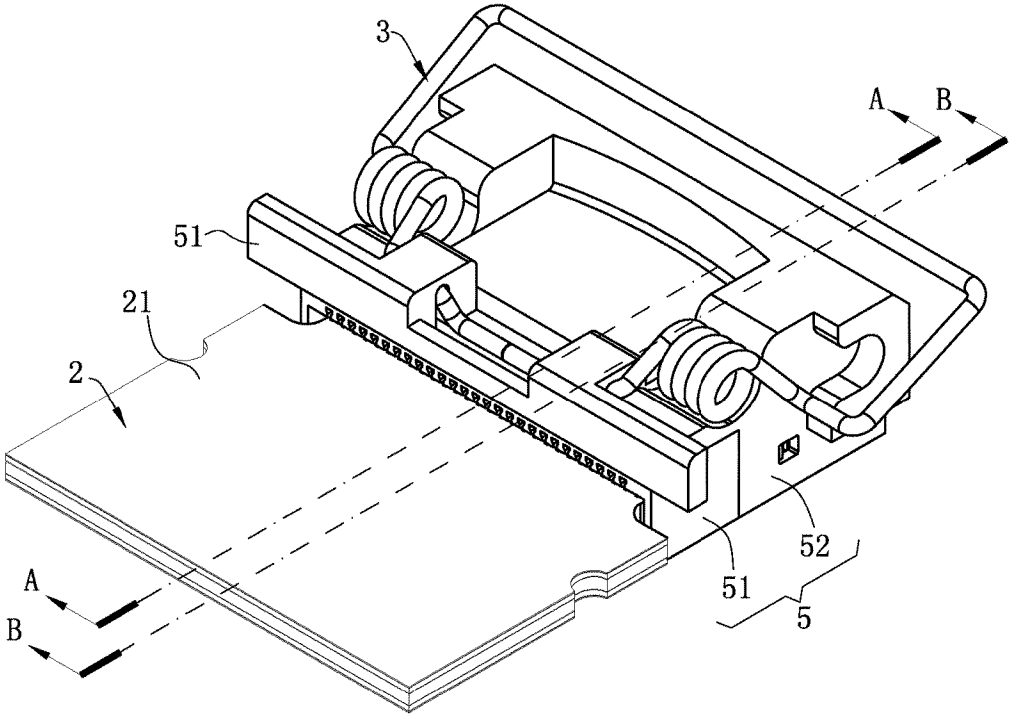
FIG. 5 is a perspective assembled view of the electrical connection device according to the first embodiment of the present invention.

As shown in FIG. 1 and FIG. 5, the pressing member 3 and the elastic body 4 are provided on an insulating member 5. The insulating member 5 includes a first shell 51 and a second shell 52 arranged opposite to each other at the front and the rear thereof, and both are fastened and assembled together. The first shell 51 is provided with a space 53 for accommodating the first insulating body 11 and the elastic body 4, and the first conductors 12 and the second conductors 22 are mated in the space 53. In other embodiments, the insulating member 5 can be made into one piece. That is, the first shell 51 and the second shell 52 are formed integrally without being assembled.

As shown in FIG. 1, FIG. 6 and FIG. 7, the pressing member 3 is a spring clip, which is provided on the second shell 52. An elastic element 6 is accommodated in the space 53 and arranged in vertical symmetry with the elastic body 4, and the elastic element 6 is located under the third conductors 13 to elastically abut the third conductors 13. The third conductors 13 are in electrical contact with the fourth conductors 23.

In the present embodiment, both the first conductors 12 and the third conductors 13 are conductive terminals which are formed by stamping a metal plate. In other embodiments, the first conductors 12 and the third conductors 13 can also be other electrical elements, such as conductive cores (not shown in the drawings, similarly hereinafter), which is applicable as well, because when the front ends of the conductive cores are warped up or a gap exists between the rear edges 2212 of the second conductors 22 and the conductive cores, the match between the pressing member 3 and the elastic body 4 can still be used to apply a pressing force on the conductive cores, so that the conductive cores are in tight contact with the second conductors 22, thus avoiding a serious signal radiation to the outer environment, reducing the adverse influence of the stake effect, and increasing the quality of signal transmission.

In other embodiments, the second mating element 2 can be other mating elements, such as a male connector (not shown in the drawings).

If necessary, two pressing members 3 can be provided, the other of two pressing member 3 is located under the elastic element 6, the elastic element 6 is located between the other of the two pressing members 3 and the third conductors 13, and the elastic element 6 downward abuts the other of the two pressing members 3 and upward abuts the third conductors 13. In this way, pressing forces can be provided downwardly and upwardly, thereby enhancing the pressing effect. The pressing member 3 can be an eccentric wheel, a screw, etc. When the elastic body 4 and the elastic element 6 are made of a soft material (such as a silicon rubber), a pressing plate (not shown in the drawings) can also be provided between the elastic body 4 and the corresponding pressing member 3, such that the whole elastic body 4 can be pressed uniformly, and the pressing plate (not shown in the drawings) can be made of a material harder than the rubber, such as resin or metal.

FIG. 12 to FIG. 15 show a second embodiment of the electrical connection device 100 of the present invention, which is different from the first embodiment in that: the contact portions 121 first extend downward and then extend upward. In the mating process of the first conductors 12 and the second conductors 22, the contact areas 1214 and the top surfaces 221 scrape each other to remove foreign matters of the contact areas 1214 and the top surfaces 221, such as dust and oxides. The remaining structures are identical with those of the first embodiment, and therefore are not elaborated herein.

Figure 16:
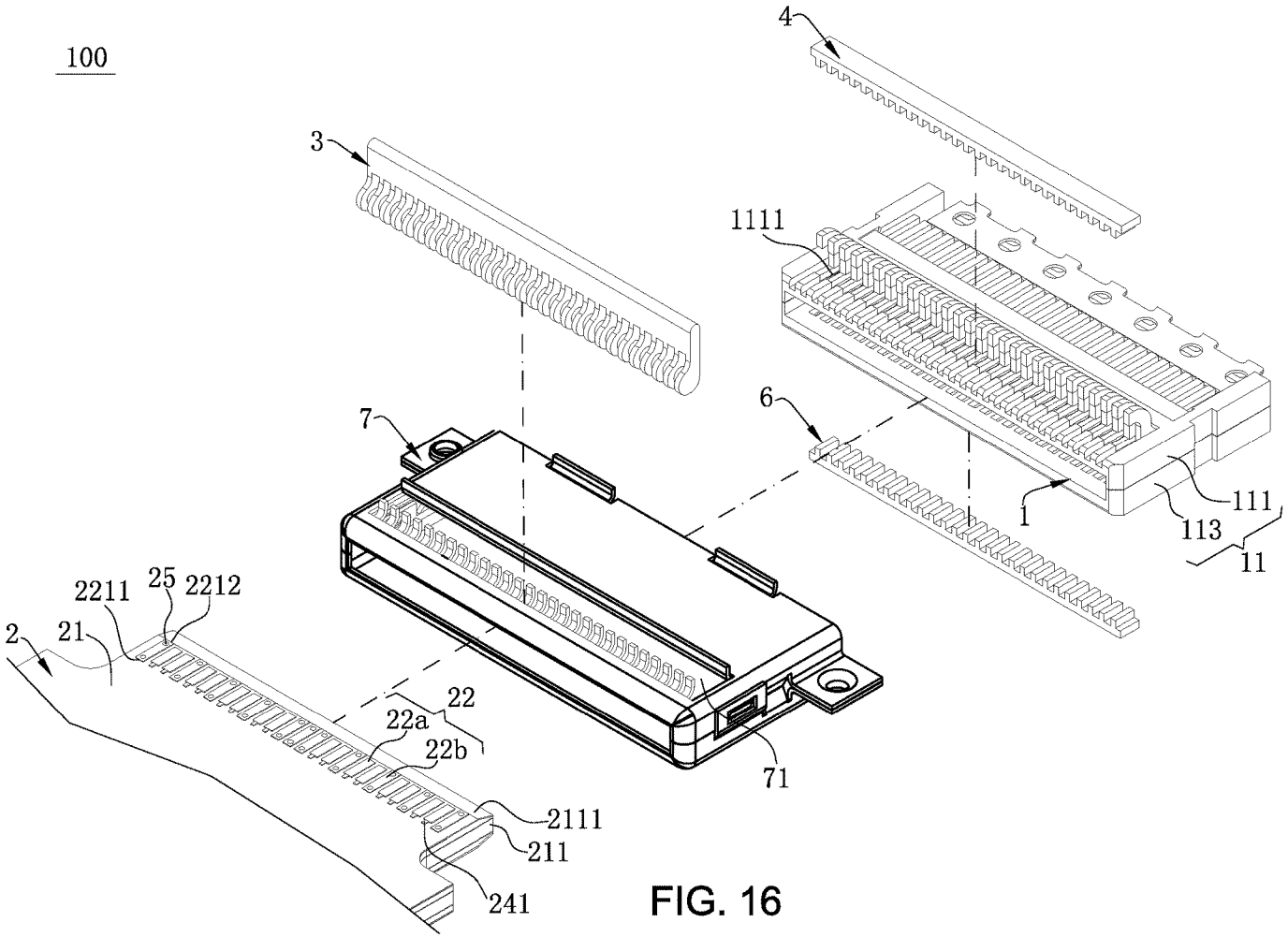
FIG. 16 is a perspective exploded schematic view of an electrical connection device according to a third embodiment of the present invention.
Figure 17:
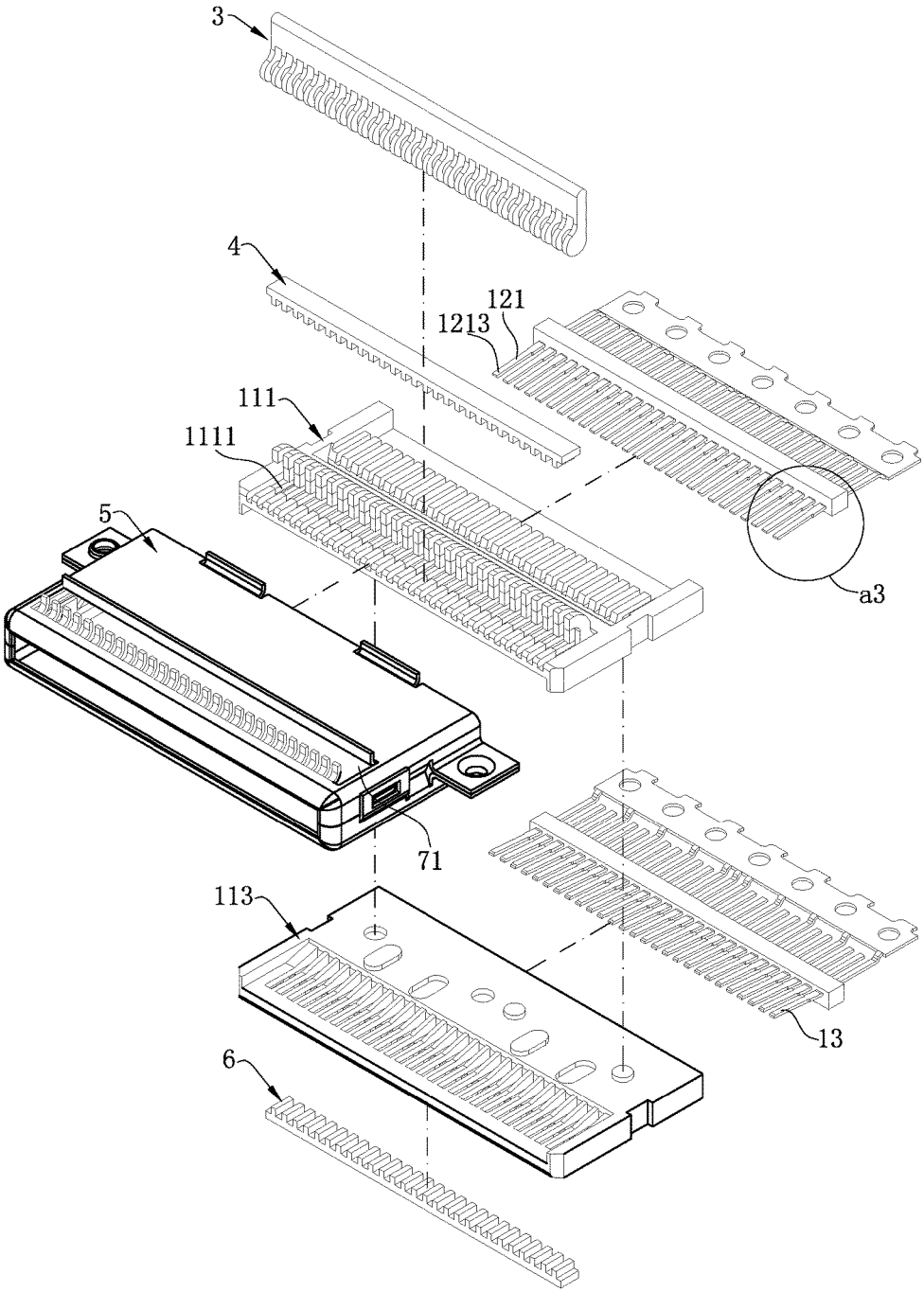
FIG. 17 is a partial perspective exploded schematic view of the electrical connection device according to the third embodiment of the present invention.
Figure 18:
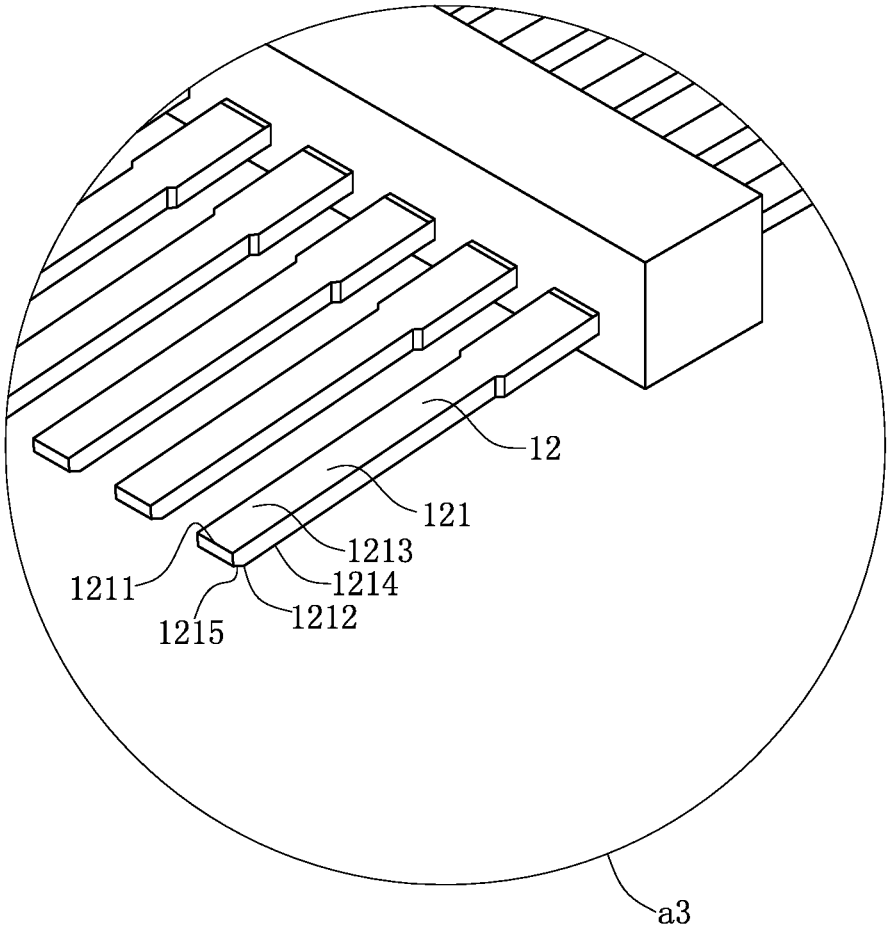
FIG. 18 is an enlarged view of a portion a3 in FIG. 17.
Figure 19:
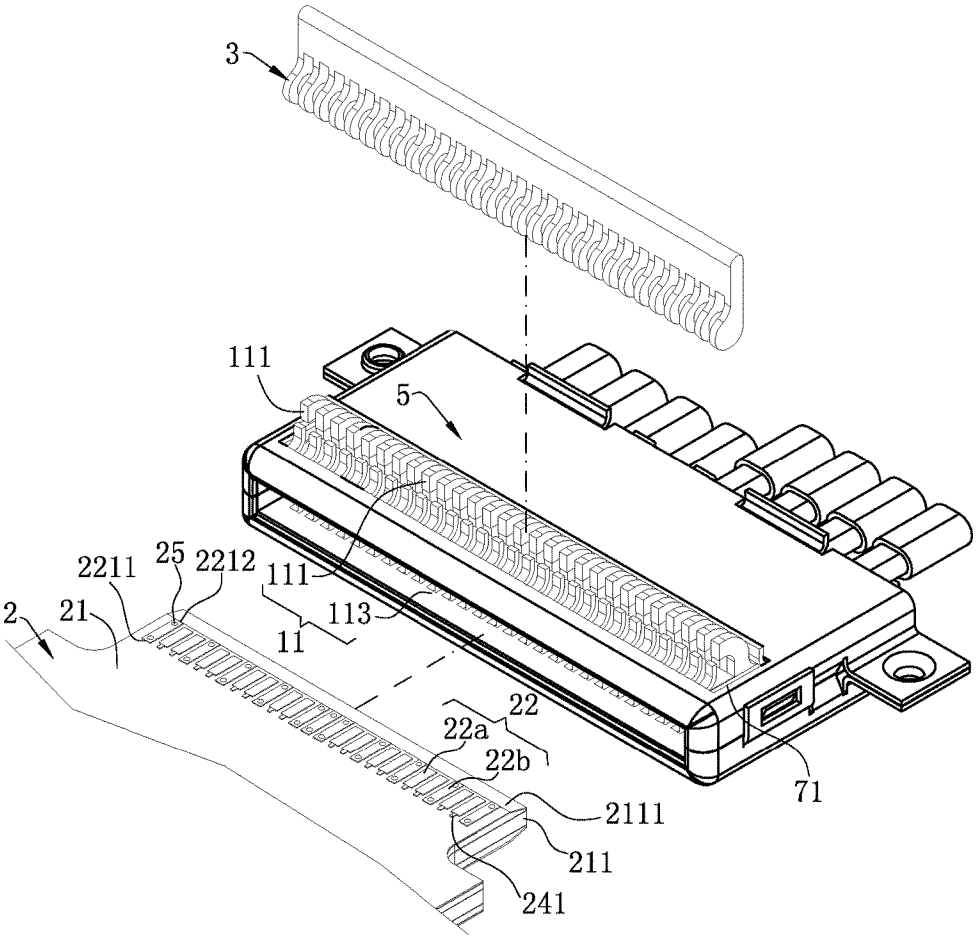
FIG. 19 is another perspective exploded schematic view of an electrical connection device according to a third embodiment of the present invention.
Figure 20:
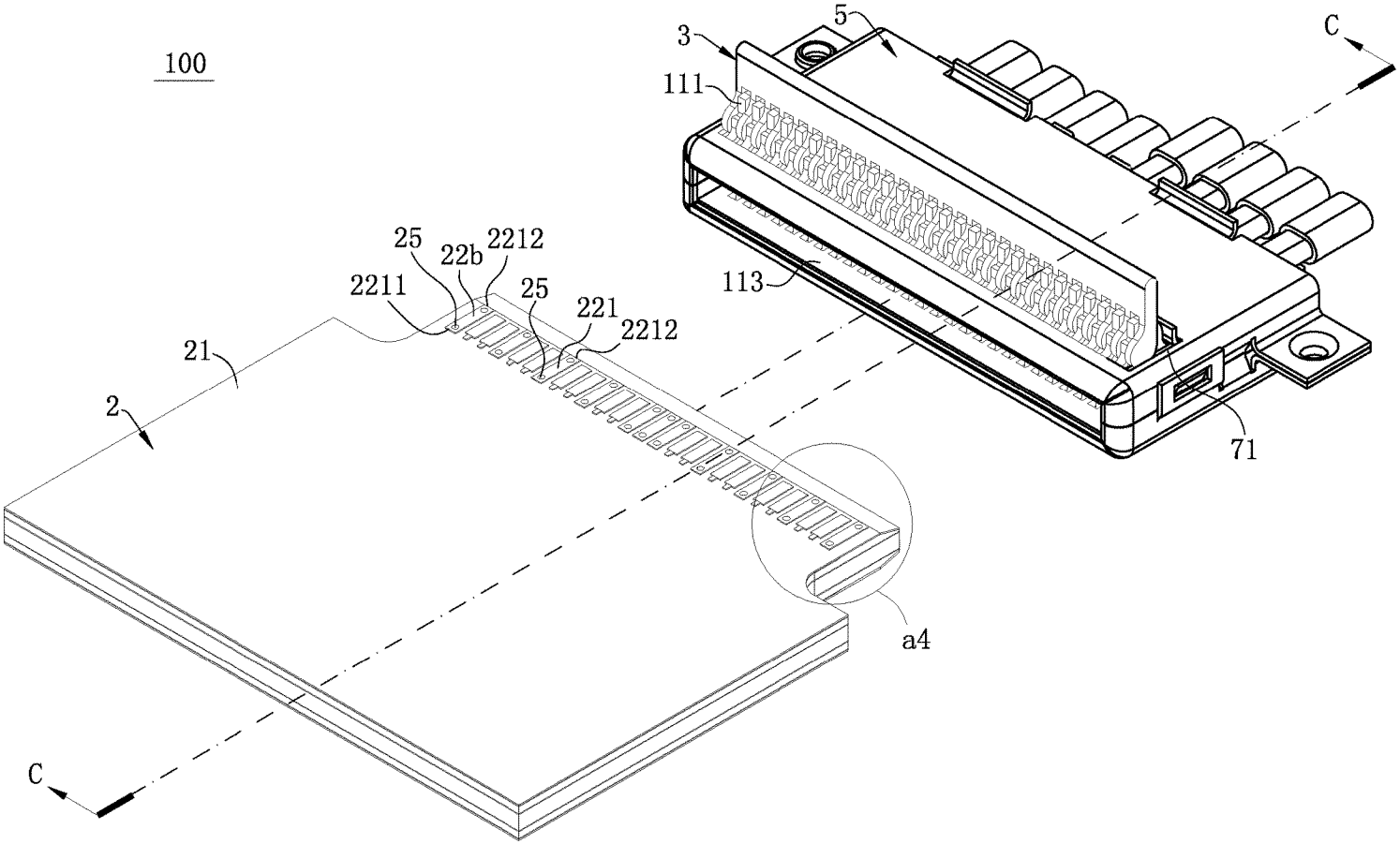
FIG. 20 is a perspective view of the electrical connection device according to the third embodiment of the present invention before the second mating element is mated with the first mating element.
Figure 21:
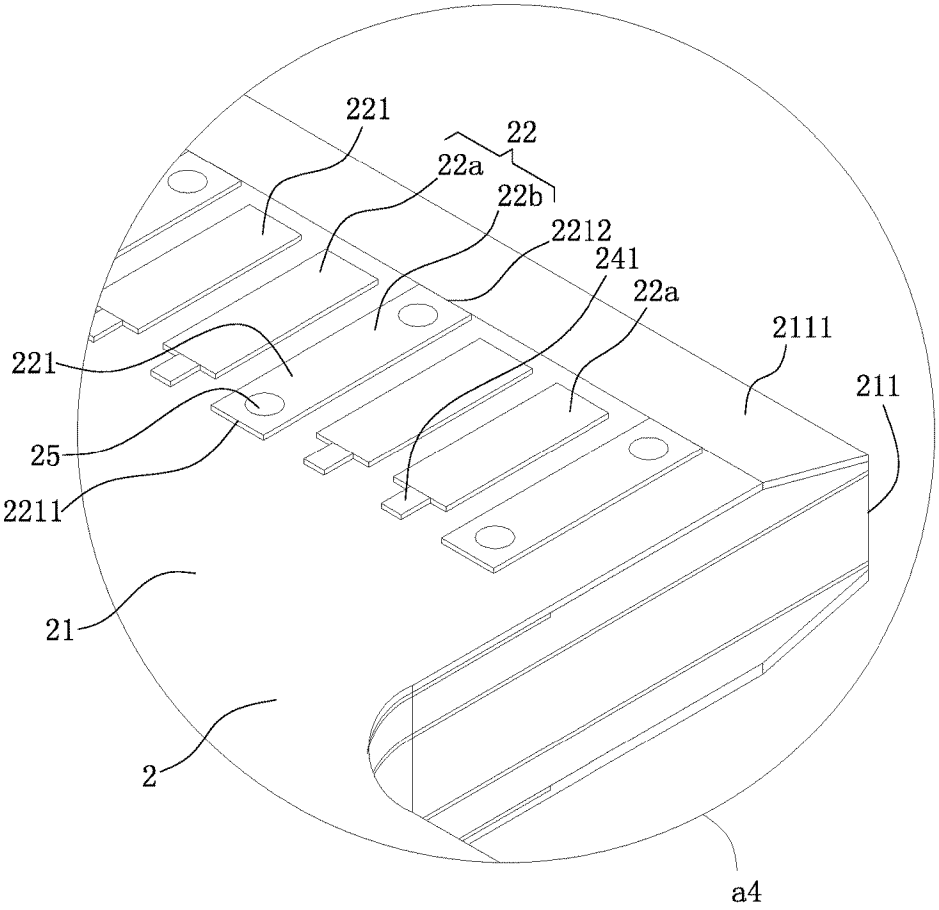
FIG. 21 is an enlarged view of a portion a4 in FIG. 20.
Figure 22:
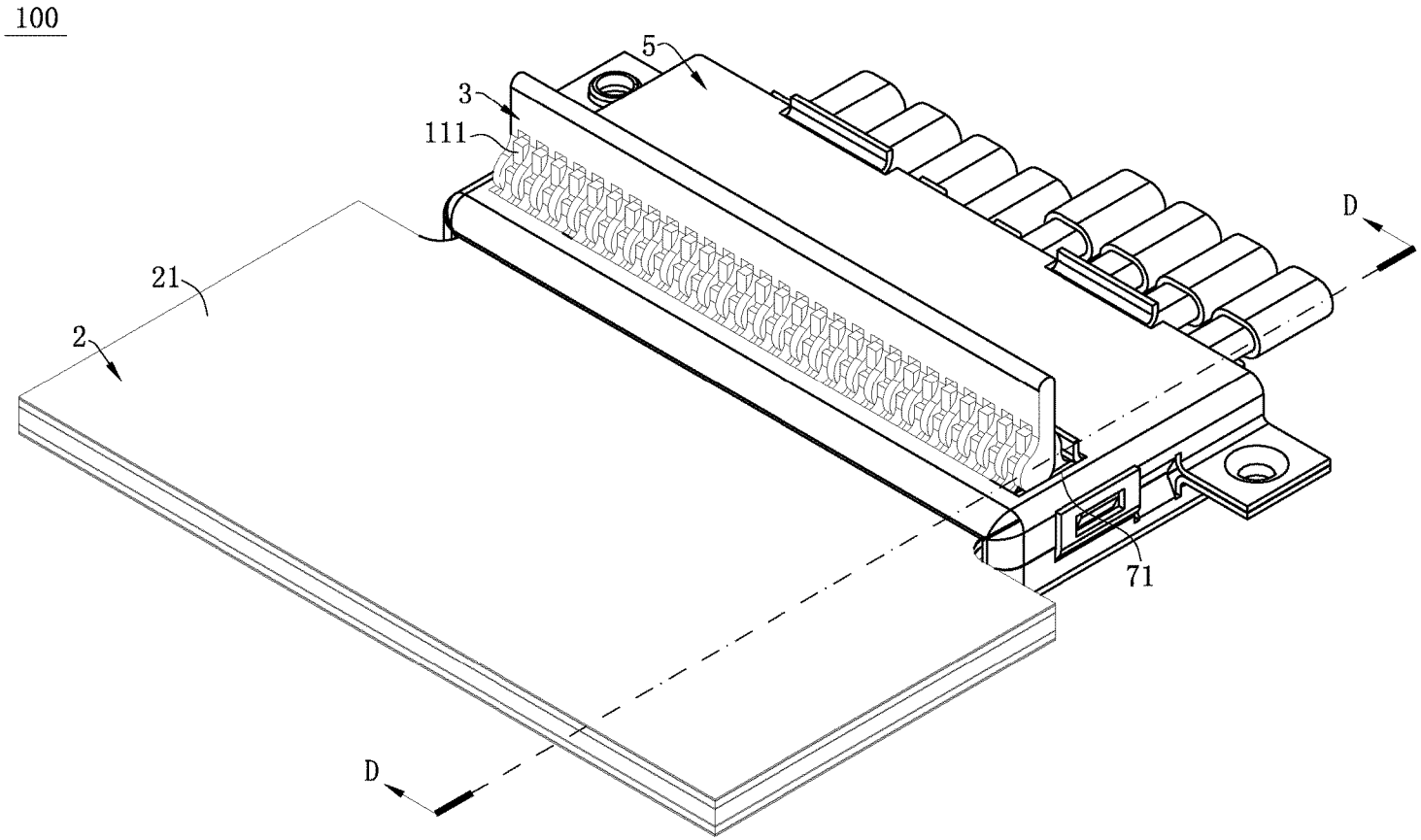
FIG. 22 is a perspective assembled view of the electrical connection device according to the third embodiment of the present invention, where the pressing member is in an open state.
Figure 23:
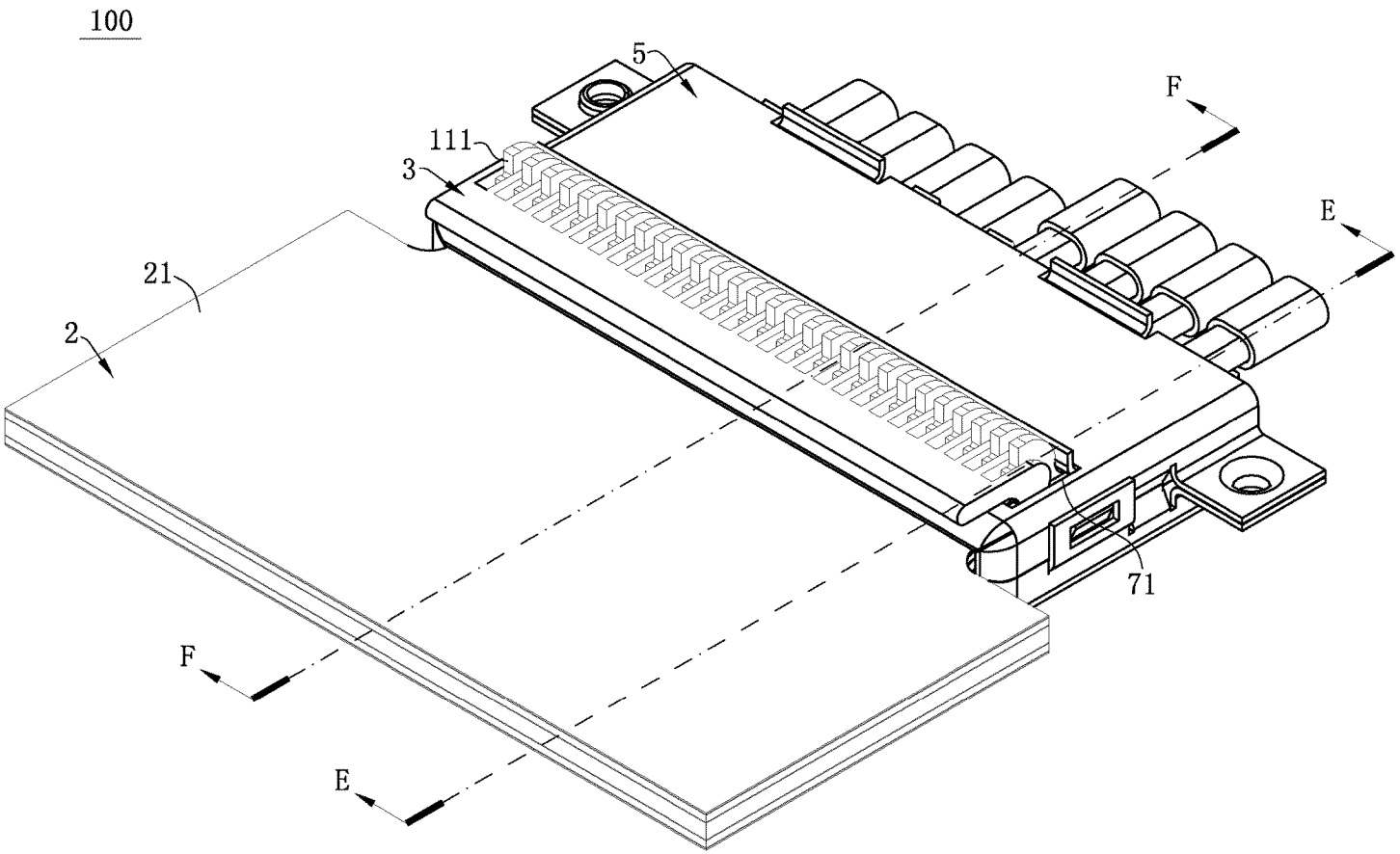
FIG. 23 is a perspective assembled view of the electrical connection device according to the third embodiment of the present invention, where the pressing member is in a closed state.
Figure 24:
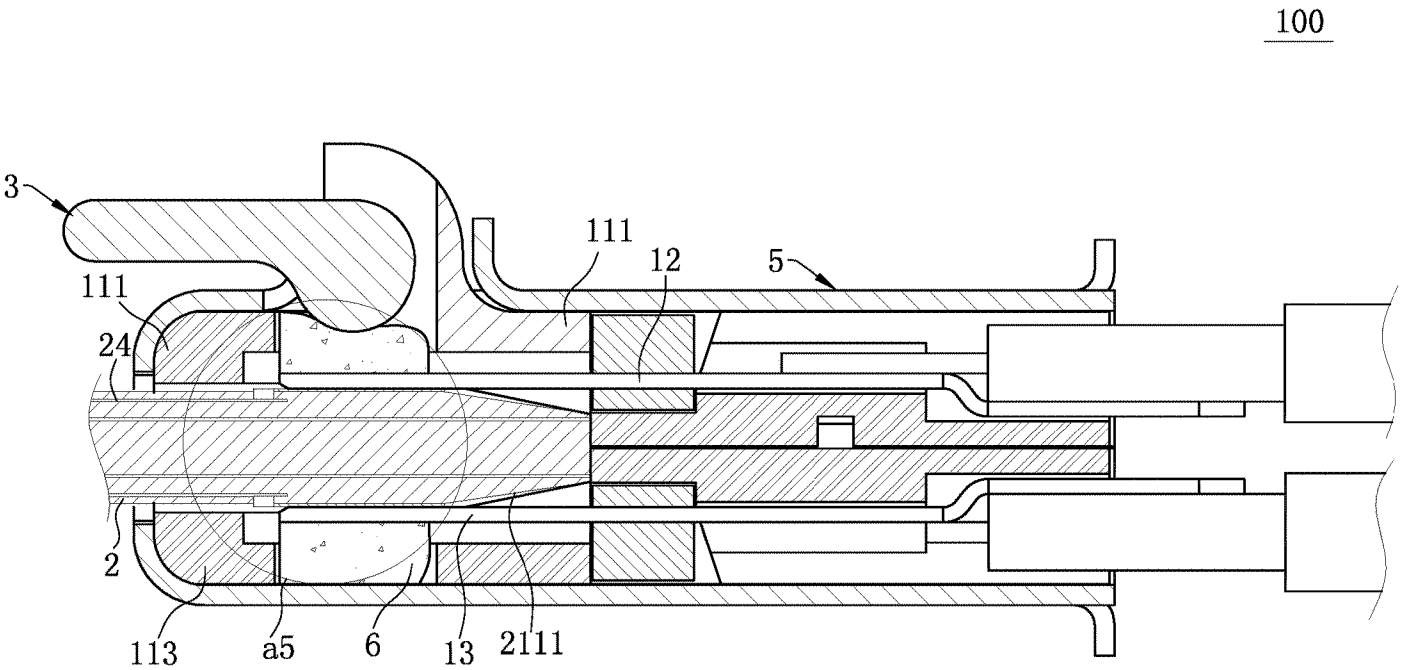
FIG. 24 is a side sectional view of FIG. 23 along an E-E direction.
Figure 25:
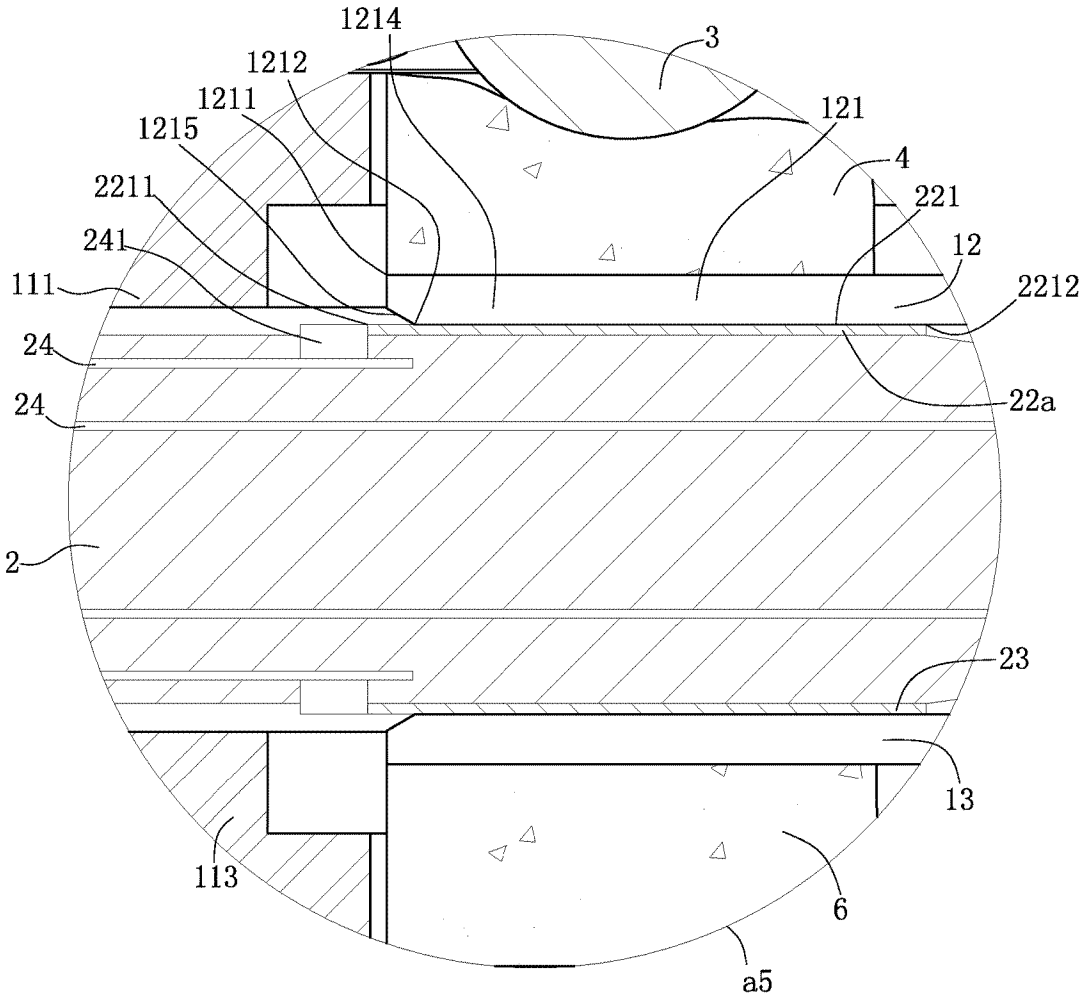
FIG. 25 is an enlarged view of a portion a5 in FIG. 24.

FIG. 16, FIG. 17 and FIG. 19 show a third embodiment of the electrical connection device 100 of the present invention, which is different from the first embodiment in that: the first insulating body 11 is formed by an upper body 111 and a lower body 113 being assembled together. The upper body 111 is provided with an accommodating groove 1111 facing upward and vertically running through the upper body 111. The first insulating body 11 is accommodated in a metal shell 7, and the metal shell 7 is provided with a slot 71 facing upward and corresponding to the accommodating groove 1111, such that the accommodating groove 1111 is exposed upward out of the slot 71.

Figure 26:
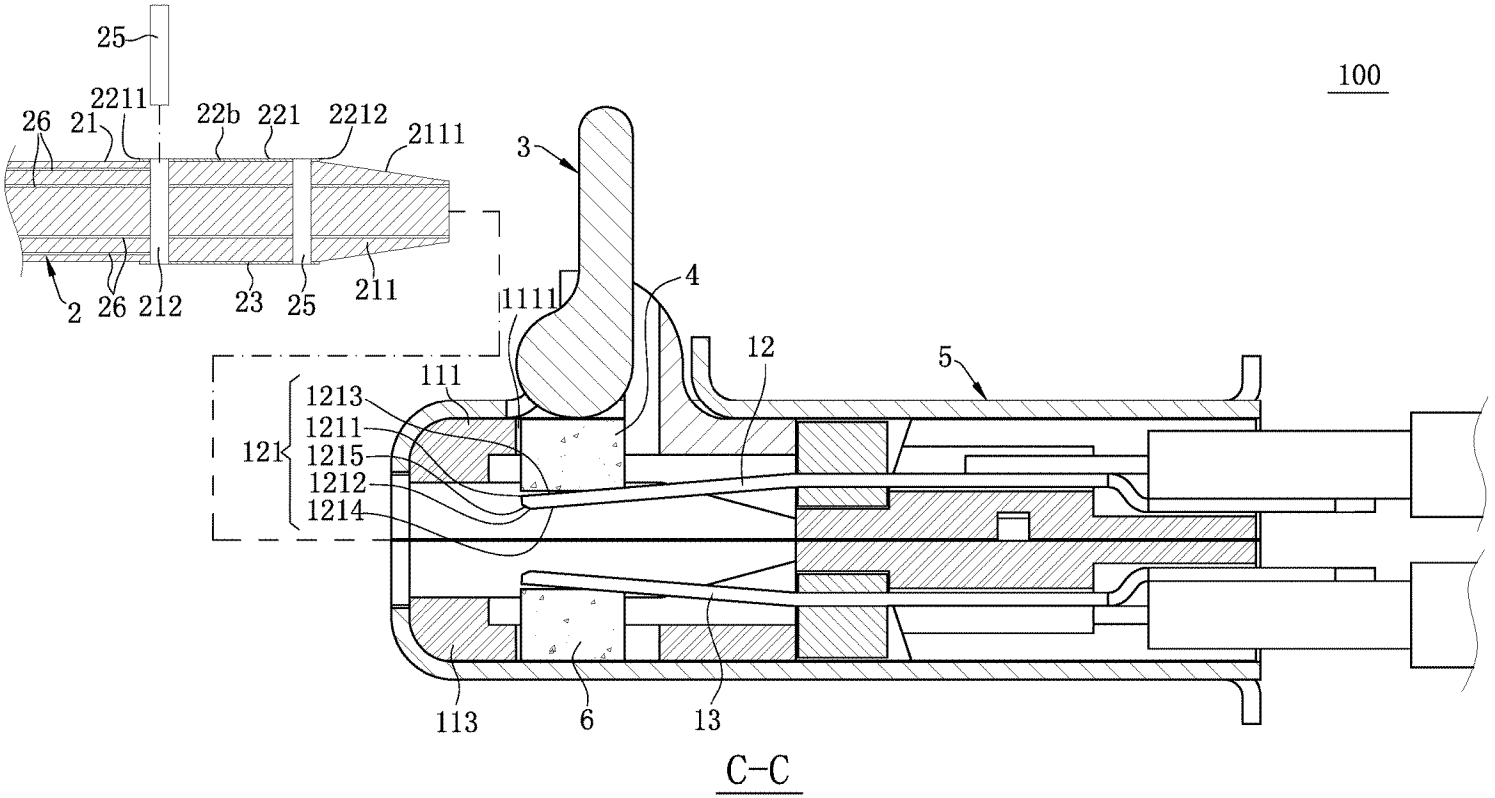
FIG. 26 is a side sectional view of FIG. 20 along a C-C direction.
Figure 27:
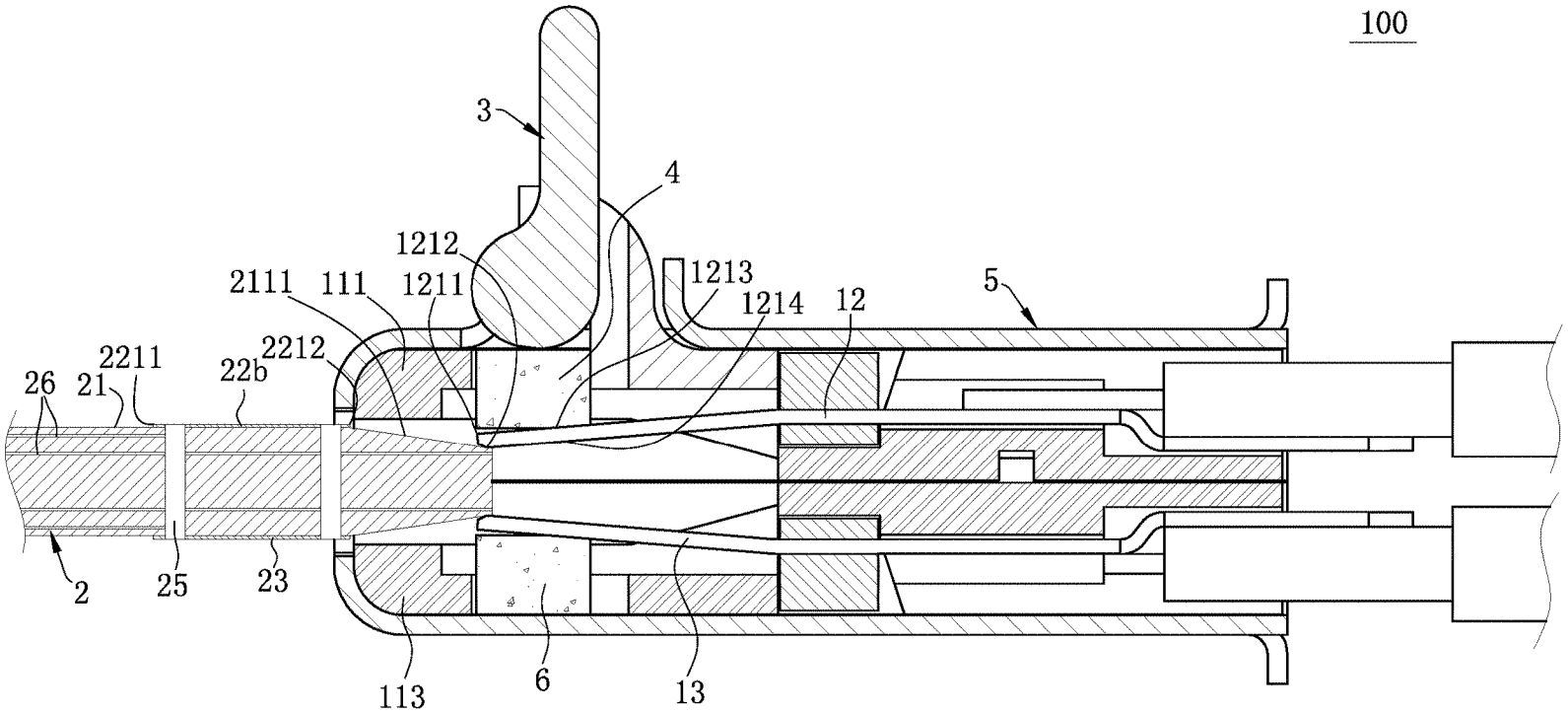
FIG. 27 is a side sectional view of the electrical connection device according to the third embodiment of the present invention when the second mating element is mated with the first mating element.
Figure 28:
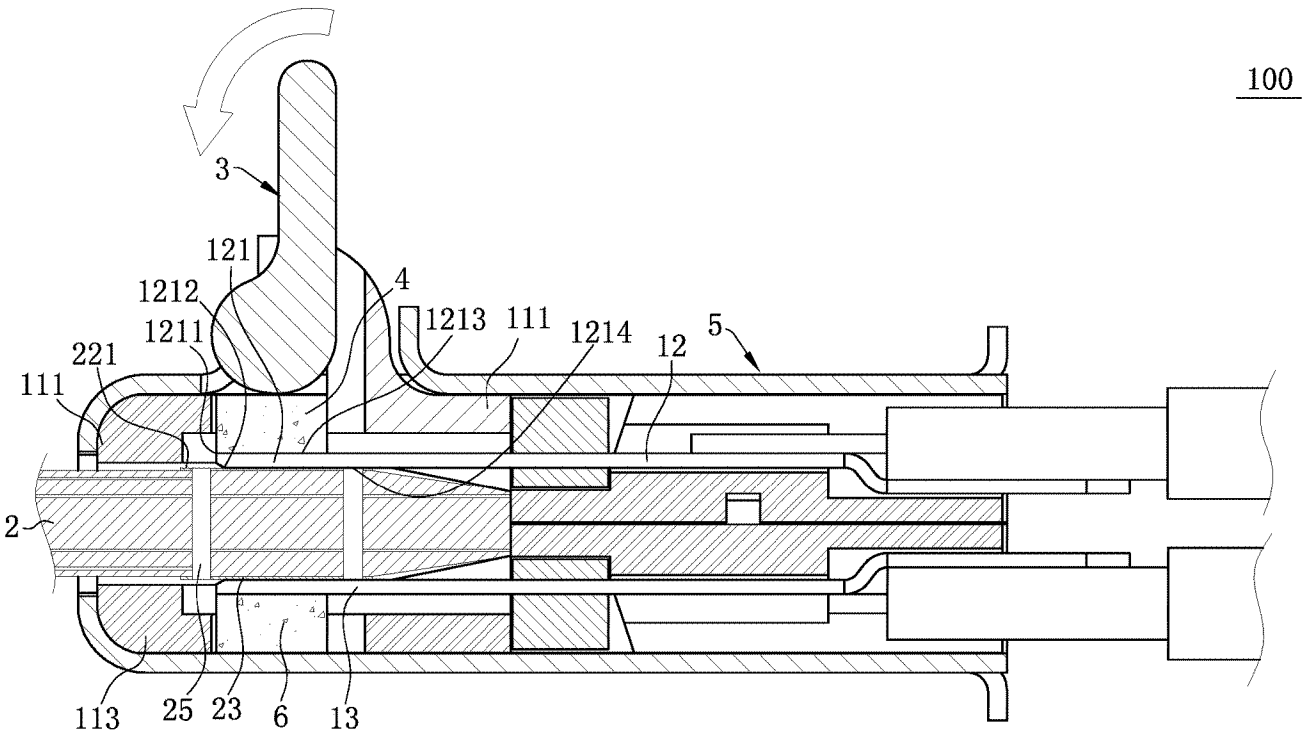
FIG. 28 is a side sectional view of FIG. 22 along a D-D direction.

As shown in FIG. 26, FIG. 27 and FIG. 28, the contact portions 121 obliquely extend downward as a whole. The front end of each contact portion 121 is provided with a slope surface 1215 which obliquely extends from the front end surface of the contact portion 121 to the lower surface of the contact portion 121, such that in a horizontal projection, the upper edge 1211 is located in front of the lower edge 1212, and in the mating process, the slope surfaces 1215 function to guide the contact portions 121 to be in contact with the top surfaces 221, thus preventing the front ends of the contact portions 121 from being excessively sharp to scratch the circuit board 2.

The rear end of the second insulating body 21 is provided with a chamber 211, and the chamfer 211 extends along a width direction of the second insulating body 21. The chamfer 211 of the circuit board 2 is provided with a guide surface 2111 extending to the ground pads 22*b*, and the rear edges 2212 of the ground pads 22*b* are exposed out of the guide surface 2111, such that the rear edges 2212 can smoothly abut the contact areas 1214, and the chamfer 211 is not too high (for example, the chamfer 211 protrudes upward to be higher than the top surfaces 221 of the signal pads 22*a* or higher than the top surfaces 221 of the ground pads 22*b*) to cause one end of each contact area 1214 to be located on the chamfer 211, and thus failing to be in contact with the rear edge 2212, generating an antenna effect to adversely affect the quality of signal transmission.

Figure 29:
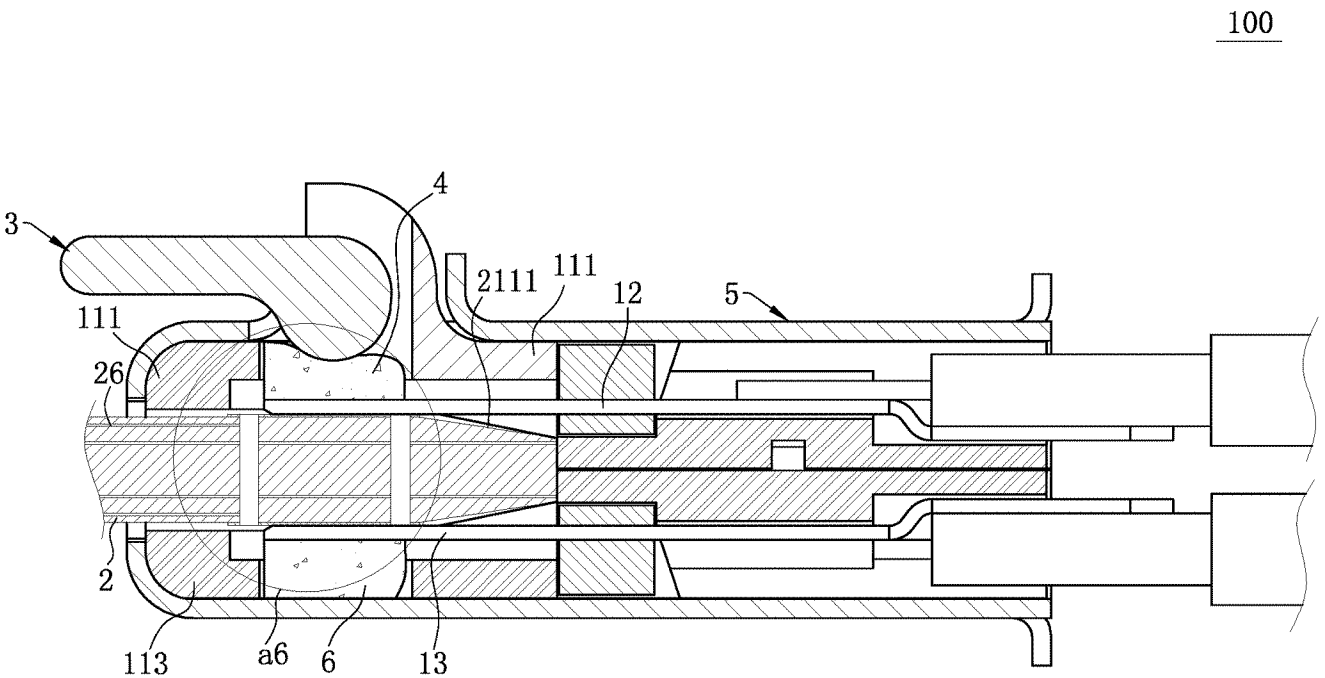
FIG. 29 is a side sectional view of FIG. 23 along a F-F direction.
Figure 30:
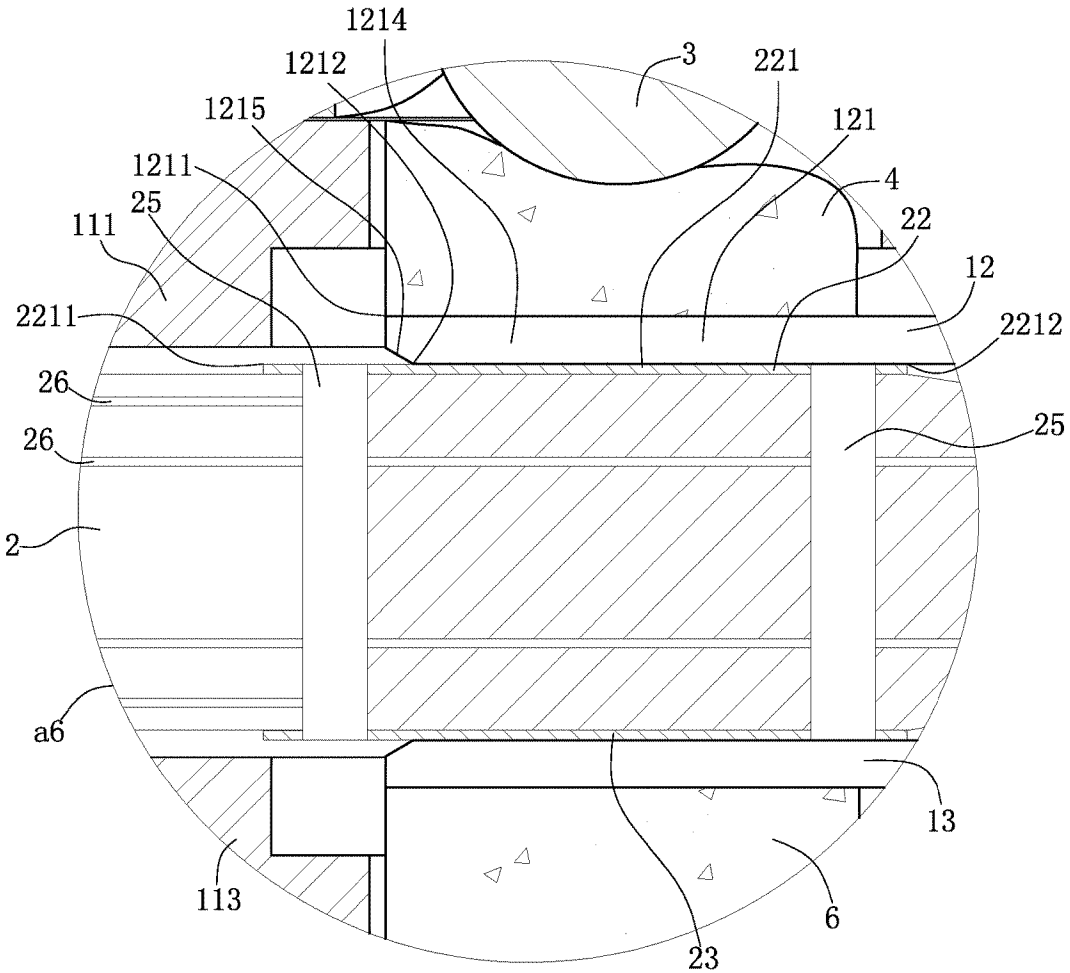
FIG. 30 is an enlarged view of a portion a6 in FIG. 29.

As shown in FIG. 26 and FIG. 29, the elastic body 4 is accommodated in the accommodating groove 1111. The pressing member 3 is an eccentric wheel provided in the accommodating groove 1111 and abuts the elastic body 4 from the top. The eccentric wheel 3 has an open state and a closed state.

As shown in FIG. 26 and FIG. 28, the eccentric wheel 3 is in the open state, where the elastic body 4 does not press or does not fully press the contact portions 121. The minimum distance between the front ends of the first conductors 12 and the front ends of the third conductors 13 is greater than a thickness of the rear end of the chamfer 211, such that the distance between both can facilitate the insertion of the chamfer 211 even if the front ends of the first conductors 12 are close to the front ends of the third conductors 13. Then, the contact areas 1214 respectively slide along the guide surface 2111 and the top surfaces 221, the guide surface 2111 scrapes the contact areas 1214, and the contact areas 1214 and the top surfaces 221 scrap and move with respect to each other.

As shown in FIG. 24, FIG. 25, FIG. 29 and FIG. 30, when the eccentric wheel 3 is in the closed state, the eccentric wheel 3 provides a downward acting force, such that the first conductors 12 downward abut the second conductors 22, the contact areas 1214 are attached to the top surfaces 221, the lower edges 1212 are located between the front edges 2211 and the rear edges 2212 and abut the top surfaces 221, and the rear edges 2212 abut the contact areas 1214.

When the eccentric wheel 3 is switched from the open state to the closed state, the elastic body 4 moves downward, providing a downward acting force to press the contact portions 121. The first conductors 12 press the second conductors 22, and the downward acting force is transmitted downward, such that the fourth conductors 23 move downward to be in contact with the third conductors 13, and the third conductors 13 move toward the elastic element 6, such that both are in tight contact. The metal shell 7 bears the elastic element 6, and thereby facilitating the mating process.

In this embodiment, the contact portions 121 extend downward, which is favorable for the mating between the first conductors 12 and the second conductors 22 with each other. As long as the front ends of the contact portions 121 bend and extend downward, that is, as shown in the FIG. 26, the contact portions 121 bend downward as a whole, or the middle portions of the contact portions 121 are raised upward and the front ends then bend downward, the requirement that the guide surface 2111 scrapes the contact areas 1214 and the contact areas 1214 and the top surfaces 221 scrape each other in the mating process can be met. The remaining structures are identical with those of the first embodiment, and therefore are not elaborated herein.

Figure 31:
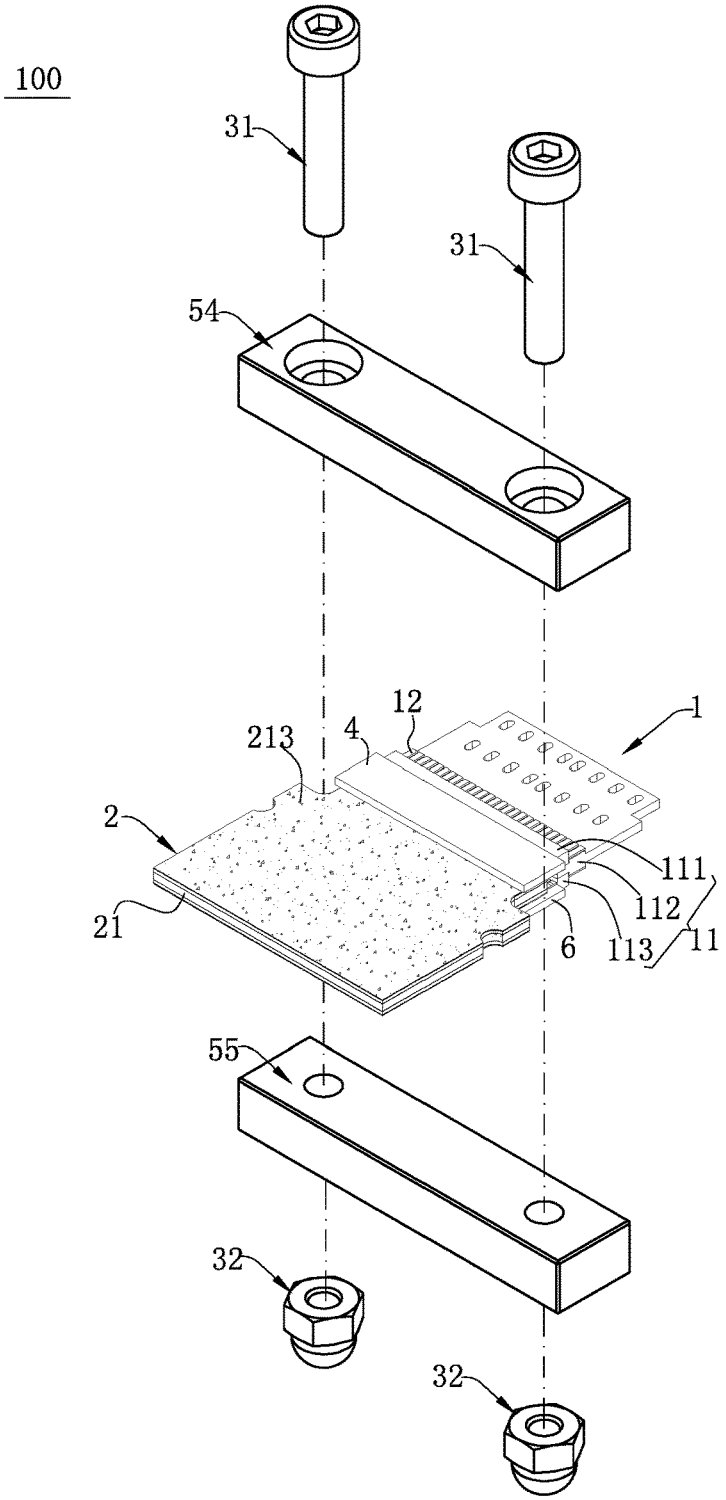
FIG. 31 is a perspective exploded schematic view of an electrical connection device according to a fourth embodiment of the present invention.
Figure 32:
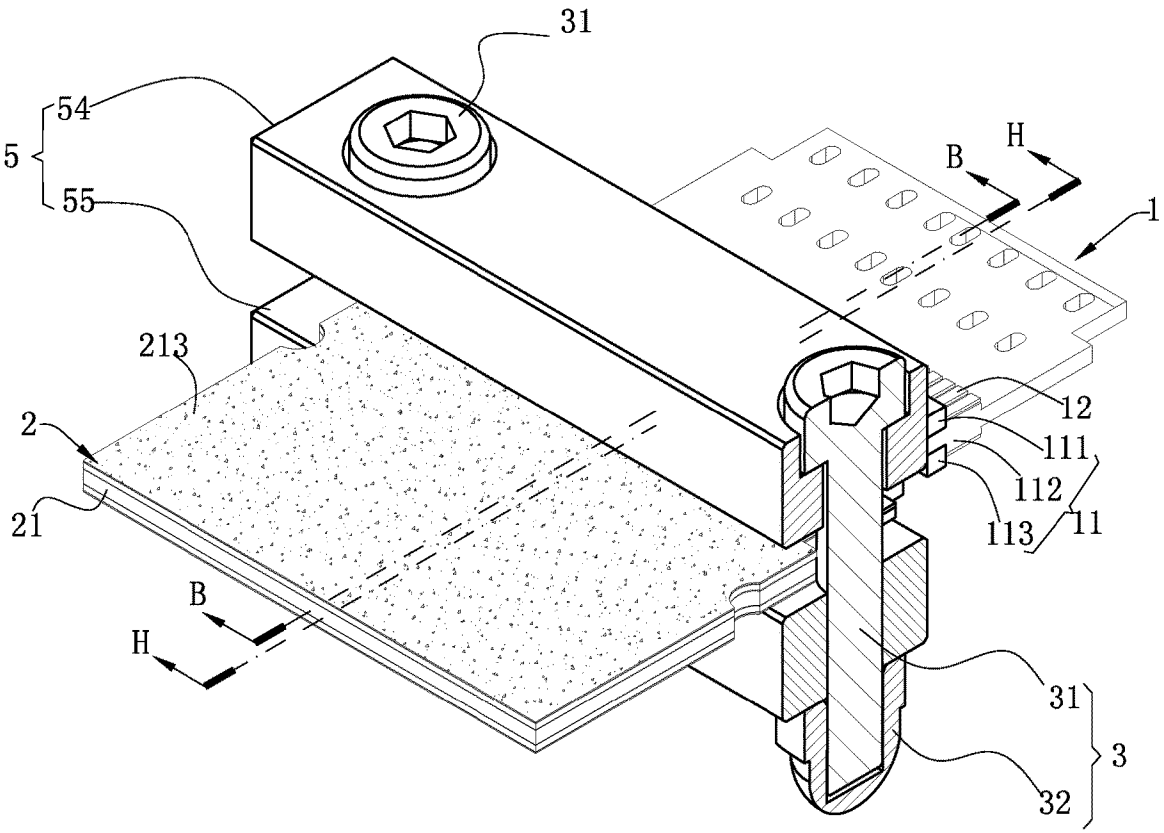
FIG. 32 is a partial perspective assembly view of the electrical connection device according to the fourth embodiment of the present invention.
Figure 33:
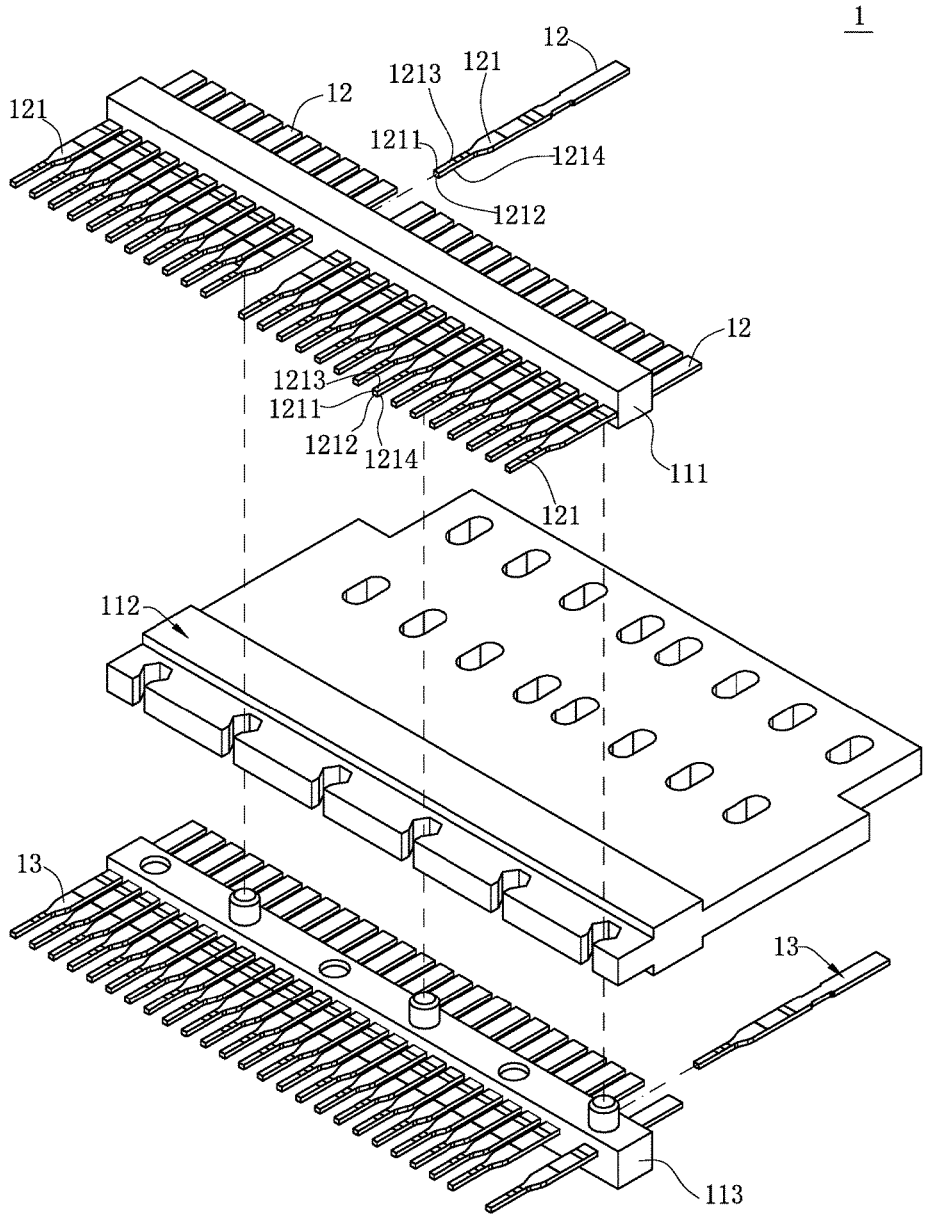
FIG. 33 is a perspective exploded view of the first mating element of the electrical connection device according to the fourth embodiment of the present invention.

FIG. 31, FIG. 32 and FIG. 33 show a fourth embodiment of the electrical connection device 100 of the present invention, which is different from the first embodiment in that: the first conductors 12 are arranged horizontally as a whole, such that the contact portions 121 are almost not bent in the pressing process, thus preventing from repetitive insertion and pulling from causing the metal fatigue of the first conductors 12.

Figure 34:
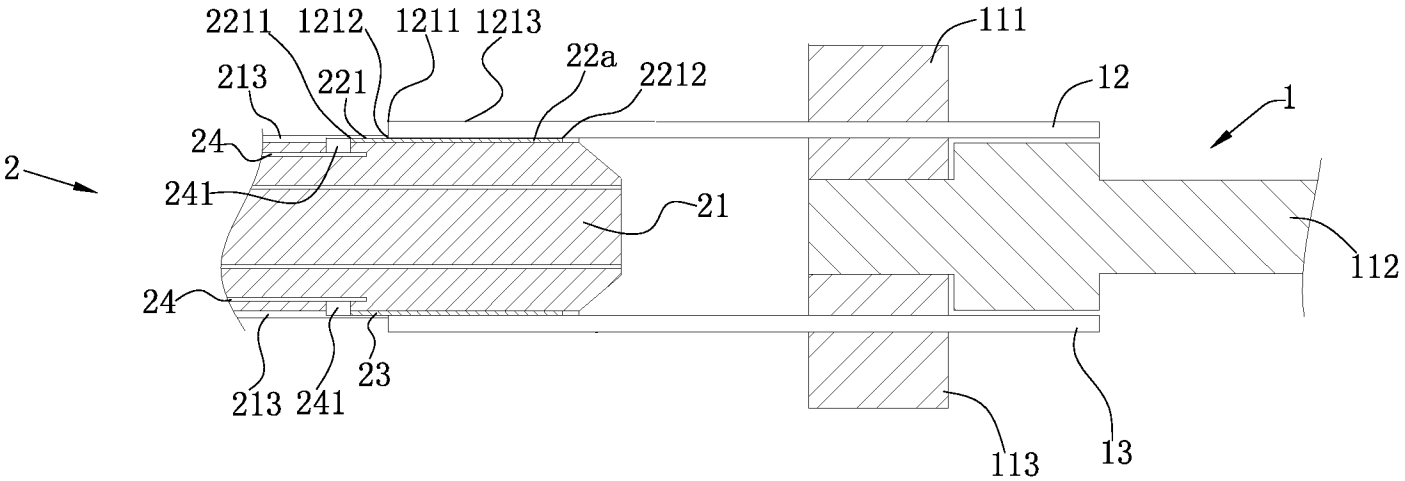
FIG. 34 is a side sectional view of the electrical connection device according to the fourth embodiment of the present invention after the second mating element is mated with the first mating element.
Figure 35:
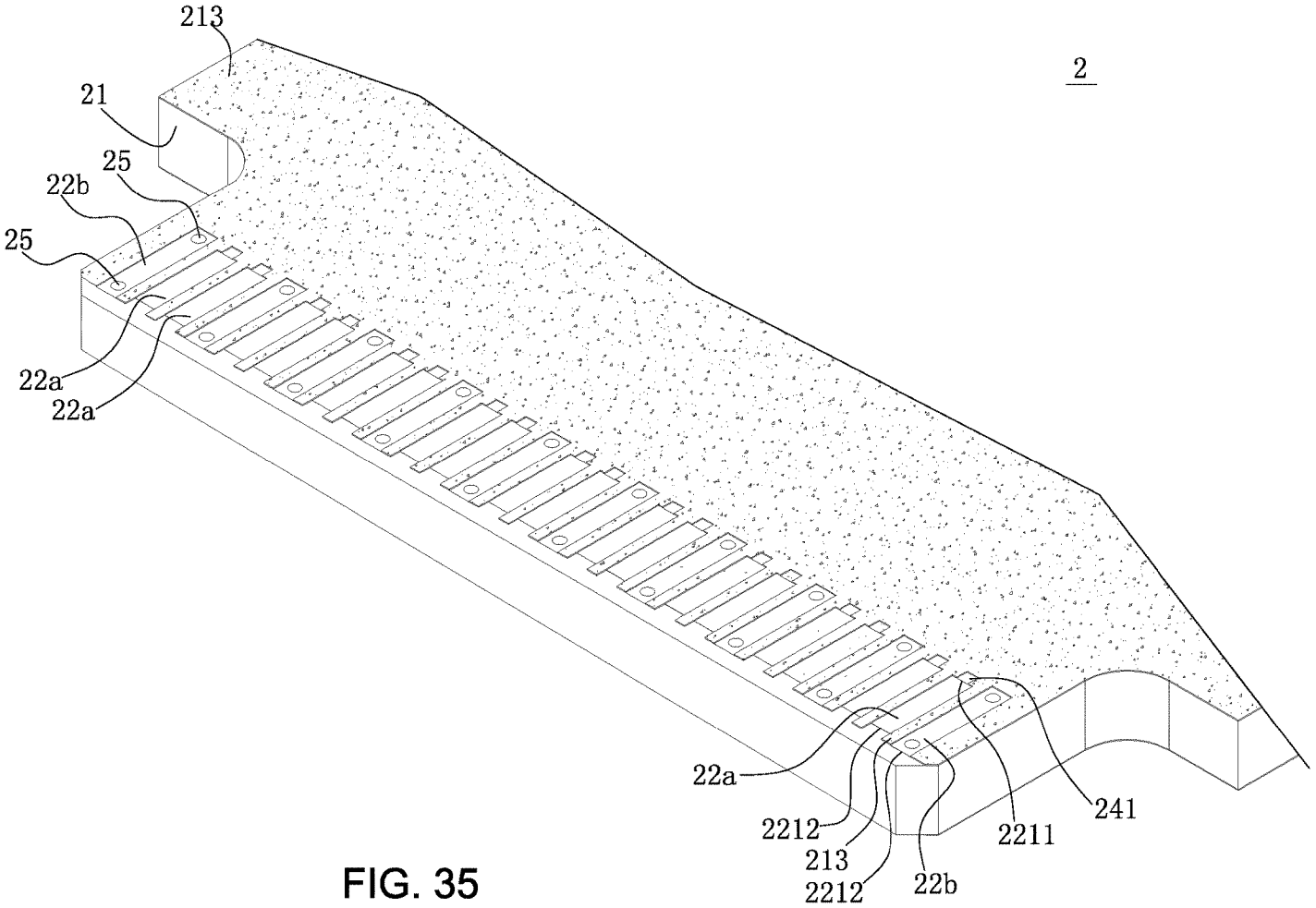
FIG. 35 is a perspective schematic view of the second mating element of the electrical connection device according to the fourth embodiment of the present invention.

As shown in FIG. 34 and FIG. 35, the length of the signal pad 22*a* is shorter than the length of the ground pad 22*b*, and the rear edges 2212 of the ground pads 22*b* are located behind the rear edges 2212 of the signal pads 22*a*, such that the contact portions 121 of the first conductors 12 corresponding to the ground pads 22*b* are first in contact with the ground pads 22*b* to form a shield, and then the contact portions 121 of the first conductors 12 corresponding to the signal pads 22*a* are in contact with the signal pads 22*a*, thereby benefiting the stable transmission of signals.

As shown in FIG. 33, FIG. 34 and FIG. 35, the upper surface and the lower surface of the circuit board 2 are coated symmetrically with conformal coating 213, and the height of the upper surface of the conformal coating 213 on the upper surface of the circuit board 2 is greater than the height of the top surfaces 221, such that the signal pads 22*a* and the ground pads 22*b* are embedded steadily in the conformal coating 213. The conformal coating 213 is three anti lacquer and has good resistance to high and low temperature, and has excellent insulation, moisture proof, leakage proof, shock proof, dust proof, corrosion prevention, aging resistance, corona resistance and so on.

Further, the upper surface of the circuit board 2 is not coated with the conformal coating 213 right behind the signal terminals and the ground terminals, such that the rear edges 2212 of the signal pads 22*a* and the rear edges 2212 of the ground pads 22*b* are all exposed backward out of the circuit board 2, and not covered by the conformal coating 213, which helps the rear edges 2212 of the signal pads 22*a* and the rear edges 2212 of the ground pads 22*b* smoothly abut the contact areas 1214 of the corresponding first conductors 12.

As shown in FIG. 31 and FIG. 32, the pressing member 3 is a screw, which includes a bolt 31 and a nut 32 matching with each other. An insulating member 5 includes an upper insulating block 54 and a lower insulating block 55 arranged opposite to each other to clamp the first insulating body 11 therebetween. The bolt 31 perpendicularly passes through the upper insulating block 54 and the lower insulating block 55, and is fitted in the nut 32 located below the lower insulating block 55 to provide a pressing force to press the elastic body 4. The elastic body 4 is clamped between the upper insulating block 54 and the circuit board 2, and backwardly abuts against the upper body 111, and the elastic element 6 is clamped between the lower insulating block 55 and the circuit board, and backward abuts the lower body 113. The remaining structures are identical with those of the first embodiment, and therefore are not elaborated herein.

In other embodiments, the height of the upper surface of the conformal coating 213 may not be greater than the height of the top surfaces 221 of the signal pads 22*a* or the height of the top surfaces 221 of the ground pads 22*b*.

Figure 36:
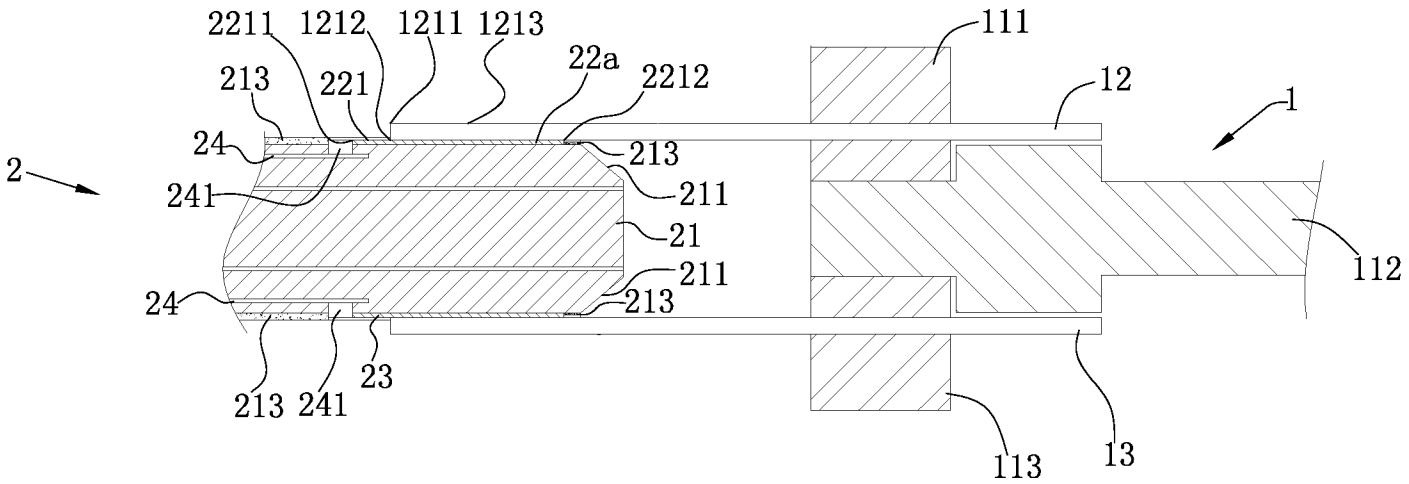
FIG. 36 is a side sectional view of an electrical connection device according to a fifth embodiment of the present invention after the second mating element is mated with the first mating element.
Figure 37:
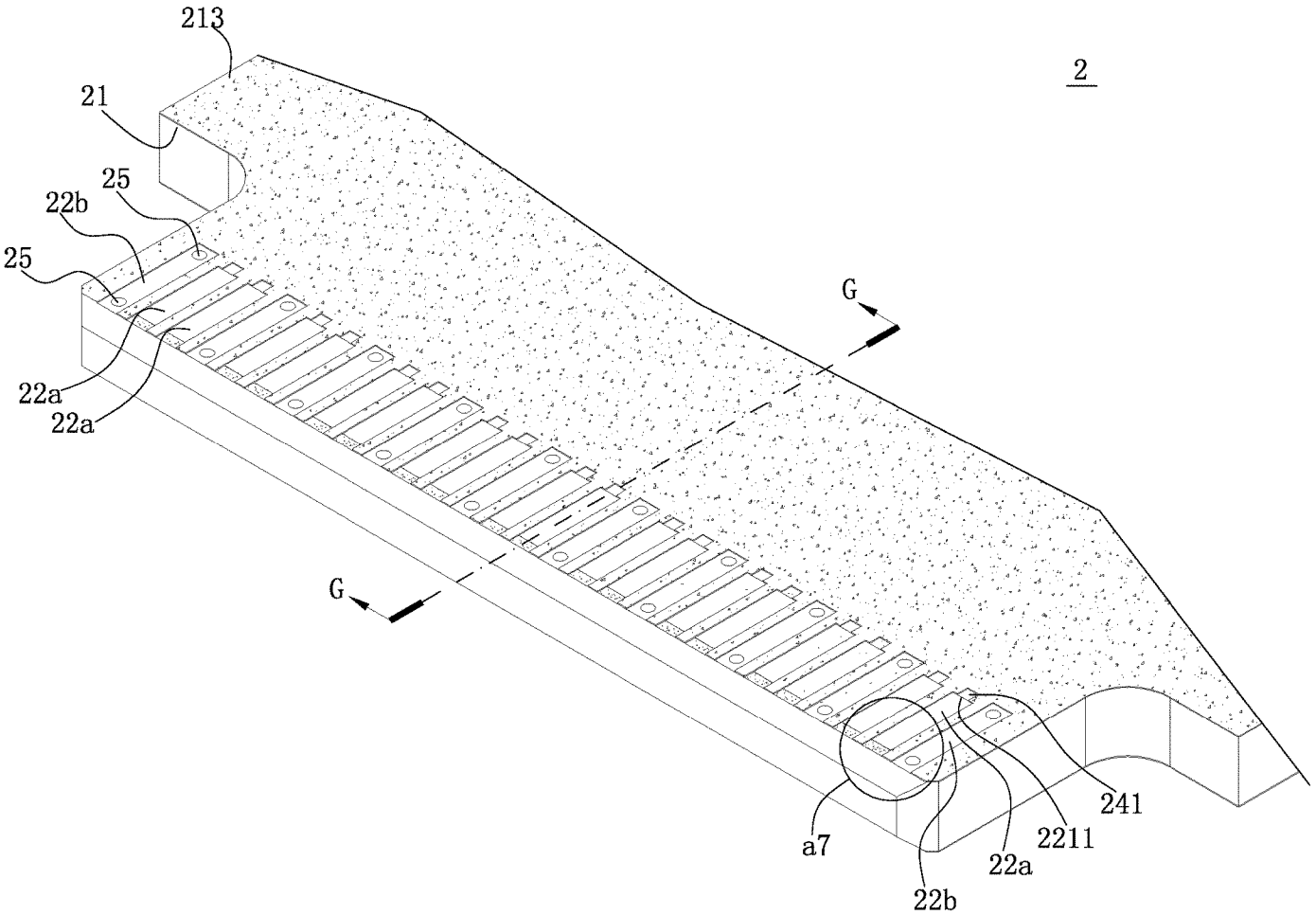
FIG. 37 is a perspective schematic view of the second mating element of the electrical connection device according to the fifth embodiment of the present invention.
Figure 38:
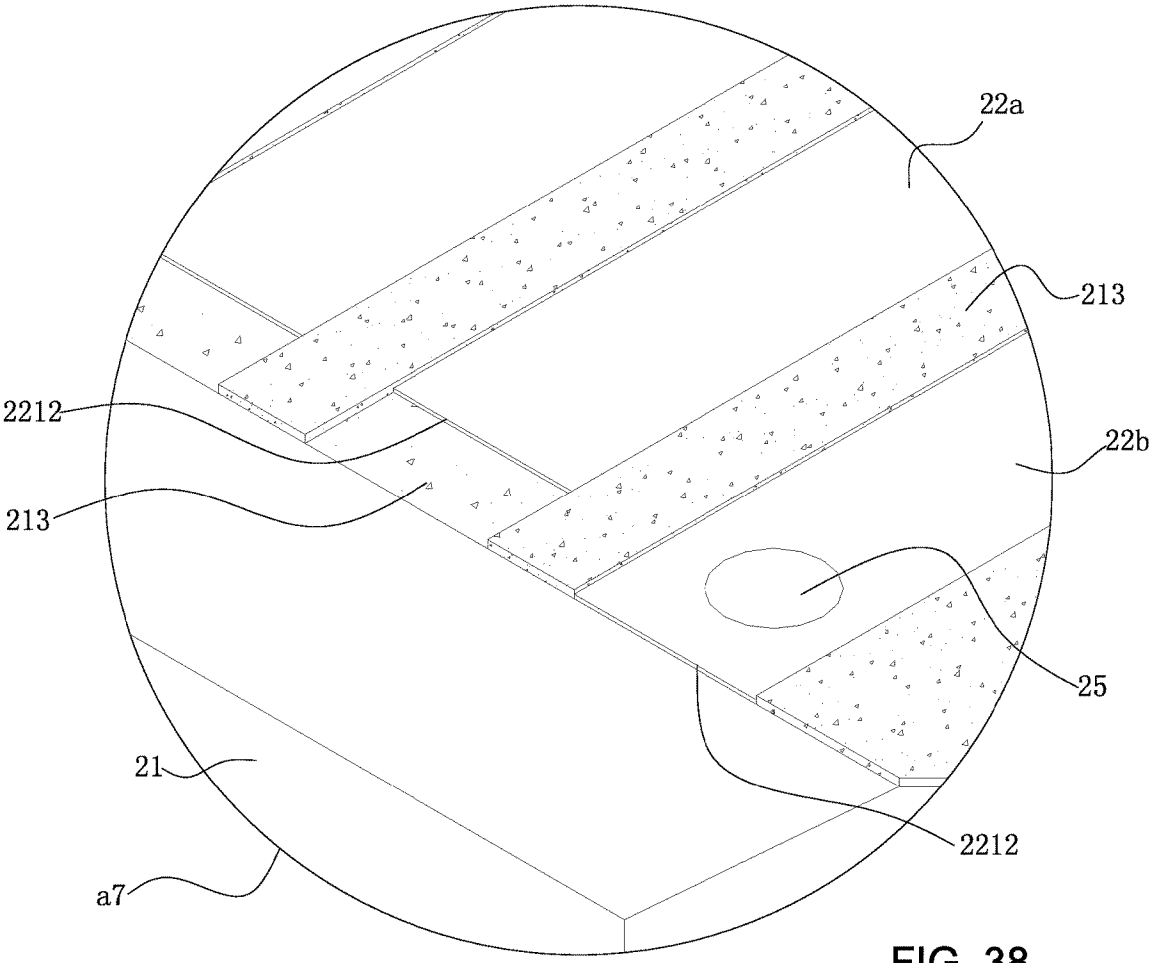
FIG. 38 is an enlarged view of a portion a7 in FIG. 37.

FIG. 36 to FIG. 38 show a fifth embodiment of the electrical connection device 100 of the present invention, which is different from the fourth embodiment in that: the rear end of the circuit board 2 is provided with a chamfer 211 behind the signal pads 22*a* and the ground pads 22*b*. The chamfer 221 extends forward to the ground pads 22*b*, and the rear edges 2212 of the ground pads 22*b* are exposed out of the chamfer 211, such that the rear edges 2212 can smoothly abut the contact areas 1214, and the chamfer 211 is not too high (for example, the chamfer 211 protrudes upward to be higher than the top surfaces 221 of the signal pads 22*a* or higher than the top surfaces 221 of the ground pads 22*b*) to cause one end of each contact area 1214 to be located on the chamfer 211, and thus failing to be in contact with the rear edge 2212, generating a stake effect to adversely affect the quality of signal transmission.

Moreover, the rear edges 2212 of the ground pads 22*b* are located behind the rear edges 2212 of the signal pads 22*a*, such that the chamfer 221 does not extend forward to the signal pads 22*a*. Both the upper surface and the lower surface of the circuit board 2 are coated with the conformal coating 213, and the upper surface of the circuit board 2 is also coated with the conformal coating 213 right behind the signal pads 22*a*. In this case, the height of the upper surface of the conformal coating 213 is lower than the height of the top surfaces 221 of the signal pads 22*a*, such that the rear edges 2212 can smoothly abut the contact areas 1214, and the conformal coating 213 is not too high (for example, the chamfer 211 protrudes upward to be higher than the top surfaces 221 of the signal pads 22*a* or higher than the top surfaces 221 of the ground pads 22*b*) to cause one end of each contact area 1214 to be located on the conformal coating 213, and thus failing to be in contact with the rear edge 2212, generating a stake effect to adversely affect the quality of signal transmission. The remaining structures are identical with those of the fourth embodiment, and therefore are not elaborated herein.

FIG. 39 to FIG. 44 show a sixth embodiment of the electrical connection device 100 of the present invention, which has a similar structure to the third embodiment, where the first mating element 1 includes a first insulating body 11, multiple cables 10 accommodated in the first insulating body 11, and a metal shell 7 wrapping the first insulating body 11.

Figure 41:
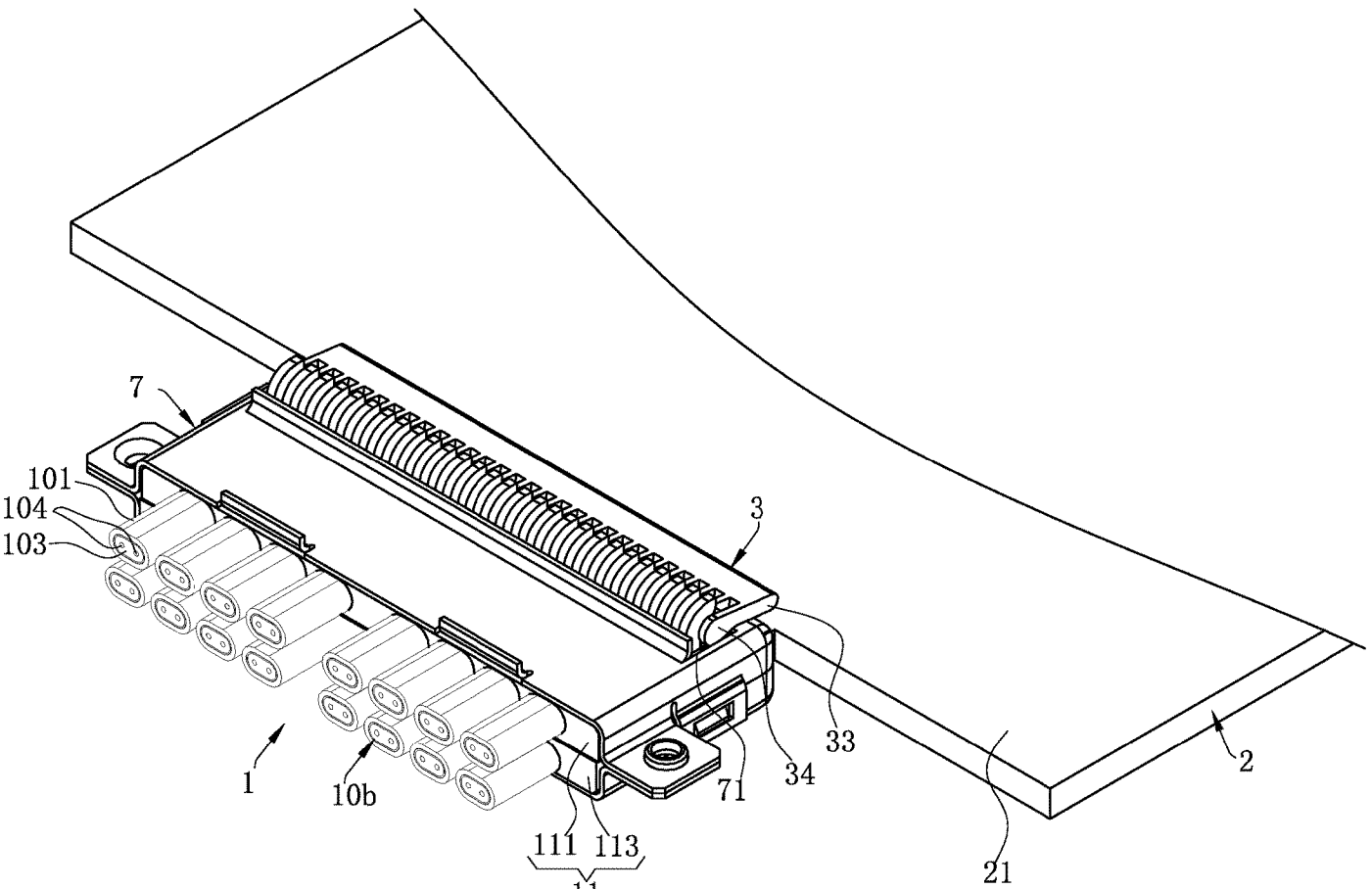
FIG. 41 is a perspective view of the electrical connection device according to the sixth embodiment of the present invention after the second mating element is mated with the first mating element.
Figure 42:
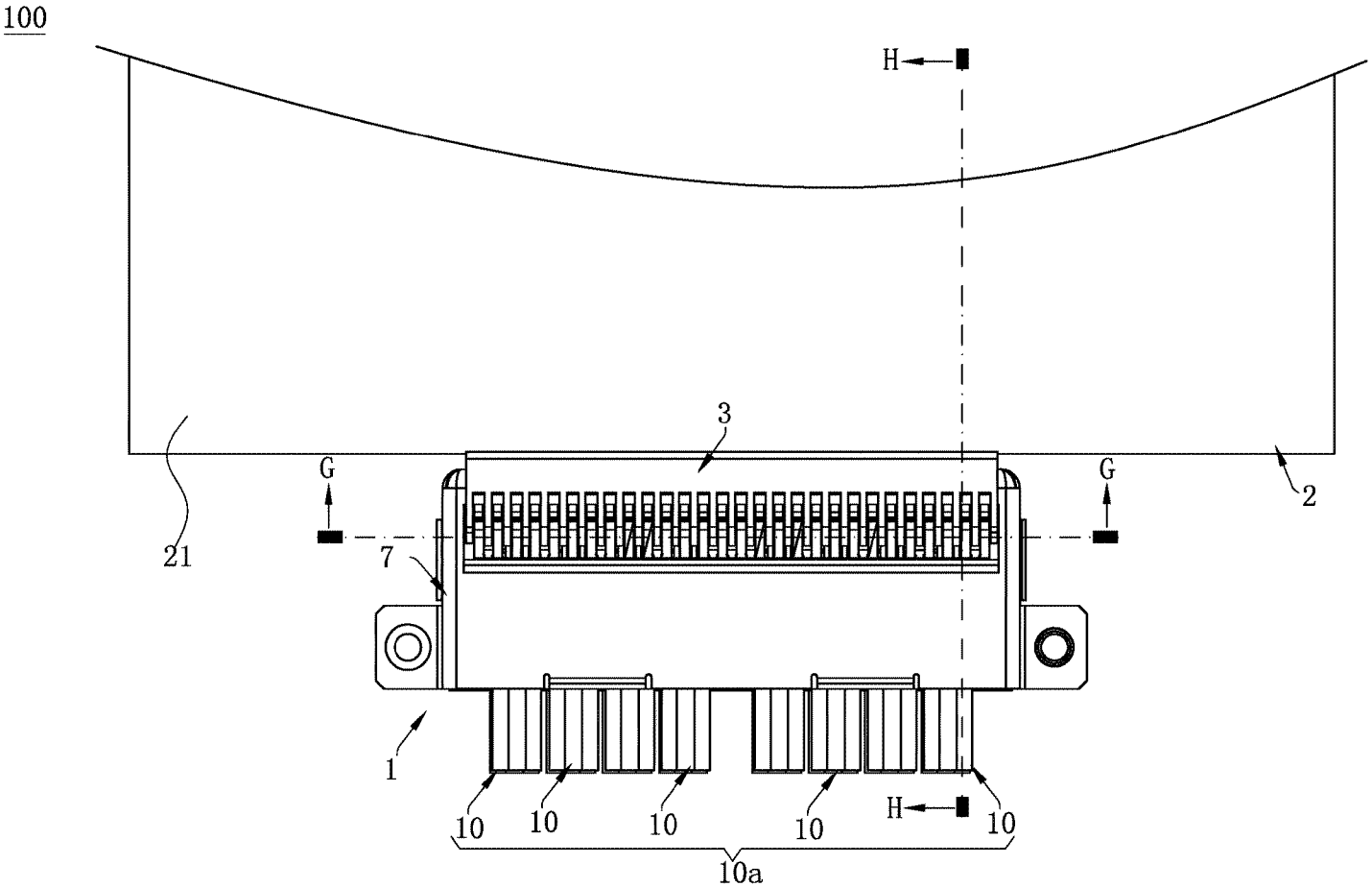
FIG. 42 is a top view of FIG. 41.
Figure 43:
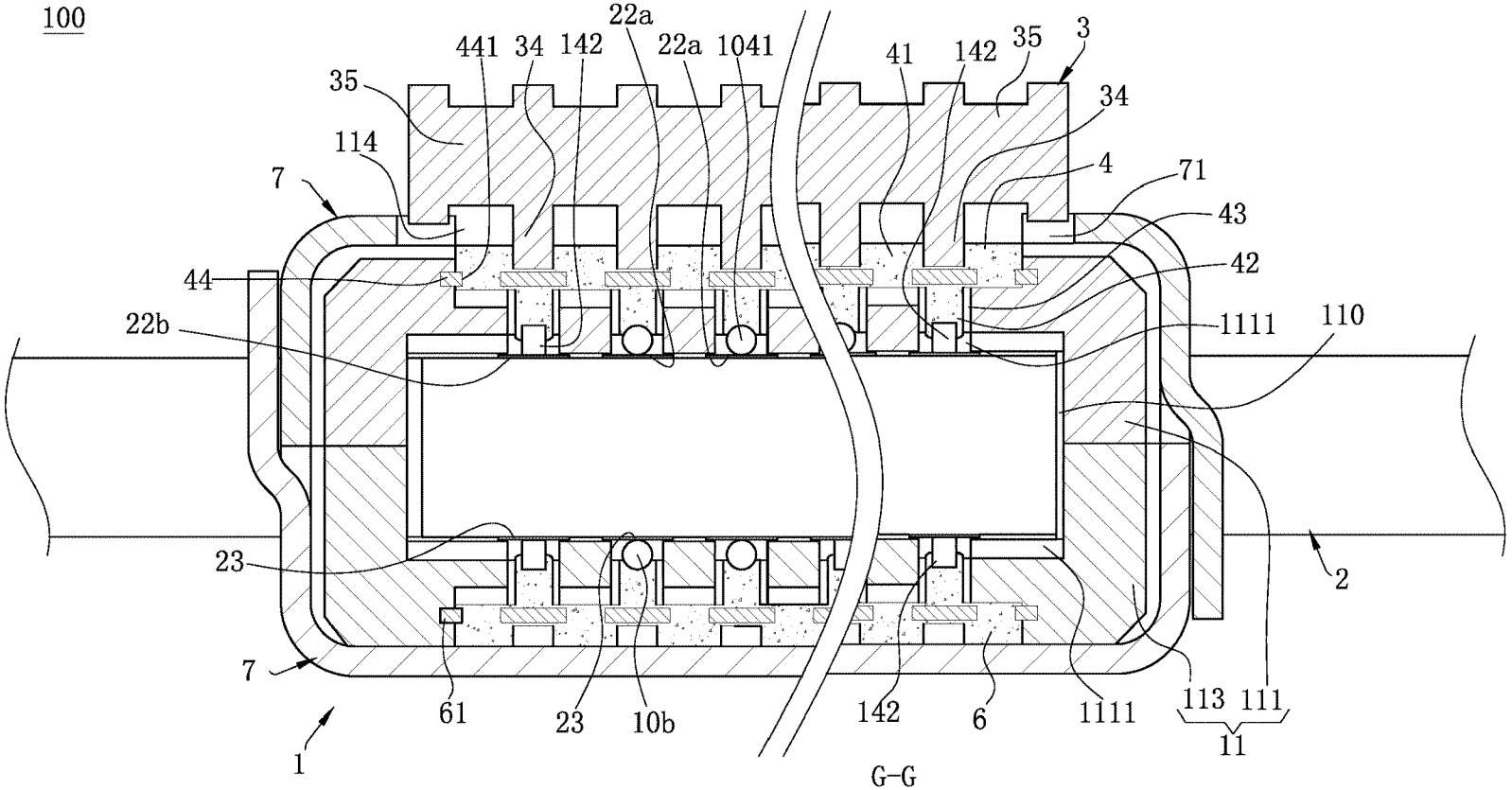
FIG. 43 is a side sectional view of FIG. 42 along a G-G direction.
Figure 44:
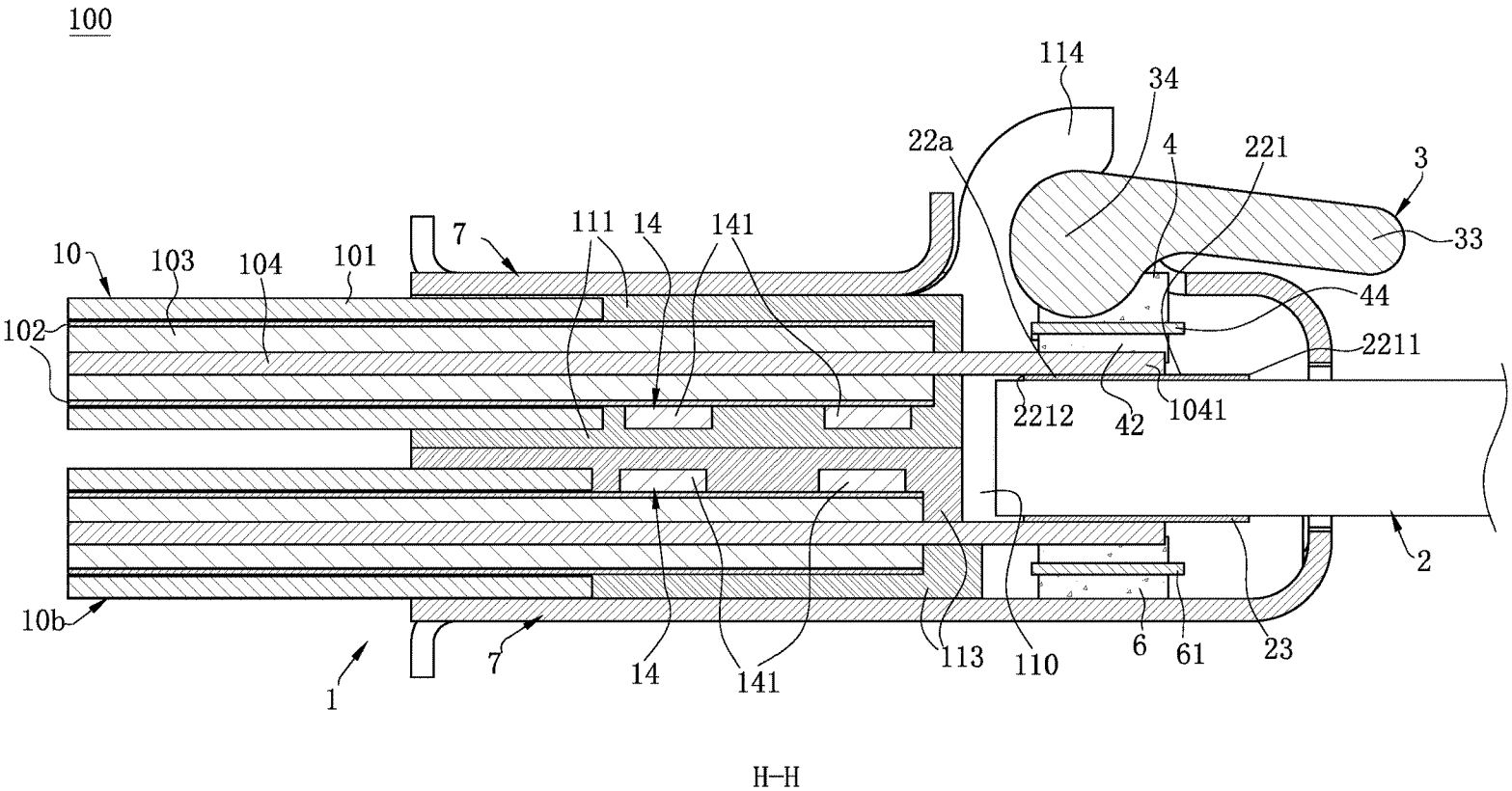
FIG. 44 is a side sectional view of FIG. 42 along a H-H direction.

As shown in FIG. 41, FIG. 43 and FIG. 44, the first insulating body 11 has an upper body 111 and a lower body 113 being assembled together, and the upper body 111 and the lower body 113 altogether form an insertion slot 110 therein. The insertion slot 110 runs forward through the first insulating body 11 for insertion of the second mating element 2. The upper body 111 is provided with an accommodating groove 1111 vertically running therethrough and communicated with the insertion slot 110. In the upper body 111, a pivoting portion 114 extends forward from the rear of the accommodating groove 1111 to be above the accommodating groove 1111.

Figure 40:
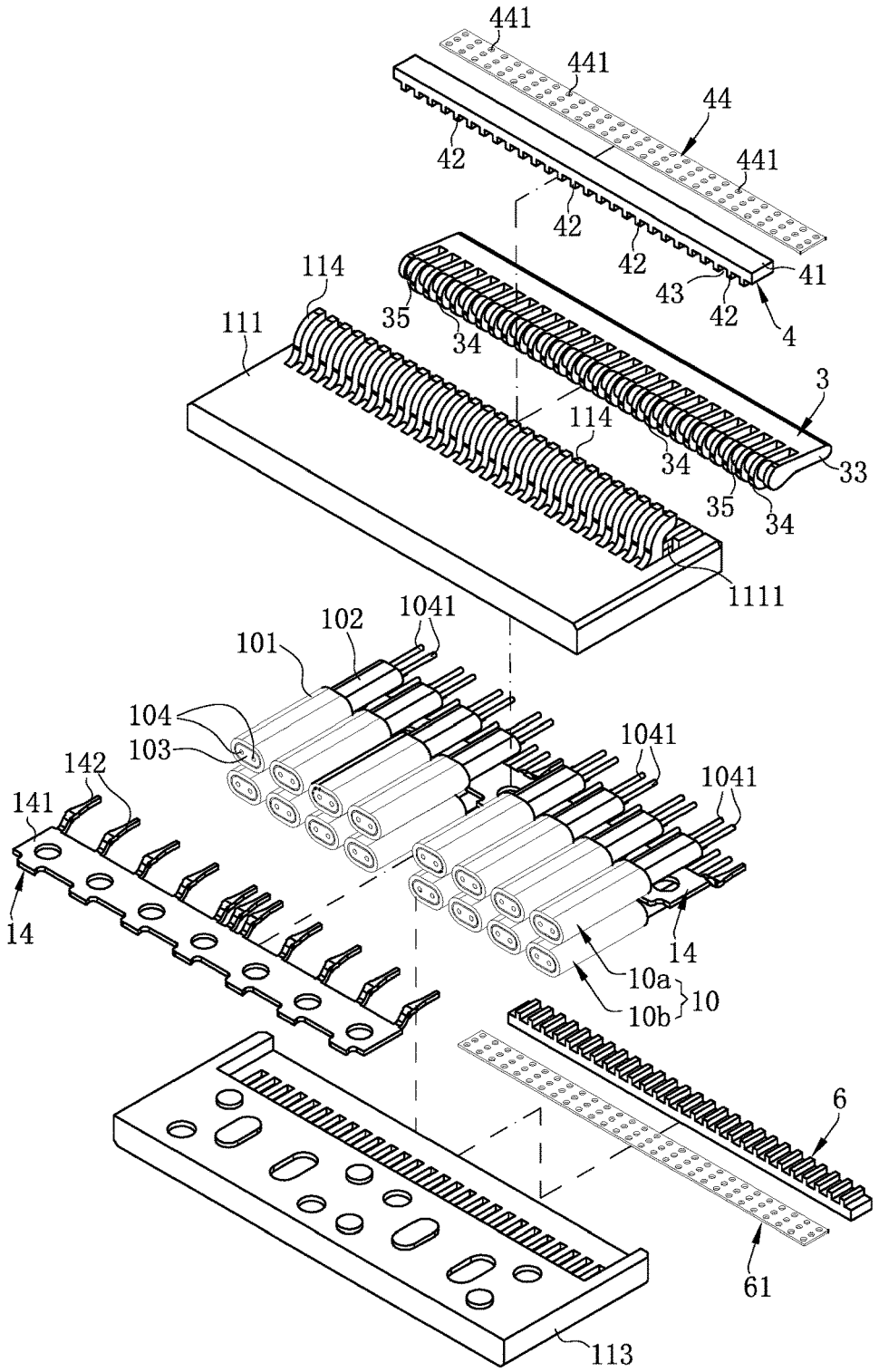
FIG. 40 is a partial perspective exploded view of the first mating element of the electrical connection device according to the sixth embodiment of the present invention.

As shown in FIG. 40 and FIG. 44, the cables 10 are dual axis cables. Each of the cables 10 has two cores 104 in parallel and an insulating layer 103 wrapping the two cores 104, and a shielding layer 102 wraps the insulating layer 103. A sheath 101 wraps the shielding layer 102, and the shielding layer 102 extends forward out of the sheath 101. The insulating layer 103 extends forward out of the shielding layer 102. The cores 104 extend forward out of the insulating layer 103. A front end of each core 104 has a mating section 1041 extending forward along a horizontal direction.

As shown in FIG. 40, FIG. 43 and FIG. 44, eight of the cables 10 form an upper row of cables 10*a*. A grounding strip 14 is provided below the upper row of cables 10*a* and extends transversely. The grounding strip 14 has a grounding portion 141, which is strip-shaped, and a plurality of arm portions 142 extending forward in parallel from the grounding portion 141. The grounding portion 141 is soldered to the shielding layers 102 of the upper row of cables 10*a* by solders (not shown), and the arm portions 142 separate the mating sections 1041 of the adjacent cables 10 in the upper row. The upper row of cables 10*a* and the grounding strip 14 are formed altogether by insert-molding on the upper body 111, and the mating sections 1041 of the upper row of cables 10*a* and the arm portions 142 of the grounding strip 14 are exposed in the insertion slot 110.

As shown in FIG. 40 and FIG. 44, the remaining eight of the cables 10 form a lower row of cables 10*b*. Another grounding strip 14 is provided above the lower row of cables 10*b* and is soldered to the shielding layers 102 of the lower row of cables 10*b*, and the lower row of cables 10*b* and the upper row of cables 10*a* have identical structures and are arranged in vertical symmetry. The two grounding strips 14 have identical structures and are arranged in vertical symmetry. The lower row of cables 10*b* and the another grounding strip 14 are formed altogether by insert-molding on the lower body 113.

As shown in FIGS. 43 and 44, the metal shell 7has an open slot 71 vertically corresponding to the accommodating groove 1111, such that the accommodating groove 1111 is exposed upward out of the open slot 71. The pivoting portion 114 extends upward out of the open slot 71, and the insertion slot 110 is exposed forward from the metal shell 7.

Figure 39:
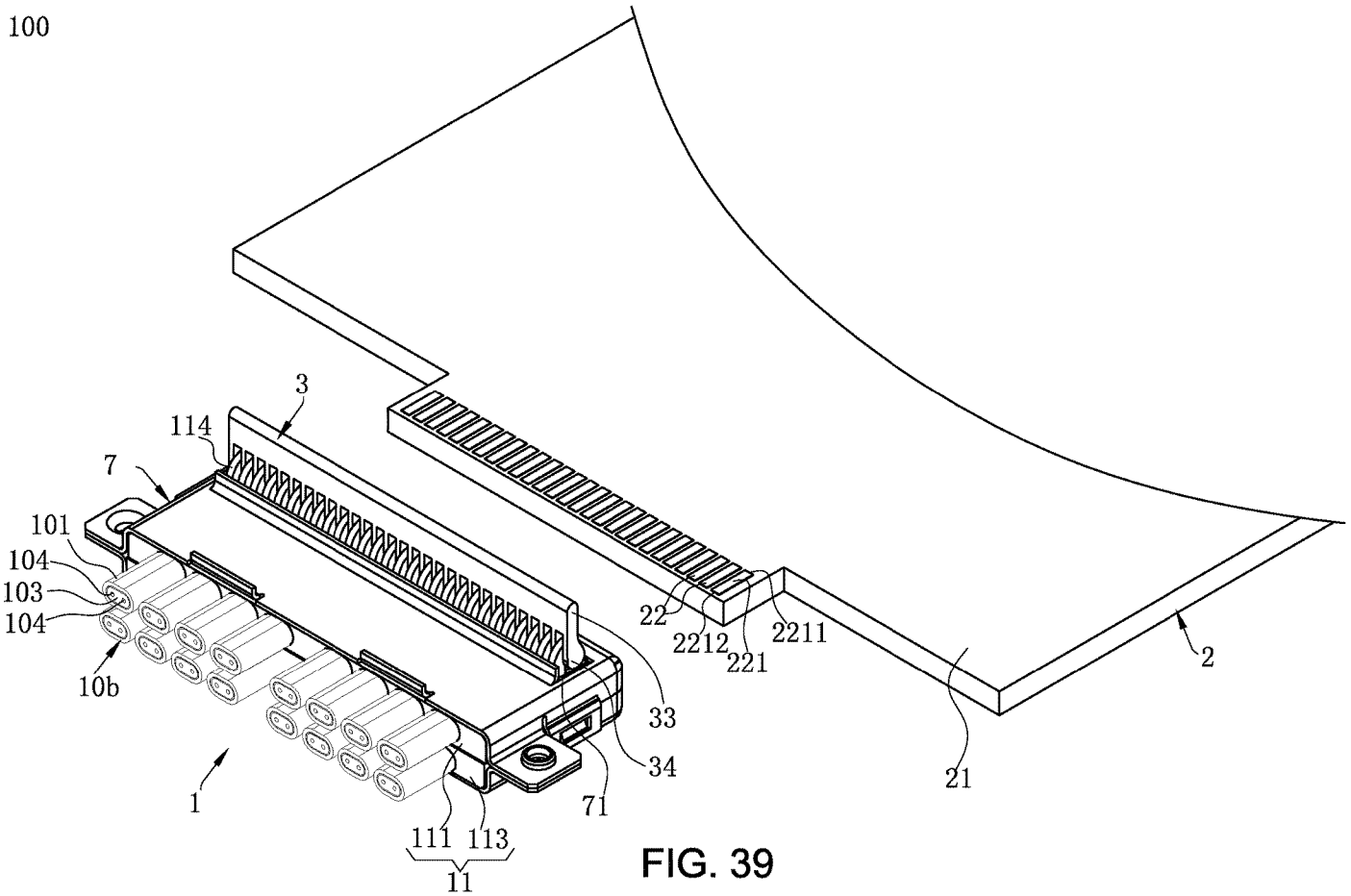
FIG. 39 is a perspective view of the electrical connection device according to a sixth embodiment of the present invention before the first mating element is mated with the second mating element.

As shown in FIG. 39 and FIG. 43, the second mating element 2 is a circuit board configured to be mated with the first mating element 1, and includes a second insulating body 21. A plurality of second conductors 22 are provided on an upper surface of the second insulating body 21. The second conductors 22 include eight pairs of signal pads 22*a* and a plurality of grounding pads 22*b* separating the eight pairs of the signal pads 22*a*. Each signal pads 22*a* is provided with a top surface 221 fully exposed out of the upper surface of the second insulating body 21 and configured to be in contact with the mating section 1041, and the top surface 221 is provided with a front edge 2211 and a rear edge 2212 opposite to each other. The grounding pads 22*b* and the signal pads 22*a* have similar structures, and the grounding pads 22*b* are configured to be electrically connected to the arm portions 142. The second mating element 2 further includes a plurality of fourth conductors 23 correspondingly arranged in vertical symmetry with the second conductors 22, and are provided on a lower surface of the second insulating body 21.

As shown in FIG. 40 and FIG. 43, the elastic body 4 is strip-shaped and is accommodated in the accommodating groove 1111, and is provided right above the mating sections 1041 of the upper row of cables 10*a*. The elastic body 4 has a main body portion 41 and a plurality of protruding portions 42 extending downward from the main body portion 41. Two adjacent ones of the protruding portions 42 are separated by a slot 43. Each of the protruding portions 42 corresponds to one of the mating sections 1041 or one of the arm portions 142.

As shown in FIG. 40 and FIG. 43, the elastic body 4 has a reinforcing member 44 insert-molded on the main body portion 41. The reinforcing member 44 is formed by punching a metal sheet material, and has multiple through holes 441 running vertically therethrough. The through holes 441 are vertically aligned to the slot 43 and are staggered from the protruding portions 42, such that when the elastic body 4 is formed by insert-molding, the elastic material of the elastic body 4 may be filled in the through holes 441 to increase the combining strength of the main body portion 41 and the reinforcing member 44. An elastic element 6 is arranged in vertical symmetry with the elastic body 4, and is provided below the lower row of cables 10*b*. A reinforcing element 61 is finsert-molded on the elastic element 6, and the reinforcing element 61 and the reinforcing member 44 have identical structures.

As shown in FIG. 40 and FIG. 43, the pressing member 3 is an eccentric wheel, having a pushing portion 33 and a plurality of pressing portions 34 extending from one end of the pushing portion 33. The pressing portions 34 are separated from each other, and are connected by a pivot 35, and the pressing member 3 is pivoted on the pivoting portion 114 through the pivot 35. The pressing portions 34 are accommodated in the accommodated grooves 1111 and downward abut the elastic body 4, such that each mating section 1041 and each arm portion 142 align upward to one of the pressing portions 34. The pressing member 3 has an open state and a closed state.

As shown in FIG. 39, before the first mating element 1 is mated with the second mating element 2, the pushing portion 33 is located vertically upward, and the pressing member 3 is in the open state. As shown in FIGS. 41, 43 and 44, the second mating element 2 enters the insertion slot 110 to be mated with the first mating element 1, and the pushing portion 33 is pushed to be in the horizontal direction, such that the pressing member 3 is in the closed state. The pressing portions 34 downward press the main body portion 41, and the main body portion 41 passes the pressure downward and concentrated onto the protruding portion 42. The protruding portions 42 downward press the mating sections 1041 or the arm portions 142 correspondingly, such that the mating sections 1041 abut the corresponding signal pads 22*a*, and the arm portions 142 abut the corresponding grounding pads 22*b*. A foremost end of each mating section 1041 is located between the front edge 2211 and the rear edge 2212 and abuts the top surface 221, the rear edge 2212 abuts the mating section 1041, and the protruding portions 42 are elastically deformed and pressed to enter the slot 43.

As shown in FIG. 39, FIG. 41 and FIG. 43, when the pressing member 3 is switched from the open state to the closed state, it provides a downward acting force, such that the elastic body 4 is elastically deformed, the elastic body 4 downward presses the mating sections 1041, and the mating sections 1041 press the second conductors 22. The downward acting force is further passed downward, such that the fourth conductors 23 move downward to be in contact with the lower row of cables 10*b*, and the lower row of cables 10*b* moves toward the elastic element 6, such that the fourth conductors 23 and the lower row of cables 10*b* are in tight contact. The metal shell 7 bears the elastic element 6, and thereby facilitating the mating process.

The pressing member 3 is not limited to the eccentric wheel. In other embodiments (not shown), the pressing member 3 can be a wedge member. The accommodating groove 1111 runs forward through the first insulating body 11, and the pressing member 3 may be movable in a front-rear direction in the accommodating groove 1111, thereby providing the downward acting force, thus facilitating the pressing process similar to that in the present embodiment.

Figure 45:
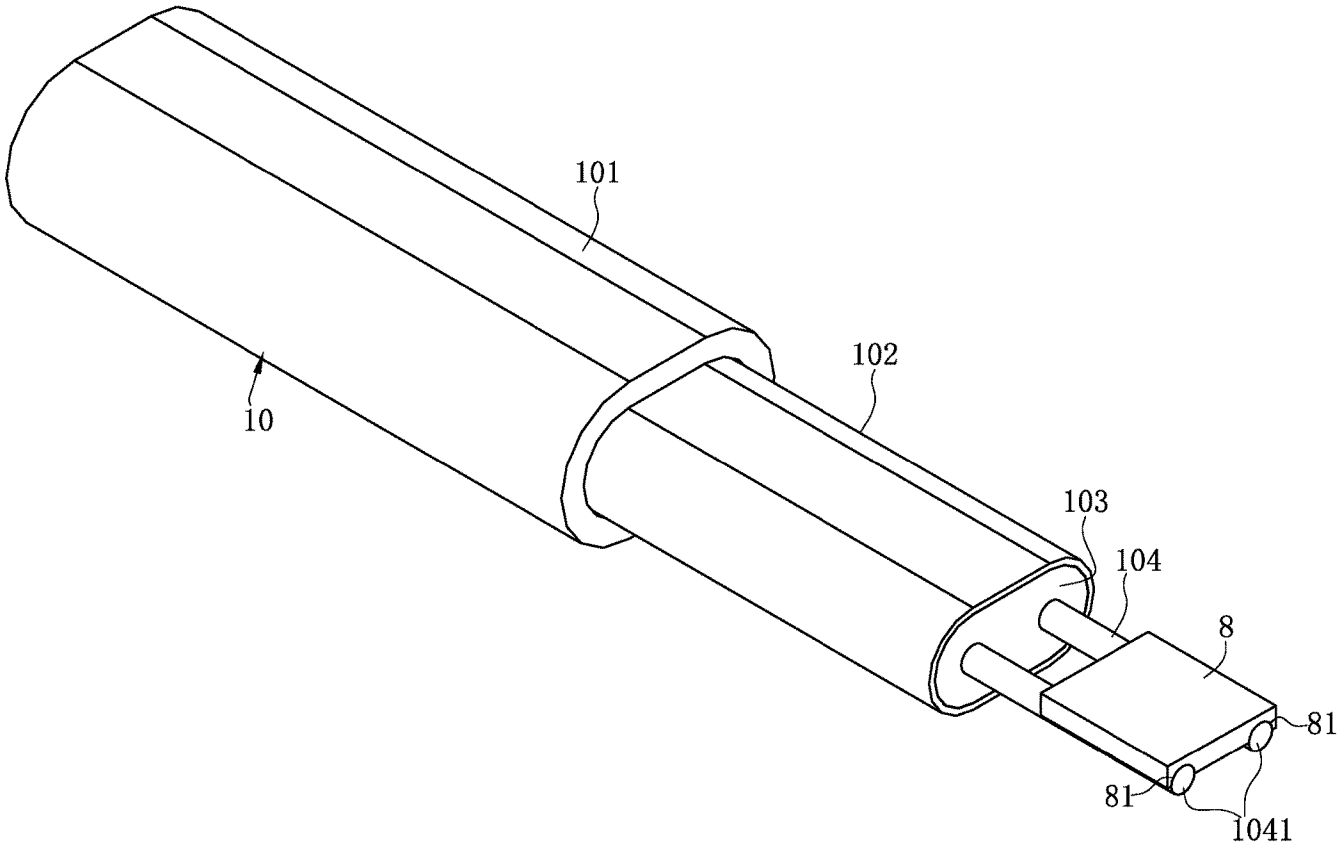
FIG. 45 is a perspective view of an electrical connection device according to a seventh embodiment of the present invention, where a mating section of a cable is accommodated in an insulating body.
Figure 46:
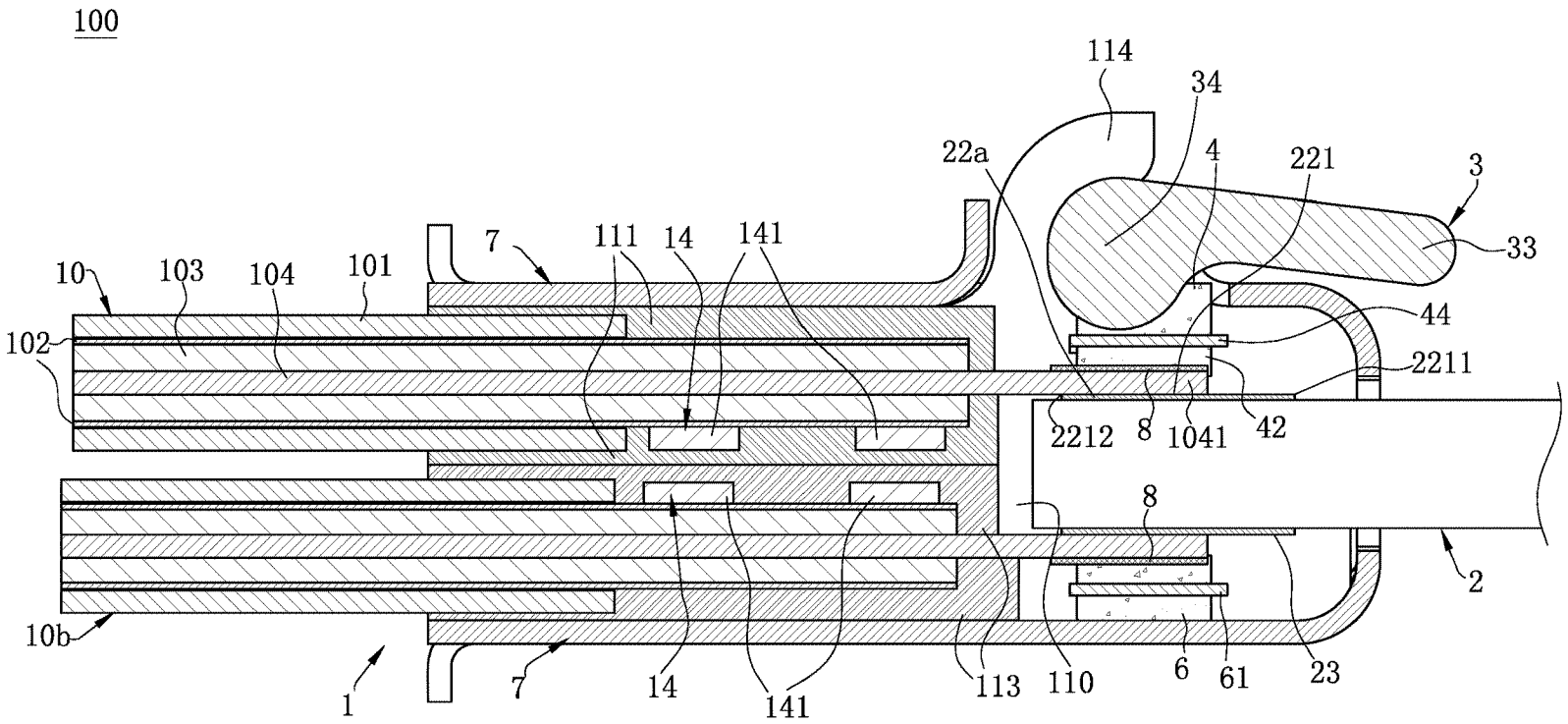
FIG. 46 is a side sectional view of the electrical connection device according to the seventh embodiment of the present invention.

FIG. 45 and FIG. 46 show a seventh embodiment of the electrical connection device 100 of the present invention, which is different from the sixth embodiment in that: an insulating body 8 is provided above the mating sections 1041, and the insulating body 8 has two grooves 81 facing downward for accommodating two of the mating sections 1041 of one cable 10. The insulating body 8 may position the mating sections 1041 in the grooves 81, and provide protection effects to the mating sections 1041. The mating sections 1041 are partially downward exposed out of the grooves 81, allowing the mating sections 1041 to be electrically connected to the top surface 221.

When the pressing member 3 presses on the elastic body 4, the elastic body 4 firstly presses the insulating body 8, and the insulating body 8 then passes the pressure to the mating sections 1041, such that the mating sections 1041 are electrically connected to the top surface 221.

In the present embodiment, the insulating body 8 and the mating sections 1041 are insert-molded, and a foremost end of each mating section 1041 is flush with a front end of each groove 81. In other embodiments, the insulating body 8 can be assembled to the mating sections 1041, and the foremost ends of the mating sections 1041 may be provided not to be exposed from the grooves 81.

Figure 47:
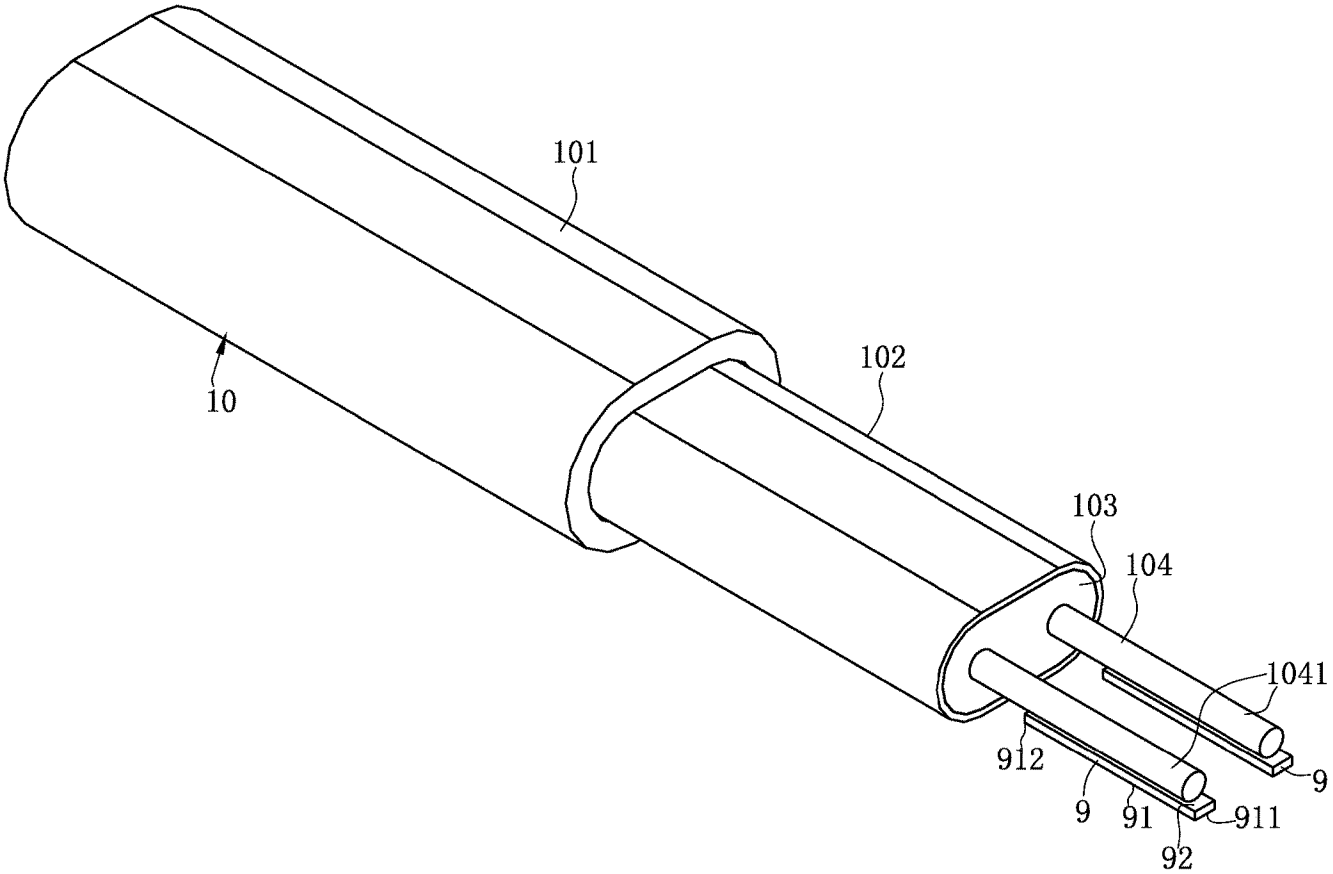
FIG. 47 is a perspective view of a cable of an electrical connection device according to an eighth embodiment of the present invention.
Figure 48:
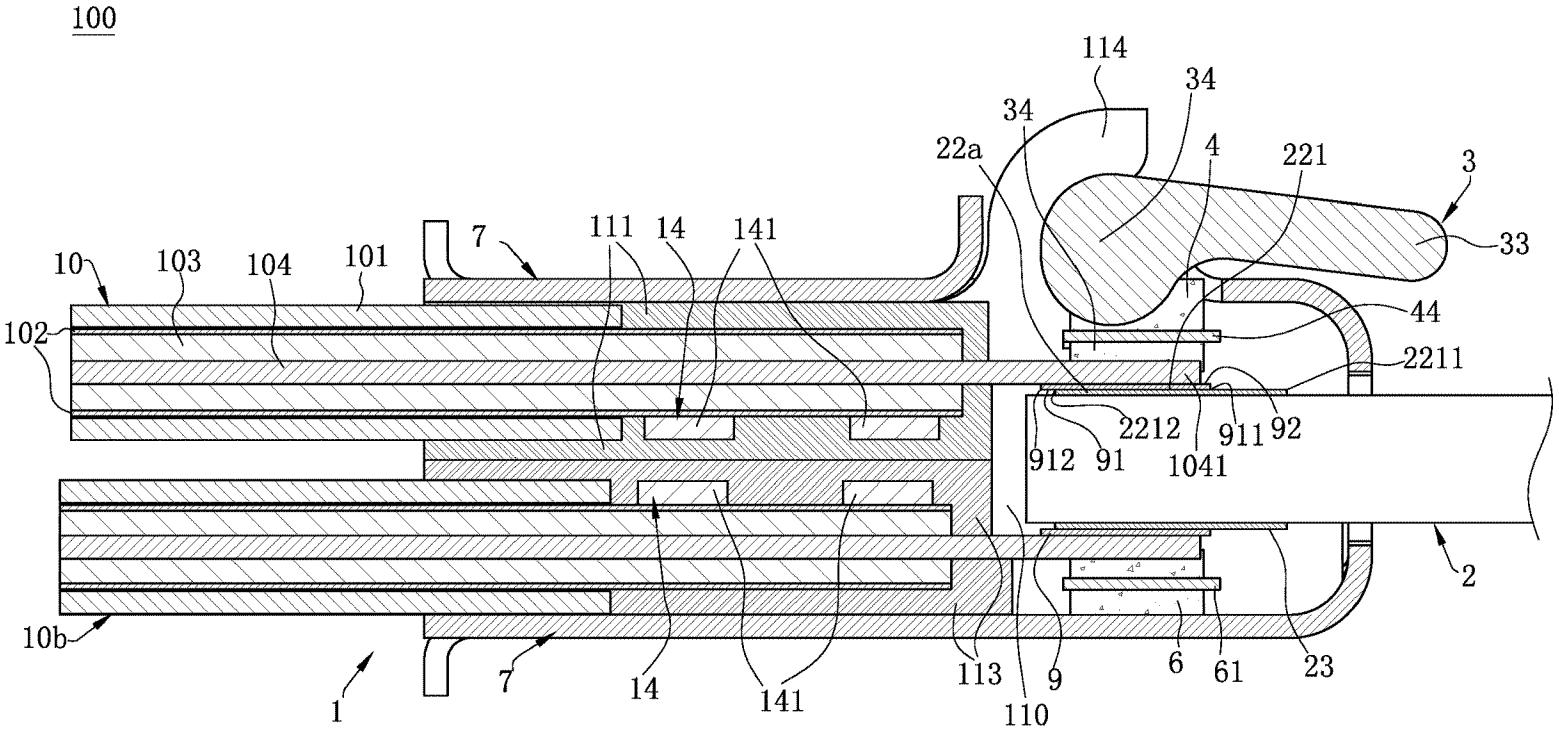
FIG. 48 is a side sectional view of the electrical connection device according to the eighth embodiment of the present invention.

FIG. 47 and FIG. 48 show an eighth embodiment of the electrical connection device 100 of the present invention, which is different from the sixth embodiment in that: a conductive sheet 9, which is strip-shaped, is soldered along a front-rear direction at the bottom of the mating section 1041. The conductive sheet 9 is provided to be plate-shaped, and the conductive sheet has a top surface 92 and a bottom surface 91 opposite to each other. The mating section 1041 is soldered to the top surface 92, and the foremost end of the mating section 1041 abuts the top surface 92. The bottom surface 91 is in contact with the top surface 221, and the bottom surface 91 has a first edge 911 and a second edge 912 opposite to each other in the front-rear direction. When the pressing member 3 presses on the elastic body 4, the elastic body 4 presses the mating section 1041, and the mating section 1041 passes the pressure downward to the conductive sheet 9, such that the first edge 911 abuts the top surface 221, and the rear edge 2212 abuts the bottom surface 91.

In the present embodiment, the conductive sheet 9 and the mating section 1041 are soldered by a solder (not shown). In other embodiments, the conductive sheet 9 and the mating section 1041 may be laser-soldered, or may be soldered by other soldering methods. Certainly, both can be connected mechanically. For example, the conductive sheet 9 can wrap the mating section 1041.

In the present embodiment, the cores 104 are made by pure copper and surface-plated by silver, which is softer for easy bending and deforming. The conductive sheet 9 is made of a copper alloy and surface-plated by gold, which is harder, so as to enhance the strength of the mating section 1041. In other embodiments, the conductive sheet 9 may be made of other conductive materials, such as aluminum alloys, and the surface thereof may be plated by gold or nickel.

The electrical connection device according to certain embodiments of the present invention has the following beneficial effects.

1. The contact areas 1214 are fully attached to the top surfaces 221, the lower edges 1212 are located between the front edges 2211 and the rear edges 2212 and abut the top surfaces 221, and the rear edges 2212 abut the contact areas 1214. Therefore, the rear edges 2212 of the second contactor 22 and the lower edges 1212 of the first contactor 12 are connected with the electric current path to avoid a serious signal radiation to the outer environment, thus effectively decreasing the negative influence of the stake effect, and increasing the quality of high-frequency signal transmission.

2. The pressing member 3 matches with the elastic body 4 to press the first conductors 12 and the second conductors 22, and the elastic body 4 is made of a material with good elasticity, such as silicon rubber. Therefore, even if the first conductors 12 and the second conductors 22 are inserted obliquely without being aligned and then mated, the first conductors 12 or the second conductors 22 can still be deformed elastically within a certain range, such that that the first conductors 12 and the second conductors 22 are in tight contact without damaging the first conductors 12.

3. One of the conducting members 25 is conductively connected to the contact areas 1214, the other conducting member 25 abuts the second conductor 22 between the front edge 2211 and the lower edge 1212, and both are electrically connected to the ground lines 26 at the same time, such that the ground effect is enhanced.

4. The contact 241 is conductively connected to the second conductors 22, and is conductively connected right to the front edges 2211, eliminating open circuits between the signal line 24, the second conductors 22 and the first conductors 12, such that the electrical connection device 100 has excellent high-frequency signal transmission performance.

5. The chamfer 211 extends to the second conductors 22, and the rear edges 2212 are exposed backward out of the chamfer 211, such that the rear edges 2212 can smoothly abut the contact areas 1214, and the chamfer 211 is not too high (for example, the chamfer 211 protrudes upward to be higher than the top surfaces 221 of the signal pads 22*a* of the second conductors 22 or higher than the top surfaces 221 of the ground pads 22*b*) to cause one end of each contact area 1214 to be located on the chamfer 211, and thus failing to be in contact with the rear edge 2212, generating a stake effect to adversely affect the quality of signal transmission.

6. The height of the conformal coating 213 of the upper surface of the circuit board 2 located right behind the signal pads 22*a* and the ground pads 22*b* is lower than the height of the top surfaces 221 of the signal pads 22*a* and the height of the top surfaces 221 of the ground pads 22*b*, such that the rear edges 2212 can smoothly abut the contact areas 1214, and the conformal coating 213 is not too high (for example, the conformal coating 213 protrudes upward to be higher than the top surfaces 221 of the signal pads 22*a* or higher than the top surfaces 221 of the ground pads 22*b*) to cause one end of each contact area 1214 to be located on the conformal coating 213, and thus failing to be in contact with the rear edge 2212, generating a stake effect to adversely affect the quality of signal transmission.

7. The upper surface of the circuit board 2 is coated with the conformal coating 213, and the upper surface of the circuit board 2 is not coated with the conformal coating 213 right behind the signal terminals, preventing the rear edges 2212 of the signal pads 22*a* from being covered by the conformal coating 213, such that the rear edges 2212 of the signal pads 22*a* can smoothly abut the contact areas 1214.

8. In certain embodiments, the contact portions 121 extend upward, which is favorable for the mating between the first conductors 12 and the second conductors 22 with each other. After the first conductors 12 are mated with the second conductors 22, before the pressing member 3 fully presses the elastic body 4, a gap S exists between the lower edges 1212 and the top surfaces 221, the upper edges 1211 abut the elastic body 4, such that the elastic body 4 can conveniently press the whole pressure-bearing areas 1213, flattening the contact portions 121, thereby allowing the contact portions 121 to be in surface contact with the top surfaces 221.

9. The foremost end of the mating section 1041 is located between the front edge 2211 and the rear edge 2212 and abuts the top surface 221, and the rear edge 2212 abuts the mating section 1041. Therefore, the foremost end of the mating section 1041 and the rear edge 2212 are connected with the electric current path, thus effectively decreasing the negative influence of the stake effect, and increasing the quality of high-frequency signal transmission.

10. When the pressing member 3 presses on the elastic body 4, the elastic body 4 simultaneously presses the mating sections 1041 and the arm portions 142, such that the mating sections 1041 and the arm portions 142 respectively elastically press the corresponding second conductors 22, thus increasing the contacting forces of the mating sections 1041 and the arm portions 142 to the corresponding second conductors 22 respectively.

11. When the pressing member 3 presses on the elastic body 4, the protruding portions 42 of the elastic body 4 abut the mating sections 1041, such that the pressure provided by the pressing member 3 can be concentrated and pressed onto the mating sections 1041 by the protruding portions 42, thus increasing the contacting forces of the mating sections 1041 and the second conductors 22. There are multiple protruding portions 42, and the adjacent ones of the protruding portions 42 are separated by the slot 43, such that the protruding portions 42, when being pressed and deformed, are transversely pressed to enter the slot 43.

12. The reinforcing member 44 and the elastic body 4 are insert-molded, so as to increase the mechanical strength of the elastic body 4. The reinforcing member 44 is exposed from the elastic body 4, thus facilitating the positioning of the reinforcing member 44 during insert-molding, and facilitating cutting of the reinforcing member 44 after insert-molding. The through holes 441 provided on the reinforcing member 44 allow the elastic material of the elastic body 4 to fill in the through holes 441, so as to increase the combining strength of the elastic body 4 and the reinforcing member 44.

13. The grooves 81 of the insulating body 8 are configured to accommodate the mating sections 1041. Since the cores 104 are generally made by pure copper, which is softer and may be easily bent, the insulating body 8 may position the mating sections 1041 in the grooves 81, and provide protection effects to the mating sections 1041. The mating sections 1041 are partially downward exposed out of the grooves 81, allowing the mating sections 1041 to be electrically connected to the top surface 221.

14. The conductive sheet 9 is coupled to the bottom of the mating section 1041. Since the cores 104 are generally made by pure copper, which is softer and may be easily bent, the conductive sheet 9 may increase the strength of the mating sections 1041, so as to avoid the mating sections 1041 from mating with the second conductors 22 for multiple times to be bent and deformed. Further, the bottom surface 91 of the conductive sheet 9 is in contact with the top surface 221 of the second conductor 22, which may increase the contact area thereof in comparison to the case where the curved surface of the mating section 1041 is in contact with the top surface 221.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connection device, comprising:

a first mating element comprising a first insulating body, wherein a first conductor is strip-shaped and is accommodated in the first insulating body, the first conductor is provided with a contact portion exposed forward out of the first insulating body, a foremost end of a lower surface of the contact portion is provided with a lower edge, a contact area extends backward from the lower edge, a pressing member is located right above the first conductor, and an elastic body is located between the pressing member and the first conductor, such that the pressing member is configured to downward abut the elastic body, and the elastic body is configured to downward abut the first conductor; and a second mating element comprising a second insulating body, wherein a second conductor is provided in the second insulating body and is located below the first conductor, the second conductor is provided with a front edge and a rear edge opposite to each other and a top surface connected to the front edge and the rear edge, and the top surface is exposed out of an upper surface of the second insulating body, wherein the pressing member provides a downward acting force such that the first conductor downward abuts the second conductor; and when the pressing member presses the elastic body, the contact area is fully attached to the top surface, the lower edge is located between the front edge and the rear edge and is conductively connected to the top surface, and the rear edge abuts the contact area.

2. The electrical connection device according to claim 1, wherein the contact area is narrow at a front thereof and wide at a rear thereof.

3. The electrical connection device according to claim 1, wherein:

the second insulating body is provided with a guide surface located behind the second conductor and configured to guide the first conductor to be in contact with the second conductor; and when the first mating element is mated with the second mating element, the contact area slides along the guide surface and the top surface respectively, the guide surface scrapes the contact area, and the contact area and the top surface scrape each other.

4. The electrical connection device according to claim 1, wherein when the second mating element is mated with the first mating element, before the pressing member presses the elastic body, a gap exists between the lower edge and the top surface; and when the pressing member presses the elastic body, the elastic body abuts the contact portion, such that the contact portion moves toward the gap until the gap disappears.

5. The electrical connection device according to claim 1, wherein the second insulating body is provided with a sloped chamfer located behind the second conductor, the chamfer extends to the second conductor, and the chamfer does not forwardly cover the rear edge.

6. The electrical connection device according to claim 1, wherein the second mating element is a circuit board, an upper surface of the circuit board is provided with conformal coating, and the upper surface of the circuit board is not provided with the conformal coating right behind the second conductor.

7. The electrical connection device according to claim 1, wherein the second mating element is a circuit board, an upper surface of the circuit board is provided with conformal coating, the circuit board is provided with the conformal coating right behind the second conductor, and the upper surface of the conformal coating is not higher than the top surface.

8. The electrical connection device according to claim 1, wherein the second mating element is a circuit board, the second conductor comprises a signal pad, and the circuit board is provided with a signal line having a contact conductively connected to the signal pad between the lower edge and the front edge.

9. The electrical connection device according to claim 1, wherein the second mating element is a circuit board, the second conductor comprises a signal pad, and the circuit board is provided with a signal line having a contact conductively connected to the front edge.

10. The electrical connection device according to claim 1, wherein an area of the contact area is greater than or equal to one half of an area of the top surface.

11. The electrical connection device according to claim 1, wherein a foremost end of a upper surface of the contact portion is provided with an upper edge, a pressure-bearing area extends backward from the upper edge, and the elastic body is attached from the pressure-bearing area to the upper edge.

12. The electrical connection device according to claim 11, wherein the upper edge is located in front of the lower edge.

13. The electrical connection device according to claim 11, wherein the first conductor has a base, the contact portion extends upward from the base, and the upper edge abuts the elastic body.

14. The electrical connection device according to claim 13, wherein the contact portion extends upward as a whole.

15. The electrical connection device according to claim 13, wherein along an extending direction of the contact portion, the contact portion first extends downward and then extends obliquely upward.

16. The electrical connection device according to claim 1, wherein:

the first mating element further comprises a third conductor provided in vertical symmetry with the first conductor and accommodated in the first insulating body;

the second mating element further comprises a four conductor provided in vertical symmetry with the second conductor and accommodated in the second insulating body;

the second mating element is a circuit board;

each of the second conductor and the fourth conductor comprises a ground pad;

the circuit board is provided with an accommodating hole, and a conducting member is accommodated in the accommodating hole;

the ground pad of the second conductor and the ground pad of the fourth conductor are electrically conducted with each other through the conducting member; and the circuit board is provided with a ground line, and the conducting member is electrically connected to the ground line.

17. The electrical connection device according to claim 16, wherein:

an insulating member is provided with a space, the elastic body is provided in the space and upward abuts the insulating member, and the pressing member downward abuts the insulating member; and an elastic element is provided in the space and located below the third conductor, and upward abuts the third conductor, such that the third conductor upward abuts the fourth conductor, and the elastic element downward abuts the insulating member.

18. The electrical connection device according to claim 16, wherein the conducting member is located right below the contact area.

19. The electrical connection device according to claim 16, wherein the accommodating hole runs upward through the second conductor, such that the conducting member is exposed out of the top surface, and the conducting member abuts the contact area.

20. The electrical connection device according to claim 16, wherein the conducting member is conductively connected between the lower edge and the front edge.

21. The electrical connection device according to claim 16, wherein the conducting member is conductively connected between the lower edge and the rear edge.

22. An electrical connection device, comprising:

a first mating element comprising at least one cable, wherein each cable has at least one core and an insulating layer wrapping the at least one core, and a shielding layer wrapping the insulating layer, wherein each of the at least one core has a mating section extending forward out of the insulating layer, a pressing member is located right above the mating section, and an elastic body is located between the pressing member and the mating section; and a second mating element comprising a insulating body below the mating section, wherein at least one conductor is provided in the insulating body and is at least partially located below the mating section, the conductor has a top surface exposed on an upper surface of the insulating body, the top surface has a front edge and a rear edge opposite to each other, and a foremost end of the mating section is located between the front edge and the rear edge;

wherein the pressing member provides a downward acting force such that the mating section downward abuts the conductor; and when the pressing member presses the elastic body, the elastic body is pressed and deforms to pass pressure to the mating section, the foremost end of the mating section is conductively connected to the top surface, and the rear edge abuts the mating section.

23. The electrical connection device according to claim 22, wherein the cable is a dual axis cable having two cores provided in parallel in a same one of the shielding layer and configured to transmit differential signals, and a sheath is provided to wrap the shielding layer.

24. The electrical connection device according to claim 22, wherein when the pressing member presses the elastic body, the elastic body abuts the foremost end of the mating section.

25. The electrical connection device according to claim 22, wherein there are a plurality of cables provided in parallel, and a grounding strip is electrically connected to the shielding layers of the cables.

26. The electrical connection device according to claim 22, wherein an insulating body is provided between the elastic body and the mating section, the insulating body has a groove configured to accommodate each mating section, and the mating section is downward partially exposed out of the groove.

27. The electrical connection device according to claim 22, wherein the pressing member has a pushing portion configured to operate the pressing member, and a pressing portion extends from one end of the pushing portion to abut the elastic body.

28. The electrical connection device according to claim 27, wherein the pressing member is an eccentric wheel or a wedge member.

29. The electrical connection device according to claim 22, wherein the elastic body has a main body portion and at least one protruding portion extending downward from the main body portion, and when the pressing member presses the elastic body, the protruding portion abuts the mating section.

30. The electrical connection device according to claim 29, wherein the elastic body has a plurality of protruding portions, and a slot is provided between adjacent ones of the protruding portions to separate the adjacent ones of the protruding portions.

31. The electrical connection device according to claim 22, wherein a grounding strip is electrically connected to the shielding layer.

32. The electrical connection device according to claim 31, wherein the grounding strip has a grounding portion, and an arm portion extending from the grounding portion to be in contact with another one of the at least one conductor.

33. The electrical connection device according to claim 32, wherein when the pressing member presses the elastic body, the elastic body simultaneously presses on the mating section and the arm portion.

34. The electrical connection device according to claim 22, wherein a reinforcing member is provided on the elastic body to increase a mechanical strength thereof.

35. The electrical connection device according to claim 34, wherein the reinforcing member and the elastic body are formed by injection molding, and the reinforcing member is exposed on the elastic body.

36. The electrical connection device according to claim 34, wherein the reinforcing member has at least one through hole vertically penetrating the reinforcing member.

37. An electrical connection device, comprising:

a first mating element comprising a cable, wherein the cable has a core and an insulating layer wrapping the core, and a shielding layer wrapping the insulating layer, wherein the core has a mating section extending forward out of the insulating layer, a conductive sheet is coupled to a bottom of the mating section, a pressing member is located right above the mating section, and an elastic body is located between the pressing member and the mating section; and a second mating element comprising a insulating body, wherein at least one conductor is provided in the insulating body and is located below the mating section, the conductor has a top surface exposed on an upper surface of the insulating body;

wherein the pressing member provides a downward acting force such that the conductive sheet is downward conductively connected to the conductor; and when the pressing member presses the elastic body, the elastic body is pressed and deforms to pass pressure to the mating section, such that the conductive sheet is electrically connected to the top surface.

38. The electrical connection device according to claim 37, wherein the conductive sheet has a top surface and a bottom surface vertically opposite to each other, a foremost end of the mating section is electrically connected to the top surface of the conductive sheet, the bottom surface is configured to be electrically connected to the top surface of the conductor, a front end of the bottom surface has a first edge, the top surface of the conductor has a front edge and a rear edge opposite to each other, and when the pressing member presses the elastic body, the first edge abuts the top surface of the conductor, and the rear edge abuts the bottom surface.

39. The electrical connection device according to claim 37, wherein a hardness of the conductive sheet is greater than a hardness of the core.

* * * * *